US008586270B2

(12) United States Patent
Arai et al.

(10) Patent No.: US 8,586,270 B2
(45) Date of Patent: Nov. 19, 2013

(54) ELECTROPHOTOGRAPHIC PHOTOCONDUCTOR, ELECTROPHOTOGRAPHIC METHOD, AND ELECTROPHOTOGRAPHIC APPARATUS

(75) Inventors: Ryota Arai, Shizuoka (JP); Tomoyuki Shimada, Shizuoka (JP); Minoru Umeda, Niigata (JP)

(73) Assignee: Ricoh Company, Ltd., Tokyo (JP)

( * ) Notice: Subject to any disclaimer, the term of this patent is extended or adjusted under 35 U.S.C. 154(b) by 91 days.

(21) Appl. No.: 13/433,917

(22) Filed: Mar. 29, 2012

(65) Prior Publication Data

US 2012/0251934 A1 Oct. 4, 2012

(30) Foreign Application Priority Data

Mar. 30, 2011 (JP) ..... 2011-074441

(51) Int. Cl.
*G03G 15/02* (2006.01)

(52) U.S. Cl.
USPC ..... 430/57.3; 430/58.5; 430/59.3; 399/116; 399/159

(58) Field of Classification Search
USPC ..... 430/57.3, 58.5, 59.3; 399/116, 159
See application file for complete search history.

(56) References Cited

FOREIGN PATENT DOCUMENTS

| | | |
|---|---|---|
| JP | 60-196768 | 10/1985 |
| JP | 2732697 | 12/1997 |
| JP | 2884353 | 2/1999 |
| JP | 2000-231204 | 8/2000 |
| JP | 2004-258253 | 9/2004 |
| JP | 2007-212741 | 8/2007 |
| JP | 4101676 | 3/2008 |
| JP | 4226749 | 12/2008 |

OTHER PUBLICATIONS

Machine Translation of JP2007-212741.*

Itami, et al., "The Effects of Nitrogen Oxide on the Resolution of Organic Photoconductors", Konica technical Report, vol. 13, 2000, 5 pages (with Partial Engish Translation).

* cited by examiner

*Primary Examiner* — Thorl Chea

(74) *Attorney, Agent, or Firm* — Oblon, Spivak, McClelland, Maier & Neustadt, L.L.P.

(57) ABSTRACT

An electrophotographic photoconductor including: an electrically conductive substrate; and at least a photoconductive layer thereon, wherein the photoconductive layer contains a diazapentadiene derivative represented by general formula (1):

General Formula (1)

where "X" represents general formula (a), (b) or (c); "$R^1$" and "$R^2$" each represent substituted or unsubstituted alkyl group or aromatic hydrocarbon group, and may be the same or different; "$R^1$" and "$R^2$" may be joined together via "Y" to form a ring; "Y" represents single bond, oxygen atom, —$CH_2CH_2$—, or —CH=CH—, General Formula (a)

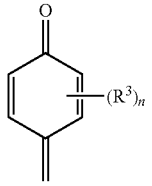

General Formula (b)

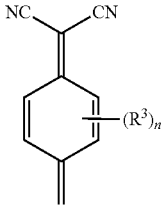

-continued

General Formula (c)

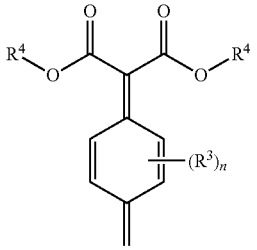

where "$R^3$" represents substituted or unsubstituted alkyl group, aromatic hydrocarbon group, alkoxy group, alkoxycarbonyl group, or halogen group; "$R^4$" represents substituted or unsubstituted alkyl or aromatic hydrocarbon group; "n" represents integer ranging from 0 to 4; and when "n" is integer of 2 to 4, "$R^3$" may be the same or different.

13 Claims, 10 Drawing Sheets

ELECTROPHOTOGRAPHIC PHOTOCONDUCTOR, ELECTROPHOTOGRAPHIC METHOD, AND ELECTROPHOTOGRAPHIC APPARATUS

BACKGROUND OF THE INVENTION

1. Field of the Invention

The present invention relates to an electrophotographic photoconductor that contains at least one specific type of diazapentadiene derivative in a photoconductive layer, and an electrophotographic method and electrophotographic apparatus.

2. Description of the Related Art

In recent years, information processing system machines that use electrophotographic systems have remarkably advanced. In particular, laser printers and digital copying machines, which record information optically by converting the information to digital signals, have shown remarkable improvements in print quality and reliability. Furthermore, the above have been used in combination with high-speed technologies, and applied to laser printers or digital copying machines capable of full-color printing. Under such a background, as for a required function of the photoconductor, having both high image quality and high durability is considered to be crucial.

As for a photoconductor that is used in a laser printer, a digital copying machine or the like with such an electrophotographic system, in general, one that uses an organic photosensitive material (OPC) is widely applied in terms of costs, productivity, pollution free characteristics and other reasons. The layer structures of the OPC photoconductor can be broadly classified into the following two: a single layer type and a functionally separation-type laminated structure. A PVK-TNF charge-transfer complex-type photoconductor, which is the first OPC put into practical use, is a single layer type of the former.

Meanwhile, in 1968, Hayashi and Regensburger separately invented a PVK/a-Se laminated photoconductor. Later, by Melz et al. in 1977, and by Schlosser in 1978, a laminated photoconductor whose photoconductive layer is all made of organic materials, i.e. an organic pigment dispersion layer and an organic low-molecular dispersion polymer layer, was announced. The laminated photoconductor is also referred to as a functional separation-type laminated photoconductor because of the concept that the laminated photoconductor includes a charge generation layer (CGL), which absorbs light to generate an electric charge, and a charge transport layer (CTL), which injects and transfers the charge generated by the CGL to neutralize a surface charge.

However, when being repeatedly used, a film of the organic photoconductor becomes scraped more seriously than an inorganic one. As the film of the photoconductive layer becomes scraped even more seriously, the following tend to be accelerated: decreases in charge potential of the photoconductor, degradation of light sensitivity, scumming associated with surface scratches of the photoconductor or the like, decreases in image density, or image degradation. Therefore, the wear and abrasion resistance of the organic photoconductor has been cited as a major issue. Furthermore, in recent years, the photoconductor has become smaller in diameter as electrophotographic apparatuses have become faster, or as the devices have become smaller in size. Therefore, increasing the durability of the photoconductor is considered an even more important issue.

As for a method of realizing an improved wear and abrasion resistance of the photoconductor, the following methods have been widely known: a method of adding lubricity to a photoconductive layer, hardening a photoconductive layer, or containing a filler in a photoconductive layer; or a method of using a high-molecular charge transport material instead of a low-molecular charge transport material (CTM) molecular dispersion polymer layer. However, when the scraping of the photoconductive layer is curbed by the above methods, a new problem arises. That is, it has been known that the following problem arises: ozone, NOx and other oxidizing substances, which are generated due to repeated use or the surrounding environment, are adsorbed on to a surface of a photoconductive layer; depending on repeated use or the usage environment, the resistance of an outermost surface is reduced, resulting in image deletion (blurred images) and other problems. According to the conventional method, a blur-generating substance has been gradually scraped off together with the photoconductive layer, and the problem has been avoided to some extent.

However, as described above, in order to meet the recent need for higher resolution images and higher durability, the addition of a new method is increasingly sought. One method to mitigate the effects thereof is a method of mounting a heater on a photoconductor. However, the method has become a major obstacle in making the device smaller in size and reducing power consumption. Among the effective measures to be taken are additive agents such as antioxidants. However, a mere additive agent does not have photoconductivity. Therefore, when large amounts of the additive agent are added to the photoconductive layer, the following and other problems associated with electrophotographic characteristics arise: lower sensitivity and increases in residual potential.

As described above, an electrophotographic photoconductor that is less seriously scraped off due to the addition of a higher wear and abrasion resistance or due to a process design around the photoconductor cannot prevent effects on image quality, including the occurrence of blurred images, decreases in resolution and other side effects; having both high durability and high image quality has been considered difficult. The reason is that higher resistance is suitable for suppressing the occurrence of blurred images, while lower resistance is suitable for curbing a rise in residual potential. It is difficult to solve the problem as both are in a trade-off relationship.

Most of the electrophotographic photoconductors in practical use are of a functional separation-type, in which a charge generation layer and a charge transport layer are stacked on a conductive substrate. For a charge transport material contained in the charge transport layer, a hole transport material is used. The above is exclusively used for a negatively charged electrophotographic process.

Moreover, a highly reliable charging method in the electrophotographic process uses a corona discharge. Most of the copying machines and printers employ the above method. However, as is well known, compared with a positive polarity one, a corona discharge of negative polarity is unstable. Accordingly, a charging method that uses a scorotron is adopted, contributing to an increase in costs. The corona discharge of negative polarity entails generating larger amounts of ozone, a substance that causes chemical damage. When being used for a long period of time, the problem arises that the image quality decreases due to: oxidative degradation of a binder resin and a charge transfer material, which is attributable to ozone that occurs at a time when charging takes place; and accumulation of, on the surface of the photoconductor, an ionic compound that is generated at a time when charging takes place, such as a nitrogen oxide ion, sulfur oxide ion or ammonium ion, for example. Accordingly, in order to prevent ozone from being discharged into the outside, a copying machine and printer of a negative charging type often use an ozone filter, contributing to an increase in costs of the devices. Moreover, large amounts of ozone generated cause problems of environmental pollution.

To solve the above problems, the development of a positive charging-type electrophotographic photoconductor is underway. The positive charging type can reduce the amount of ozone, nitrogen oxide ions and the like to be generated. Furthermore, when a two-component developing agent, which is currently widely used, is used, the positive charging-type electrophotographic photoconductor is better in obtaining a stable image with less environmental variation. Even in that regard, the positive charging-type electrophotographic photoconductor is desirable.

However, the single layer type of the positive charging type and a reversely-layered photoconductor have the following drawback: The fluctuation of properties associated with surrounding environmental gases, such as exhaust gases from blue heaters or cars, is large because a charge generation material, which is extremely susceptible to oxidizing substances such as ozone and nitrogen oxide ion, is positioned near the surface.

Meanwhile, in the case of a high-speed copying process, rather than the positive charging type as described above, the negative charging type is preferably used. The reason is as follows: an organic material, which shows charge mobility so high that no problem is posed for the high-speed copying process or the like, is substantially limited to a hole transport material that only has hole-transfer characteristics at the moment; in an orderly-layered laminated-type electrophotographic photoconductor in which a charge transport layer made of a hole transport material is positioned on the surface side, the electrification characteristic thereof is therefore limited to a negatively charged one in terms of operating principles.

As described above, regarding charging polarity, if the electrophotographic photoconductor can be used in both positively-charged and negatively-charged polarities, then it is possible to further expand the application range of the photoconductor. The expanded application range is beneficial in reducing costs with a reduction in the number of types of photoconductor, as well as in increasing the speed, among other things.

Under such a situation, an electrophotographic photoconductor capable of bipolar charging is disclosed in Japanese Patent (JP-B) No. 2732697. However, a diphenoquinone derivative, which is an electron transport material used in the electrophotographic photoconductor, is slightly lower in charge mobility. As a result, the sensitivity characteristics of the photoconductor are not sufficient enough to increase the speed of a copying machine or printer and to reduce the size thereof. Another disadvantage is that the repeated use thereof would blur an image.

What is disclosed in Japanese Patent Application Laid-Open (JP-A) No. 2000-231204 is an aromatic compound having a dialkylamino group, which is used as an acid scavenger for photoconductor. The compound is beneficial for image quality after repeated use. However, the charge transport ability thereof is low, making it difficult to meet the need for higher sensitivity and higher speed. Accordingly, there is also a limit on the additive amount.

Moreover, the following is disclosed in [Itami et al., Konica Technical Report, Volume 13, Page 37, 2001]: A stilbene compound having a dialkylamino group, which is disclosed in JP-A No. 60-196768, JP-B No. 2,884,353 and the like, is also effective for images blurred by oxidation-resistance gas.

However, the above has a dialkylamino group, which is a substituent having a strong mesomeric effect (+M effect) in a resonance region of a triarylamine structure, which is a charge transport site. Therefore, an ionization potential value of the whole is abnormally small. Accordingly, the charge retention capacity of the photoconductive layer that is used alone as a hole transport material becomes remarkably worse from the beginning, or due to repeated use. Therefore, the fatal disadvantage is that the practical application thereof is extremely difficult. Even when being mixed with other charge transport materials for combination use, an ionization potential value of the stilbene compound is far smaller than the above. As a result, the stilbene compound ends up being a hole trap site for mobile charges, resulting in an electrophotographic photoconductor that is extremely low in sensitivity and has large residual potential.

What is proposed in JP-A No. 2004-258253 is a photoconductor that contains a stilbene compound and a specific diamine compound and has the improved environmental tolerance for repeated use, acid gas and the like without causing a decrease in sensitivity.

However, the above is still not sufficient enough to make possible high-speed printing, or to make the device smaller in size in accordance with a smaller diameter of the photoconductor.

The use of a diazapentadiene derivative as decoloring dye for a heat developing material is disclosed (JP-A No. 2007-212741). However, the document does not suggest that the diazapentadiene derivative is used for an electrophotographic photoconductor.

The object of the present invention is to provide an electrophotographic photoconductor that is high in durability even when being used repeatedly for a long period of time; suppresses the degradation of images associated with a decrease in image density or the occurrence of blurred images; and can obtain high-quality images in a stable manner. Another object is to provide an electrophotographic method, electrophotographic apparatus, and electrophotographic process cartridge that can obtain a photoconductor that supports bipolar charging; uses the above photoconductor and therefore is not required to replace the photoconductor; makes possible high-speed printing or makes a device smaller in size in accordance with a smaller diameter of the photoconductor; and can obtain high-quality images in a stable manner even at the time of repeated use.

SUMMARY OF THE INVENTION

An electrophotographic photoconductor of the present invention includes at least a photoconductive layer on an electrically conductive substrate, wherein the photoconductive layer contains a diazapentadiene derivative represented by the following general formula (1).

General Formula (1)

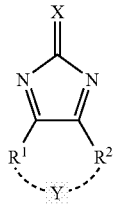

In the general formula (1), "X" represents the following general formula (a), (b) or (c); "$R^1$" and "$R^2$" each represent a substituted or unsubstituted alkyl group or a substituted or unsubstituted aromatic hydrocarbon group, and may be the same or different; the "$R^1$" and "$R^2$" may be joined together via "Y," forming a ring; "Y" represents a single bond, an oxygen atom, —$CH_2CH_2$—, or —CH═CH—.

General Formula (a)

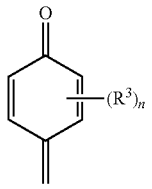

General Formula (b)

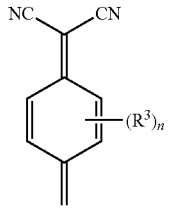

General Formula (c)

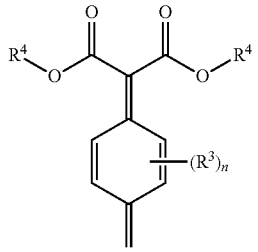

In the general formula (a), (b) or (c), "$R^3$" represents a substituted or unsubstituted alkyl group, a substituted or unsubstituted aromatic hydrocarbon group, a substituted or unsubstituted alkoxy group, an alkoxycarbonyl group, and a halogen group, and may be the same or different; "$R^4$" represents a substituted or unsubstituted alkyl group, or a substituted or unsubstituted aromatic hydrocarbon group; "n" represents an integer ranging from 0 to 4.

As will be better understood from the following detailed and concrete descriptions, according to the present invention, the diazapentadiene derivative represented by the general formula (1) is contained. Therefore, there is a significant improvement in environmental tolerance for repeated use, oxidized gas and the like without causing a decrease in sensitivity. Thus, it becomes possible to obtain a photoconductor that is high in durability and has a high-resolution image quality for a long term. According to the present invention, the great advantage is to be able to provide an electrophotographic photoconductor that is high both in durability and image quality, is able to obtain high-quality images over a long period of time in a stable manner and can support bipolar charging, as well as to be able to provide an electrophotographic method, electrophotographic apparatus, and electrophotographic apparatus process cartridge that use the electrophotographic photoconductor.

DETAILED DESCRIPTION OF THE INVENTION

Figure 1:
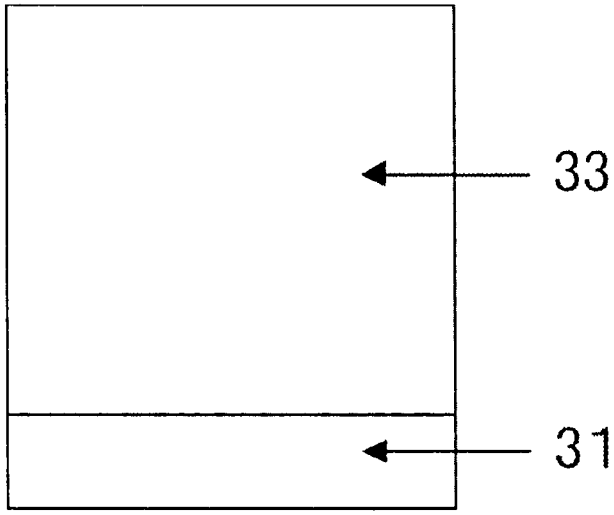
FIG. 1 is a cross-sectional view of an electrophotographic photoconductor according to the present invention.

As a result of research by the present inventors, it was found that, when a photoconductive layer contains at least one diazapentadiene derivative represented by the following general formula (1), it is possible to solve the above problems, including blurring of images (image deletion) associated with a blur generating substance such as oxidized gas, as well as to obtain a photoconductor that can support bipolar charging.

General Formula (1)

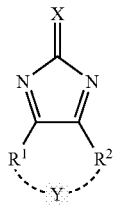

In the above general formula (1), "X" represents the following general formula (a), (b) or (c); "$R^1$" and "$R^2$" each represent a substituted or unsubstituted alkyl group, or a substituted or unsubstituted aromatic hydrocarbon group.

The above may be the same, or different from each other. Moreover, the above "$R^1$" and "$R^2$" may be joined together via "Y," forming a ring. "Y" represents a single bond, an oxygen atom, —$CH_2CH_2$—, or —CH═CH—.

General Formula (a)

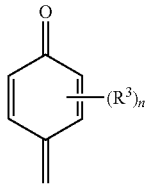

General Formula (b)

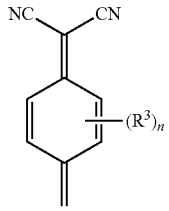

General Formula (c)

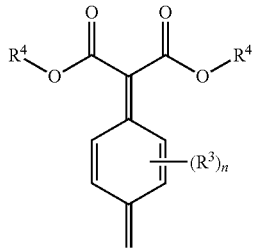

In the above general formula (a), (b) or (c), "$R^3$" represents a substituted or unsubstituted alkyl group, a substituted or unsubstituted aromatic hydrocarbon group, a substituted or unsubstituted alkoxy group, an alkoxycarbonyl group, and a halogen group. The above may be the same, or different from each other. "$R^4$" represents a substituted or unsubstituted alkyl group, or a substituted or unsubstituted aromatic hydrocarbon group; "n" represents an integer ranging from 0 to 4.

According to the present invention, the reason why the diazapentadiene derivative is beneficial in maintaining image quality even at the time of repeated use is not clear at the moment. However, in general, a nitrogen atom contained in the chemical structure of a hydrocarbon material is basic. Therefore, an electrical neutralization effect can be expected to kick in for the oxidized gas, which is considered to be a substance that causes images to blur. Moreover, in terms of a dipole function within a molecule, a nitrogen atom, which is an aromatic ring member, acts as an electron-attracting portion for a carbon atom, which is another member of the ring, as if a nitrogen atom of a nitroso group does. Therefore, it is easy to adopt a resonance structure of the nitrogen atom and the quinone site in the general formula (1). Thus, the above is also expected to be excellent in terms of electron transport property.

Moreover, the diazapentadiene derivative of the present invention is used together with another electron transport material. Therefore, there are further improvements in sensitivity, stability at the time of repeated use, and other factors.

Moreover, the diazapentadiene derivative of the present invention is an electron transport material. Therefore, as for a photoconductor that uses the diazapentadiene derivative, it is also possible to obtain a single layer-type photoconductor that can support bipolar charging depending on the type of the layer structure and when being mixed with a hole transport material.

Therefore, by satisfying the following configuration requirements, it has become possible to have both higher durability and higher image quality; to provide an electrophotographic photoconductor that can obtain a high-quality image in a stable manner even at the time of repeated use and support bipolar charging; and to provide an electrophotographic method, electrophotographic apparatus and electrophotographic process cartridge that can obtain a high-quality image in a stable manner even at the time of repeated use.

The following describes in detail an electrophotographic photoconductor of the present invention, as well as an electrophotographic method, electrophotographic apparatus and electrophotographic process cartridge that use the electrophotographic photoconductor.

(Electrophotographic Photoconductor)

An electrophotographic photoconductor of the present invention (also simply referred to as a "photoconductor," hereinafter) is an electrophotographic photoconductor where at least a photoconductive layer is provided on an electrically conductive substrate. The photoconductive layer contains a diazapentadiene derivative represented by the following general formula (1).

First, the diazapentadiene derivative represented by the following general formula (1), which is contained in the photoconductive layer according to the present invention, will be described in detail.

General Formula (1)

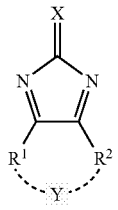

In the above general formula (1), "X" represents the following general formula (a), (b) or (c); "$R^1$" and "$R^2$" each represent a substituted or unsubstituted alkyl group, or a substituted or unsubstituted aromatic hydrocarbon group. The above may be the same, or different from each other. Moreover, the above "$R^1$" and "$R^2$" may be joined together via "Y," forming a ring. "Y" represents a single bond, an oxygen atom, —$CH_2CH_2$—, or —CH═CH—.

General Formula (a)

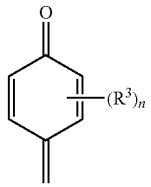

General Formula (b)

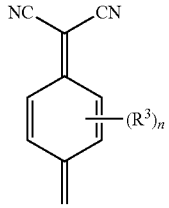

-continued

General Formula (c)

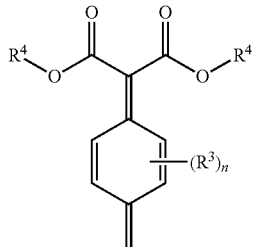

In the above general formula (a), (b) or (c), "$R^3$" represents a substituted or unsubstituted alkyl group, a substituted or unsubstituted aromatic hydrocarbon group, a substituted or unsubstituted alkoxy group, an alkoxycarbonyl group, and a halogen group. The above may be the same, or different from each other. "$R^4$" represents a substituted or unsubstituted alkyl group, or a substituted or unsubstituted aromatic hydrocarbon group; "n" represents an integer ranging from 0 to 4.

As for a method of producing the diazapentadiene derivative represented by the above general formula (1), in the first stage, in the presence of a solvent, or in the absence of a solvent, a 1,2-diketone derivative, an aldehyde derivative, and ammonium acetate react with each other, and an imidazole derivative is obtained as a result. In the second stage, the imidazole derivative is oxidized in the presence of a solvent, and the diazapentadiene derivative represented by the above general formula (1) is therefore produced.

The solvent is not specifically restricted, and can be selected appropriately according to the purpose. However, the following can be listed: benzene, toluene, xylene, chloronaphthalene, acetic acid, pyridine, methylpyridine, N,N-dimethylformamide, N,N-dimethylacetamide, dimethyl ethylene urea, dimethyl sulfoxide, dichloromethane, chloroform, and the like. The temperature of the above reaction is not specifically restricted, and can be selected appropriately according to the purpose. However, the temperature is preferably between room temperature and 250° C.

More specifically, for example, as described below, in the first process, a 1,2-diketone derivative and an aldehyde derivative react with each other, and an imidazole compound is obtained as a result; in the second process, the imidazole derivative is oxidized, and the diazapentadiene derivative represented by the above general formula (1) is produced as a result.

First process

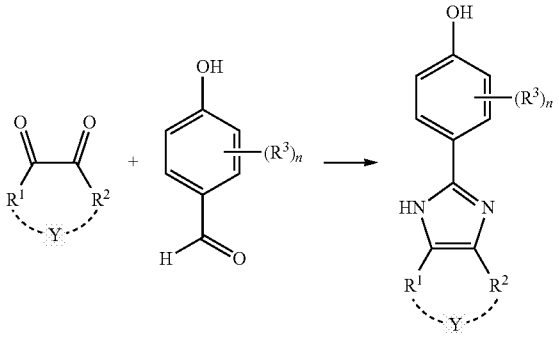

-continued

Second process

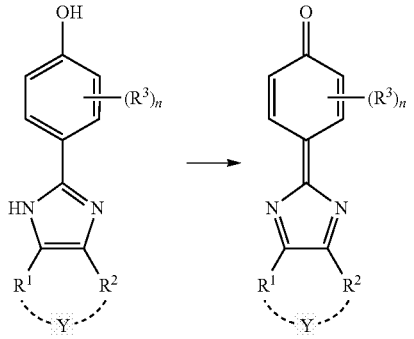

A dicyano compound and a diester compound can be synthesized in the following manner.

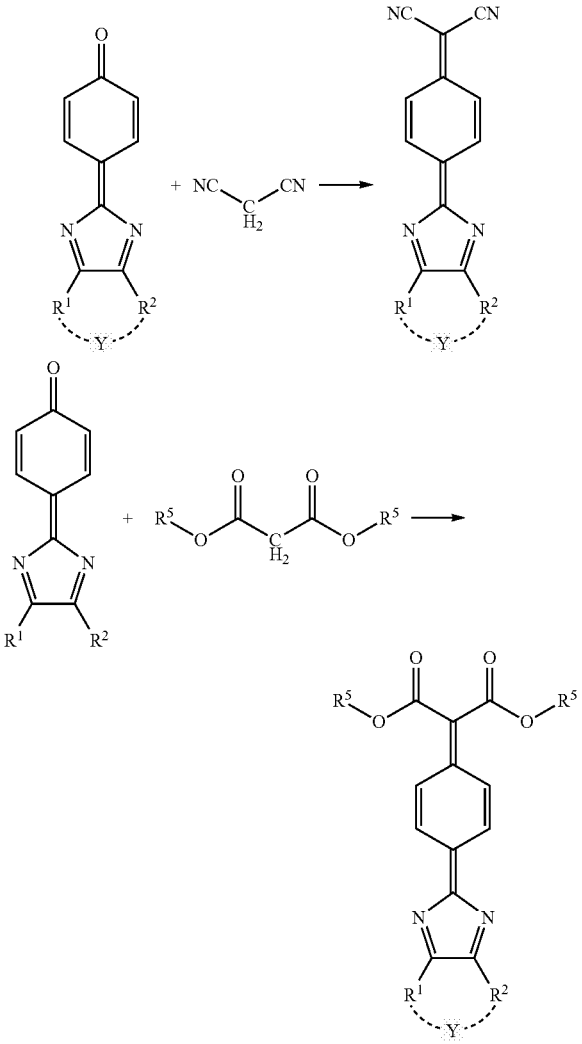

As specific examples of the alkyl group in the description of the above general formula (1), the following can be listed: a methyl group, an ethyl group, a propyl group, a butyl group, a hexyl group, an undecanyl group, and the like. For the aromatic hydrocarbon group, the following can be listed:

groups of aromatic ring, such as benzene, biphenyl, naphthalene, anthracene, fluorene, and pyrene; groups of heteroaromatic ring, such as pyridine, quinoline, thiophene, furan, oxazole, oxadiazole, and carbazole; and the like.

For substituents of the above, the following can be listed: those listed in the above specific example of the alkyl group, a methoxy group, an ethoxy group, a propoxy group, a butoxy group and other alkoxy groups, or a fluorine atom, a chlorine atom, a bromine atom, an iodine atom and other halogen atoms, a dialkylamino group, a diphenylamino group, the aromatic hydrocarbon group, and pyrrolidine, piperidine, piperazine and other groups of heterocyclic ring, and the like.

Furthermore, when the above "$R^1$" and "$R^2$" are joined together to form a heterocyclic group containing a nitrogen atom, the following can be listed as the heterocyclic group: a fused heterocyclic group, which is generated by fusing the aromatic hydrocarbon group into a pyrrolidino group, a piperidino group, a piperazino group and the like; and the like.

Preferred examples of the general formula (1) will be listed below. However, the present invention is not limited to the compounds shown below.

TABLE 1

1

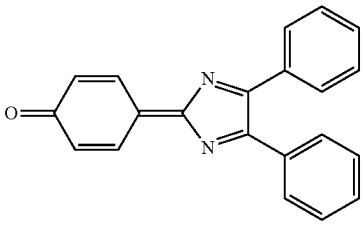

2

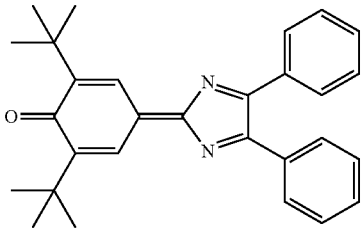

3

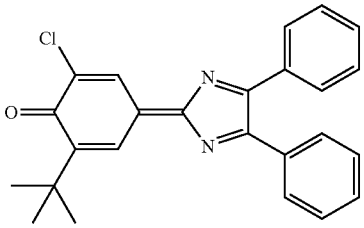

4

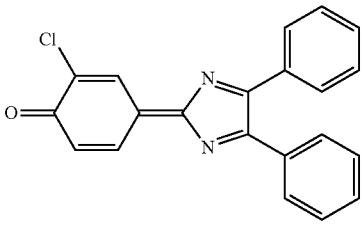

TABLE 1-continued

5

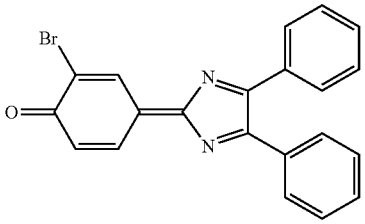

6

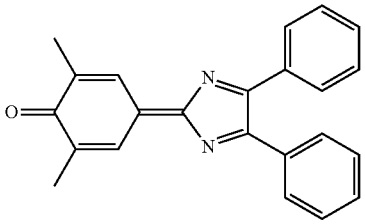

7

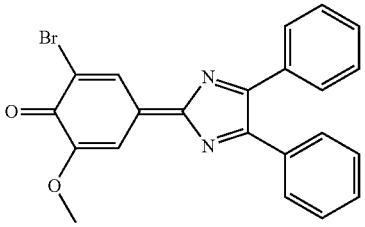

8

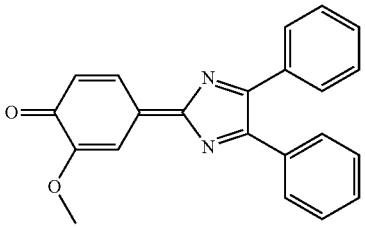

9

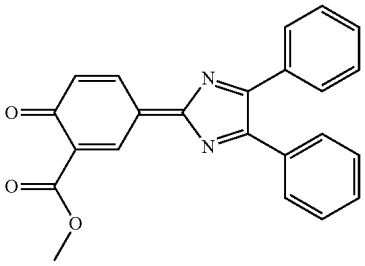

10

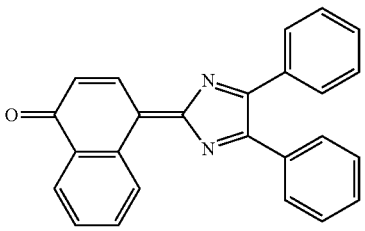

TABLE 1-continued
11
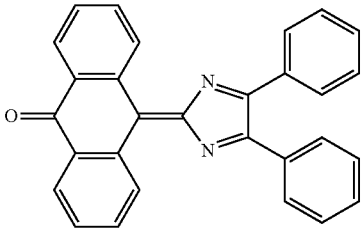
12
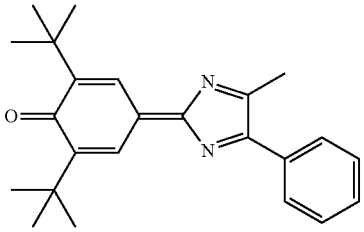
13
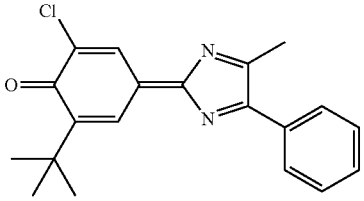
14
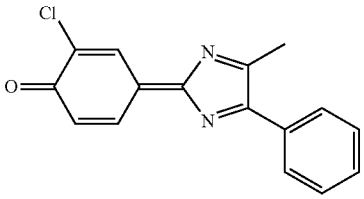
15
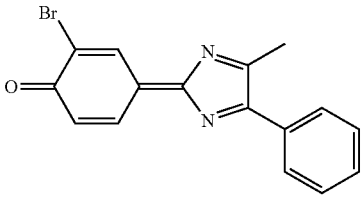
16
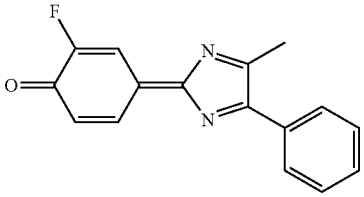
17
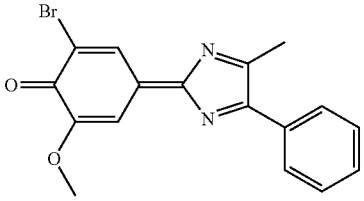
TABLE 1-continued
18
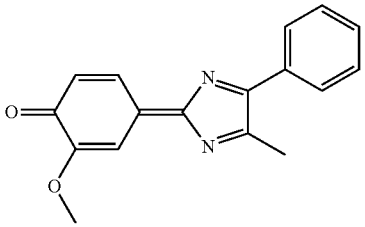
19
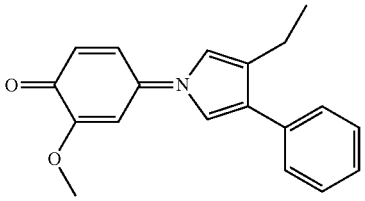
20
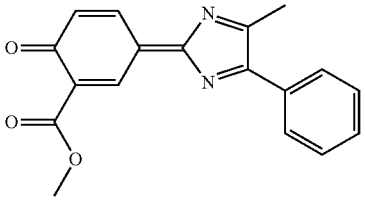
21
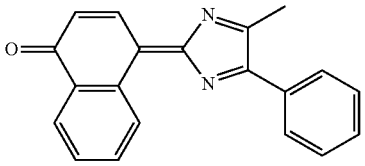
22
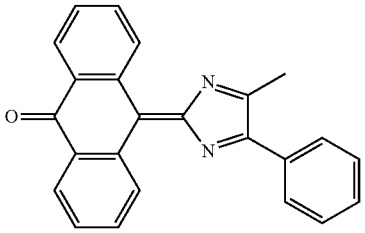
23
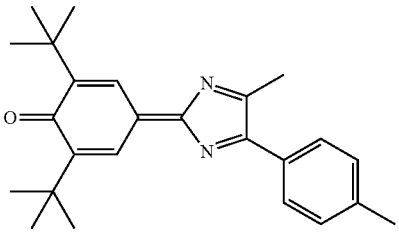
24
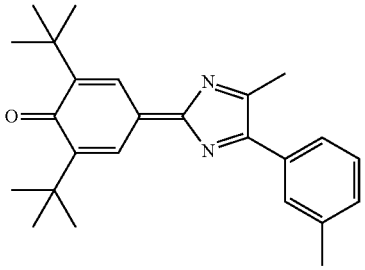

TABLE 1-continued
25
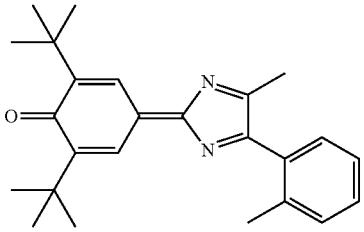
26
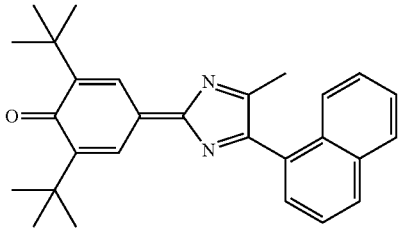
27
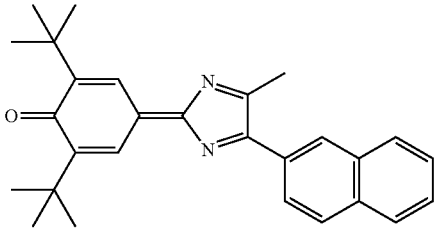
28
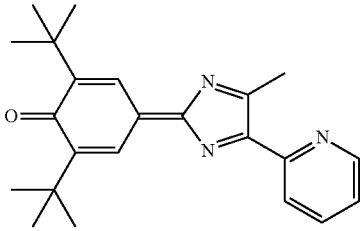
29
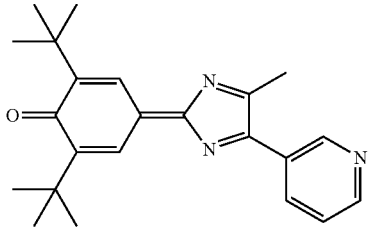
30
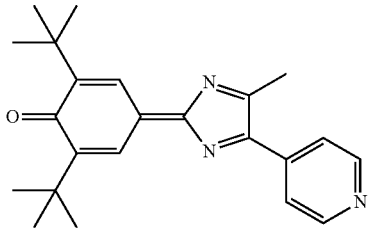
TABLE 1-continued
31
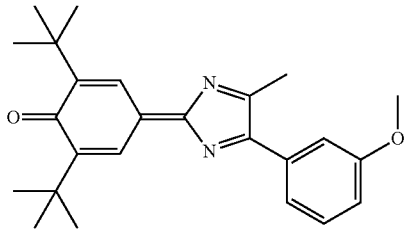
32
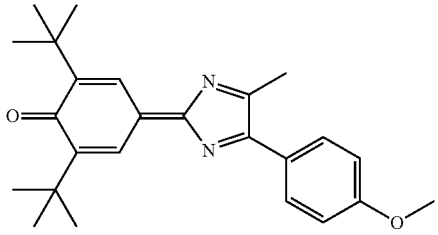
33
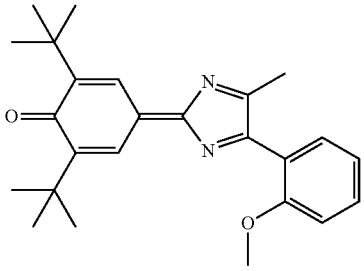
34
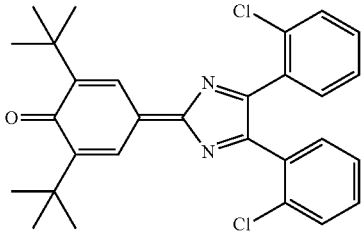
35
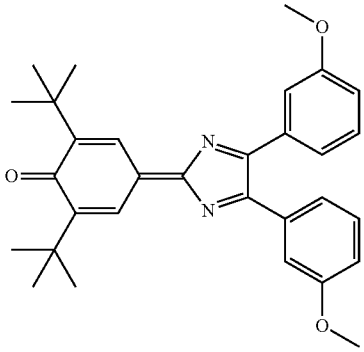
36
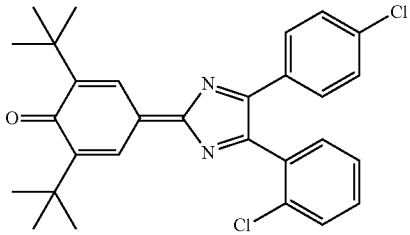

TABLE 1-continued
37
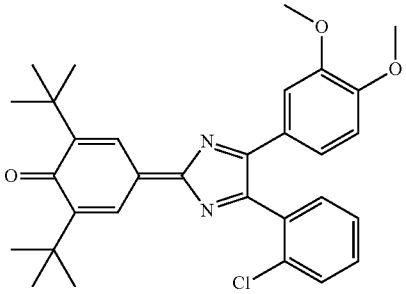
38
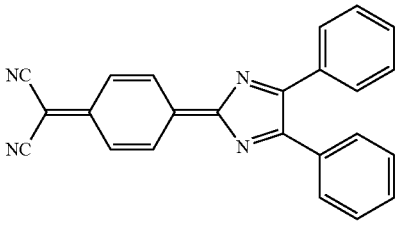
39
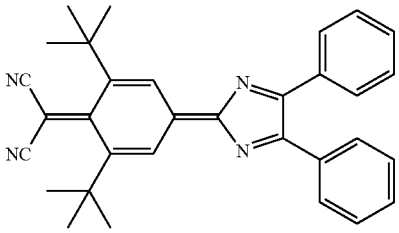
40
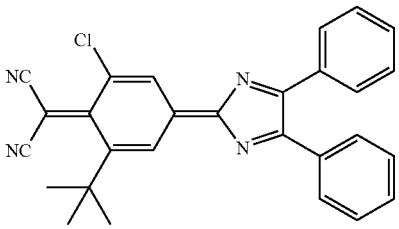
41
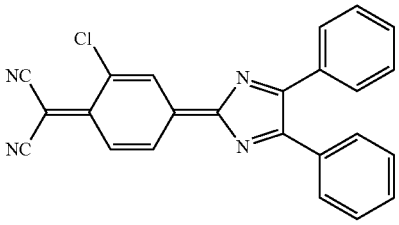
42
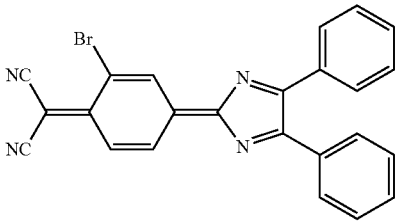
TABLE 1-continued
43
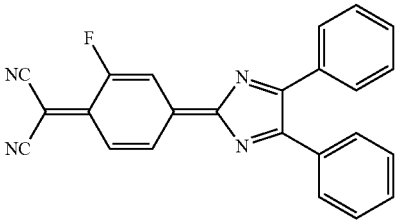
44
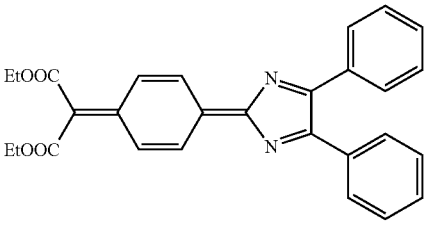
45
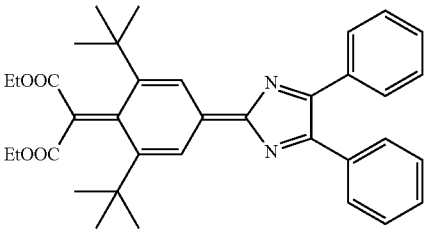
46
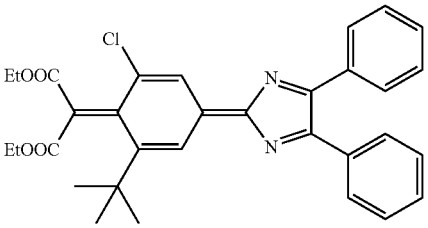
47
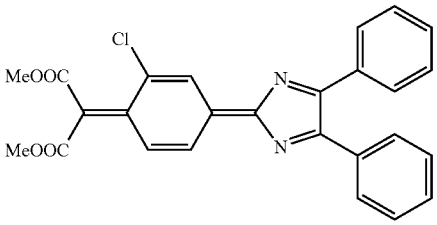
48
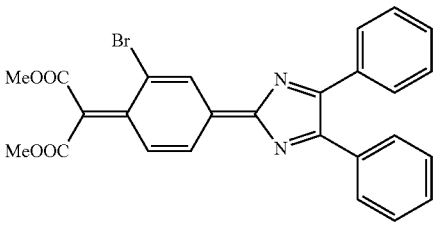
49
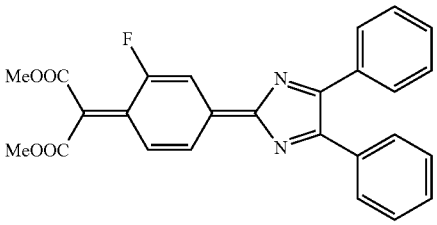

TABLE 1-continued

50

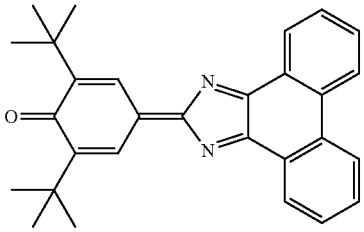

51

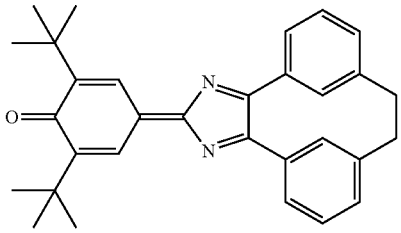

52

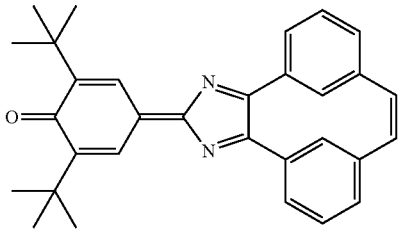

53

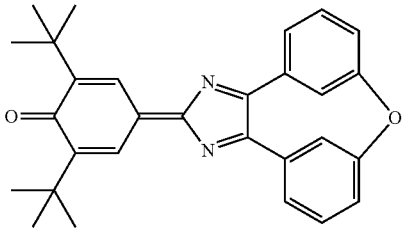

54

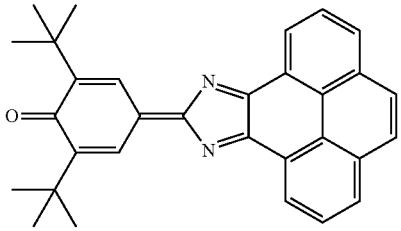

55

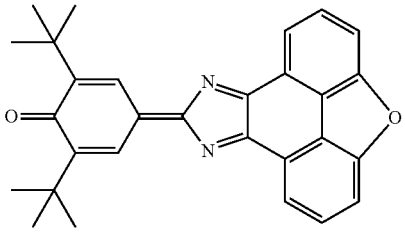

TABLE 1-continued

56

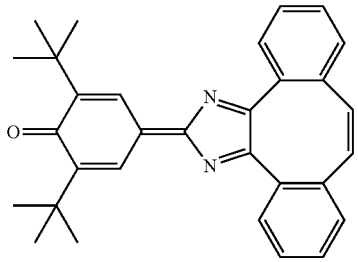

57

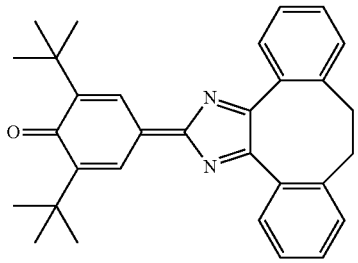

58

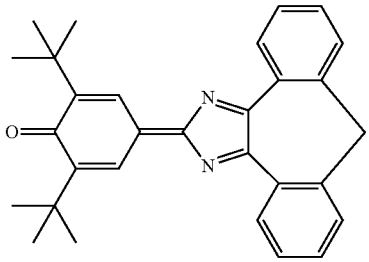

59

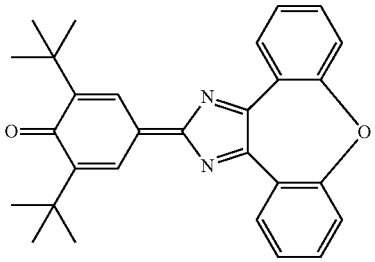

60

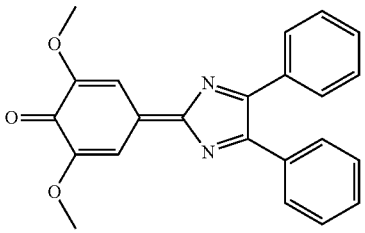

The following provides a description of the layer structure of an electrophotographic photoconductor.

FIG. 1 is a cross-sectional view of an electrophotographic photoconductor according to the present invention. On an electrically conductive substrate (31), a photoconductive layer (33), which is mainly made of a charge generation material and a charge transport material, is provided.

Figure 2:
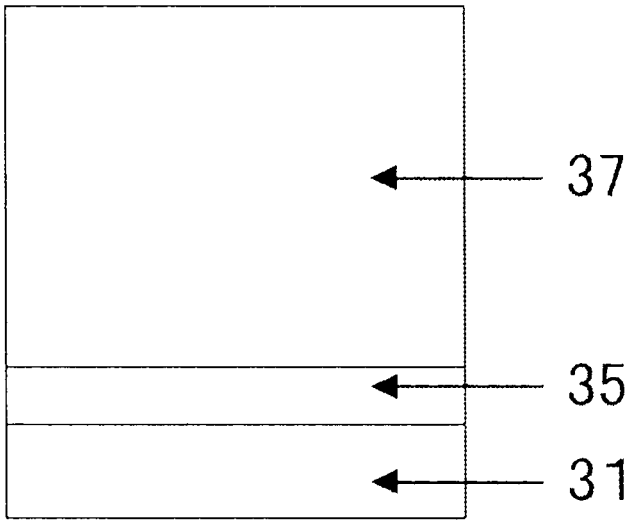
FIG. 2 is a cross-sectional view of an electrophotographic photoconductor according to the present invention.

In the case of FIG. 2, the structure is as follows: on an electrically conductive substrate (31), a charge generation layer (35), which is mainly made of a charge generation material, and a charge transport layer (37), which is mainly made of a charge transport material, are stacked.

Figure 3:
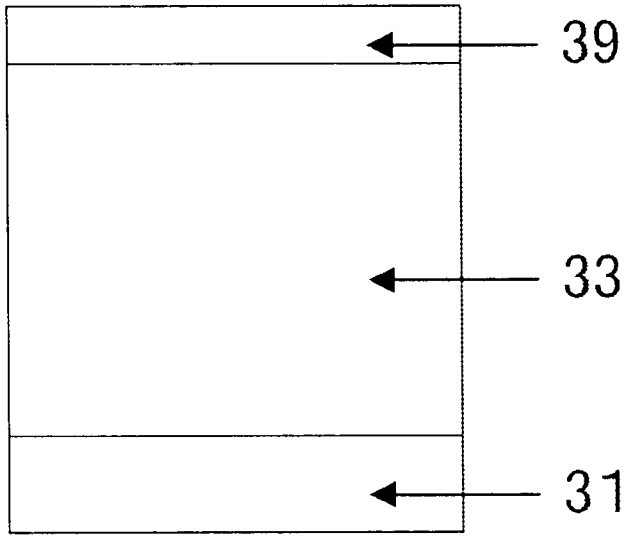
FIG. 3 is a cross-sectional view of an electrophotographic photoconductor according to the present invention.

In the case of FIG. 3, on an electrically conductive substrate (31), a photoconductive layer (33), which is mainly made of a charge generation material and a charge transport material, is provided. Furthermore, on a surface of the photoconductive layer, a protective layer (39) is provided. In this case, the protective layer (39) may contain the diazapentadiene derivative.

Figure 4:
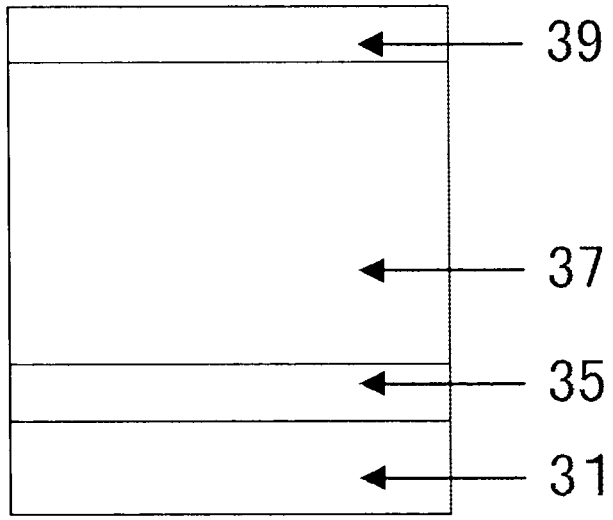
FIG. 4 is a cross-sectional view of an electrophotographic photoconductor according to the present invention.

In the case of FIG. 4, the structure is as follows: on an electrically conductive substrate (31), a charge generation layer (35), which is mainly made of a charge generation material, and a charge transport layer (37), which is mainly made of a charge transport material, are stacked. Furthermore, on the charge transport layer, a protective layer (39) is provided. In this case, the protective layer (39) may contain the diazapentadiene derivative.

Figure 5:
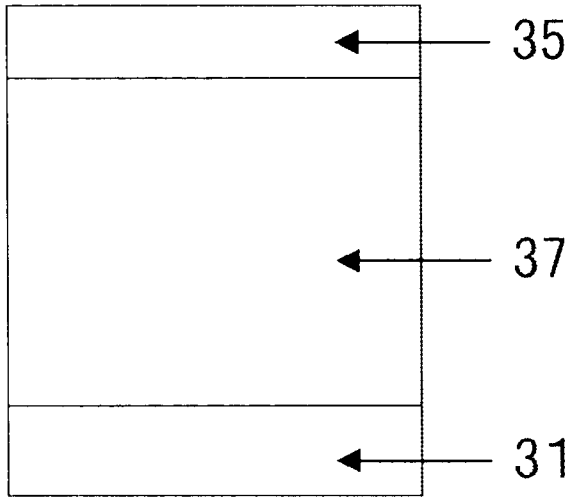
FIG. 5 is a cross-sectional view of an electrophotographic photoconductor according to the present invention.

In the case of FIG. 5, the structure is as follows: on an electrically conductive substrate (31), a charge transport layer (37), which is mainly made of a charge transport material, and a charge generation layer (35), which is mainly made of a charge generation material, are stacked.

Figure 6:
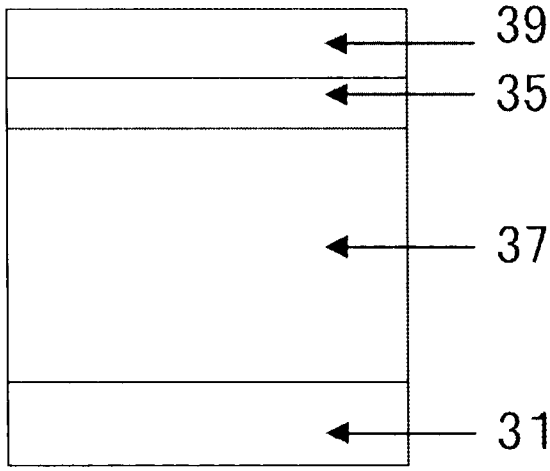
FIG. 6 is a cross-sectional view of an electrophotographic photoconductor according to the present invention.

In the case of FIG. 6, the structure is as follows: on an electrically conductive substrate (31), a charge transport layer (37), which is mainly made of a charge transport material, and a charge generation layer (35), which is mainly made of a charge generation material, are stacked. Furthermore, on the charge generation layer, a protective layer (39) is provided. In this case, the protective layer (39) may contain the diazapentadiene derivative.

<Conductive Support>

For the electrically conductive substrate (31), what is preferred is one that shows conductivity with a volume resistivity of $10^{10}\Omega\cdot$cm or less. For such an electrically conductive substrate, for example, the following can be used: a film-like or cylindrical piece of plastics or paper that is covered with aluminum, nickel, chromium, nichrome, copper, gold, silver, platinum or any other metal, or stannic oxide, indium oxide or any other metallic oxide, by means of vapor deposition or sputtering; a tube that is made by turning a plate of aluminum, aluminum alloy, nickel, stainless steel or the like and the above into an element tube by means of extrusion, drawing or any other method and then performing surface treatment, such as cutting, super finishing or polishing; or the like. Moreover, the following can also be used as the electrically conductive substrate (31): an endless nickel belt and an endless stainless steel belt, which are disclosed in JP-A No. 52-36016.

Moreover, the support on which a binder resin, into which proper conductive powder is dispersed, is applied can also be used as the electrically conductive substrate (31) of the photoconductor of the present invention.

The conductive powder is not specifically restricted, and can be selected appropriately according to the purpose. For example, the following can be listed: carbon black; acetylene black; aluminum, nickel, iron, nichrome, copper, zinc, silver or any other kind of metal powder; conductive tin oxide, ITO, or any other kind of metal oxide powder; or the like.

The binder resin that is used simultaneously is not specifically restricted, and can be selected appropriately according to the purpose. For example, the following can be listed: polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin, alkyd resin, and any other thermoplastic, thermosetting resin or photocuring resin; and the like.

Such a conductive layer can be provided by dispersing the conductive powder and the binder resin into a suitable solvent, such as tetrahydrofuran, dichloromethane, methyl ethyl ketone or toluene, and by applying.

Furthermore, the following can also be used successfully as the electrically conductive substrate (31) of the photoconductor of the present invention: one in which, on a suitable cylindrical substrate, a conductive layer is provided by a heat shrinkable tube that contains the conductive powder in a material such as polyvinyl chloride, polypropylene, polyester, polystyrene, polyvinylidene chloride, polyethylene, chlorinated rubber, Teflon (Registered Trademark) or the like.

<Photoconductive Layer>

The following describes a photoconductive layer. The photoconductive layer may be made up of a single layer, or a plurality of layers stacked. First, one example of the stacked layers, which include a charge generation layer (35) and a charge transport layer (37), will be described.

<<Charge Generation Layer>>

The charge generation layer (35) is a layer made mainly of a charge generation material.

For the charge generation layer (35), a well-known charge generation material can be used. The following can be listed as typical charge generation materials: CI Pigment Blue 25 (Color Index CI-21180), CI Pigment Red 41 (CI 21200), CI Acid Red 52 (CI 45100), CI Basic Red 3 (CI 45210), an azo pigment having a carbazole skeleton (disclosed in JP-A No. 53-95033), an azo pigment having a distyrylbenzene skeleton (JP-A No. 53-133445), an azo pigment having a triphenylamine skeleton (disclosed in JP-A No. 53-132347), an azo pigment having a dibenzothiophene skeleton (disclosed in JP-A No. 54-21728), an azo pigment having an oxadiazole skeleton (disclosed in JP-A No. 54-12742), an azo pigment having a fluorenone skeleton (disclosed in JP-A No. 54-22834), an azo pigment having a bisstilbene skeleton (disclosed in JP-A No. 54-17733), an azo pigment having a distyryl oxadiazole skeleton (disclosed in JP-A No. 54-2129), an azo pigment having a distyryl carbazole skeleton (disclosed in JP-A No. 54-14967), an azo pigment having a benzanthrone skeleton, and other azo pigments; for example, CI Pigment Blue 16 (CI 74100), Y-type oxo-titanium phthalocyanine (JP-A No. 64-17066), A(β)-type oxo-titanium phthalocyanine, B(α)-type oxo-titanium phthalocyanine, 1-type oxo-titanium phthalocyanine (disclosed in JP-A No. 11-21466), II-type chloro gallium phthalocyanine (Iijima et al., 67th Annual Spring Meeting of the Chemical Society of Japan, 1B4,04 (1994)), V-type hydroxy gallium phthalocyanine (Daimon et al., 67th Annual Spring Meeting of the Chemical Society of Japan, 1B4,05 (1994)), X-type metal-free phthalocyanine (U.S. Pat. No. 3,816,118) and other phthalocyanine pigments, CI Vat Brown 5 (CI 73410), CI Vat Dye (CI 73030) and other indigo pigments, Algo Scarlet B (manufactured by Bayer Co.), Indanthrene Scarlet R (manufactured by Bayer Co.) and other perylene pigments; and the like. Incidentally, one of the above materials may be used independently; or alternatively, two or more may be used together.

The charge generation layer (35) is formed by dispersing the charge generation material, along with a binder resin if necessary, into a suitable solvent by means of a ball mill, an attritor, a sand mill, ultrasonic waves or the like to prepare an application liquid; applying the application liquid on the surface of the electrically conductive substrate; and drying.

The binder resin, which is used for the charge generation layer (35) when necessary, is not specifically restricted, and can be selected appropriately according to the purpose. For example, the following can be listed: polyamide, polyurethane, epoxy resin, polyketone, polycarbonate, silicone resin, acrylic resin, polyvinyl butyral, polyvinyl formal, polyvinylketone, polystyrene, polysulfone, poly-N-vinylcarbazole, polyacrylamide, polyvinyl benzal, polyester, phenoxy resin, vinyl chloride-vinyl acetate copolymer, polyvinyl acetate, polyphenylene oxide, polyamide, polyvinyl pyridine, cellulosic resin, casein, polyvinyl alcohol, polyvinyl pyrrolidone, and the like.

The amount of the binder resin is not specifically restricted, and can be selected appropriately according to the purpose. The amount of the binder resin is preferably 0 parts by mass to 500 parts by mass, relative to 100 parts by mass of the charge generation material, or more preferably 10 parts by mass to 300 parts by mass. The binder resin may be added before or after the dispersion.

The solvent used here is not specifically restricted, and can be selected appropriately according to the purpose. For example, the following can be listed: isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like. One of the above may be used independently; or alternatively, two or more may be used together. It is especially preferred to use, among the above, a ketone solvent, an ester solvent and an ether solvent.

The charge generation layer (35) is mainly made of a charge generation material, a solvent and a binder resin. However, the charge generation layer (35) may contain a sensitizer, dispersing agent, surfactant, silicone oil, or any other additive agent.

As for a method of applying the application liquid, for example, the following can be listed: dip coating, spray coating, bead coating, nozzle coating, spinner coating, ring coating, and the like.

The film thickness of the charge generation layer (35) is not specifically restricted, and can be selected appropriately according to the purpose. The appropriate film thickness of the charge generation layer is about 0.01 μm to about 5 μm. The film thickness is preferably 0.1 μm to 2 μm.

<<Charge Transport Layer>>

The charge transport layer (37) is a layer made mainly of a charge transport material. The charge transport material includes a hole transport material, an electron transport material, a high-molecular charge transport material, and the like.

—Hole Transport Material—

For the hole transport material, for example, the following can be listed: poly-N-carbazole and derivatives thereof, poly-γ-carbazolylethyl glutamate and derivatives thereof, pyrene-formaldehyde condensate and derivatives thereof, polyvinyl pyrene, polyvinyl phenanthrene, oxazole derivatives, imidazole derivatives, triphenylamine derivatives, compounds represented by the following general formulae (2), (6), (7), (10) to (21), (23) to (26), and (28) to (31), and the like.

General Formula (11)

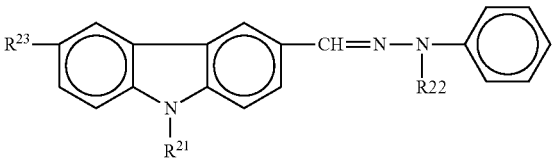

In the above general formula (11), "$R^{21}$" represents a methyl group, an ethyl group, a 2-hydroxyethyl group, or a 2-chloroethyl group; "$R^{22}$" represents a methyl group, an ethyl group, a benzyl group, or a phenyl group; "$R^{23}$" represents a hydrogen atom, a chlorine atom, a bromine atom, an alkyl group containing 1 to 4 carbon atoms, an alkoxy group containing 1 to 4 carbon atoms, a dialkylamino group, or a nitro group.

For the compound represented by the general formula (11), for example, the following can be listed: 9-ethylcarbazole-3-carboxaldehyde 1-methyl-1-phenylhydrazone, 9-ethylcarbazole-3-carboxaldehyde 1-benzil-1-phenylhydrazone, 9-ethylcarbazole-3-carboxaldehyde 1,1-diphenyl hydrazone, and the like.

General Formula (12)

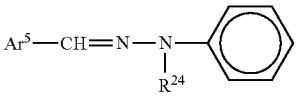

In the above general formula (12), "$Ar^5$" represents a naphthalene ring, an anthracene ring, a pyrene ring and substitution products of the rings, or a pyridine ring, a furan ring, and a thiophene ring; "$R^{24}$" represents an alkyl group, a phenyl group, or a benzyl group.

For the compound represented by the above general formula (12), for example, the following can be listed: 4-diethylaminostyryl-p-carboxaldehyde-1-methyl-1-phenylhydrazone, 4-methoxynaphthalene-1-carboxaldehyde-1-benzyl-1-phenylhydrazone, and the like.

General Formula (13)

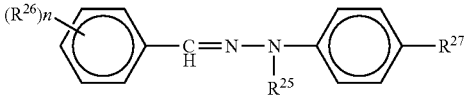

In the general formula (13), "$R^{25}$" represents an alkyl group, a benzyl group, a phenyl group, or a naphthyl group; "$R^{26}$" represents a hydrogen atom, an alkyl group containing 1 carbon atom to 3 carbon atoms, an alkoxy group containing 1 carbon atom to 3 carbon atoms, a dialkylamino group, a diaralkyl amino group, or a diarylamino group; "n" represents an integer ranging from 1 to 4. If the "n" is 2 or greater, "$R^{26}$" may be the same or different. "$R^{27}$" represents a hydrogen atom or a methoxy group.

For the compound represented by the above general formula (13), for example, the following can be listed: 4-methoxybenzaldehyde 1-methyl-1-phenylhydrazone, 2,4-dimethoxybenzaldehyde 1-benzyl-1-phenylhydrazone, 4-diethylaminobenzaldehyde 1,1-diphenylhydrazone, 4-methoxybenzaldehyde 1-(4-methoxy)phenylhydrazone, 4-diphenylaminobenzaldehyde 1-benzyl-1-phenylhydrazone, 4-dibenzylaminobenzaldehyde 1,1-diphenylhydrazone, and the like.

General Formula (14)

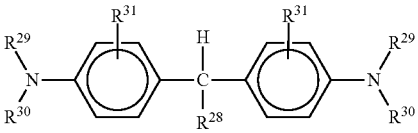

In the above general formula (14), "$R^{28}$" represents an alkyl group containing 1 to 11 carbon atoms, a substituted or unsubstituted phenyl group, or a heterocyclic group; "$R^{29}$" and "$R^{30}$," which may be the same or different, represent a hydrogen atom, an alkyl group containing 1 to 4 carbon atoms, a hydroxyalkyl group, a chloroalkyl group, or a substituted or unsubstituted aralkyl group. The "$R^{29}$" and "$R^{30}$" may be joined together to form a heterocyclic ring containing nitrogen. "$R^{31}$," which may be the same or different, represents a hydrogen atom, an alkyl group containing 1 to 4 carbon atoms, an alkoxy group, or a halogen atom.

For the compound represented by the above general formula (14), for example, the following can be listed: 1,1-bis (4-dibenzylamino phenyl) propane, tris(4-diethylaminophenyl)methane, 1,1-bis(4-dibenzylamino phenyl)propane, 2,2'-dimethyl-4,4'-bis(diethylamino)-triphenylmethane, and the like.

General Formula (15)

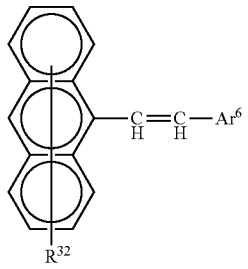

In the above general formula (15), "$R^{32}$" represents a hydrogen atom or a halogen atom; "$Ar^{6}$" represents a substituted or unsubstituted phenyl group, a naphthyl group, an anthryl group, or a carbazolyl group.

For the compound represented by the above general formula (15), for example, the following can be listed: 9-(4-diethylaminostyryl)anthracene, 9-bromo-10-(4-diethylaminostyryl)anthracene, and the like.

General Formula (16)

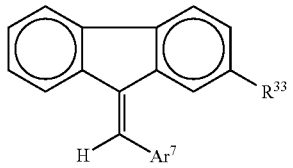

In the above general formula (16), "$R^{33}$" represents a hydrogen atom, a halogen atom, a cyano group, an alkoxy group containing 1 to 4 carbon atoms, or an alkyl group containing 1 to 4 carbon atoms; "$Ar^{7}$" represents the above general formula (17) or (18).

General Formula (17)

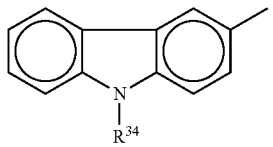

General Formula (18)

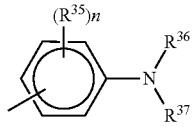

In the above general formula (17), "$R^{34}$" represents an alkyl group containing 1 to 4 carbon atoms. In the above general formula (18), "$R^{35}$" represents a hydrogen atom, a halogen atom, an alkyl group containing 1 to 4 carbon atoms, an alkoxy group containing 1 to 4 carbon atoms, or a dialkylamino group; "n" is 1 or 2. When "n" is 2, "$R^{35}$" may be the same or different. "$R^{36}$" and "$R^{37}$" each represent a hydrogen atom, a substituted or unsubstituted alkyl group containing 1 to 4 carbon atoms, or a substituted or unsubstituted benzyl group, independently.

For the compound represented by the above general formula (16), for example, the following can be listed: 9-(4-dimethylaminobenzylidene) fluorene, 3-(9-fluorenylidene)-9-ethylcarbazole, and the like.

General Formula (19)

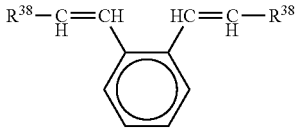

In the above general formula (19), each "$R^{38}$" independently represents a carbazolyl group, a pyridyl group, a thienyl group, an indolyl group, a furyl group, or a substituted or unsubstituted phenyl group, styryl group, naphthyl group, or anthryl group. The substituents of the above represent groups selected from among a set of the following groups: a dialkylamino group, an alkyl group, an alkoxy group, a carboxy group or esters thereof, a halogen atom, a cyano group, an aralkyl amino group, an N-alkyl-N-aralkyl amino group, an amino group, a nitro group and an acetylamino group.

For the compound represented by the above general formula (19), for example, the following can be listed: 1,2-bis(4-diethylaminostyryl)benzene, 1,2-bis(2,4-dimethoxystyryl)benzene, and the like.

General Formula (20)

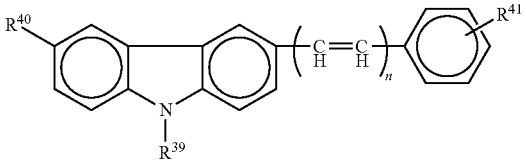

In the above general formula (20), "$R^{39}$" represents a lower alkyl group, a substituted or unsubstituted phenyl group, or a benzyl group. "$R^{40}$" and "$R^{41}$" each independently represent a hydrogen atom, a lower alkyl group, a lower alkoxy group, a halogen atom, a nitro group, an amino group, or an amino group substituted with a lower alkyl group or benzyl group. "n" represents an integer of 1 or 2.

For the compound represented by the above general formula (20), for example, the following can be listed: 3-styryl-9-ethylcarbazole, 3-(4-methoxystyryl)-9-ethylcarbazole, and the like.

General Formula (21)

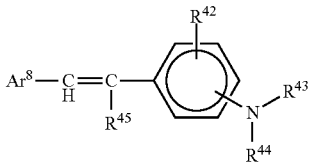

In the above general formula (21), "$R^{42}$" represents a hydrogen atom, an alkyl group, an alkoxy group, or a halogen atom. "$R^{43}$" and "$R^{44}$" each independently represent a substituted or unsubstituted aryl group. "$R^{45}$" represents a hydrogen atom, a lower alkyl group, or a substituted or unsubstituted phenyl group. "$Ar^{8}$" represents a substituted or unsubstituted phenyl group or a naphthyl group.

For the compound represented by the above general formula (21), for example, the following can be listed: 4-diphenylaminostilbene, 4-dibenzylaminostilbene, 4-ditolylaminostilbene, 1-(4-diphenylaminostyryl)naphthalene, 1-(4-diphenylaminostyryl)naphthalene, and the like.

General Formula (2)

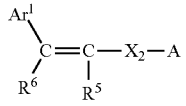

In the above general formula (2), "$X_2$" represents a single bond or a vinylene group. "$R^5$" represents a hydrogen atom, a substituted or unsubstituted alkyl group, or a substituted or unsubstituted aromatic hydrocarbon group. "$Ar^1$" represents a substituted or unsubstituted aromatic hydrocarbon group. "$R^6$" represents a hydrogen atom, a substituted or unsubstituted alkyl group, or a substituted or unsubstituted aromatic hydrocarbon group. "$Ar^1$" and "$R^6$" may together form a ring. "A" represents the above general formula (3), the above general formula (4), 9-anthryl group, or a substituted or unsubstituted carbazolyl group.

General Formula (3)

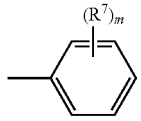

General Formula (4)

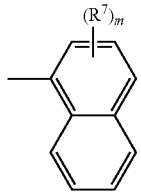

In the above general formulae (3) and (4), "$R^7$" represents a hydrogen atom, an alkyl group, an alkoxy group, a halogen atom, or the following general formula (5).

General Formula (5)

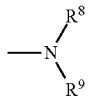

In the above general formula (5), "$R^8$" and "$R^9$" represent a substituted or unsubstituted alkyl group, or a substituted or unsubstituted aromatic hydrocarbon group. The above "$R^8$ and "$R^9$" may be the same or different. The above "$R^8$" and "$R^9$" may form a ring.

In the above general formulae (3) and (4), "m" represents an integer ranging from 1 to 3. When the above "m" is 2 or greater, the above "$R^8$" may be the same or different.

For the compound represented by the above general formula (22), for example, the following can be listed: 4'-diphenylamino-α-phenyl stilbene, 4'-bis(4-methylphenyl)amino-α-phenyl stilbene, and the like.

General Formula (23)

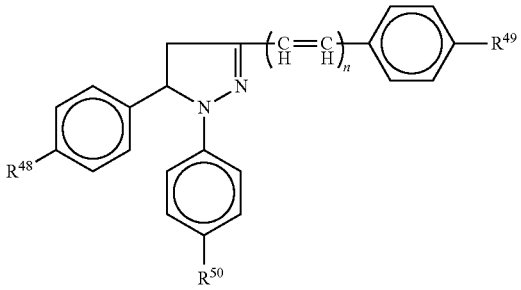

In the above general formula (23), "$R^{48}$," "$R^{49}$" and "$R^{50}$" each independently represent a hydrogen atom, a lower alkyl group, a lower alkoxy group, a halogen atom, or a dialkylamino group; "n" represents 0 or 1.

For the compound represented by the above general formula (23), for example, the following can be listed: 1-phenyl-3-(4-diethylaminostyryl)-5-(4-diethylaminophenyl)pyrazoline, and the like.

General Formula (24)

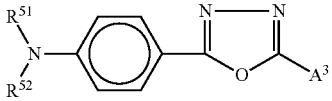

In the above general formula (24), "$R^{51}$" and "$R^{52}$" each independently represent an alkyl group containing a substituted alkyl group, or a substituted or unsubstituted aryl group. "$A^3$" represents a substituted amino group, a substituted or unsubstituted aryl group, or an allyl group.

For the compound represented by the above general formula (24), for example, the following can be listed: 2,5-bis(4-diethylaminophenyl)-1,3,4-oxadiazole, 2-N,N-diphenylamino-5-(4-diethylaminophenyl)-1,3,4-oxadiazole, 2-(4-dimethylaminophenyl)-5-(4-diethylaminophenyl)-1,3,4-oxadiazole, and the like.

General Formula (25)

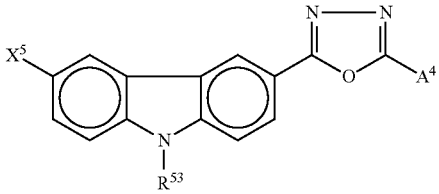

In the above general formula (25), "$X^5$" represents a hydrogen atom, a lower alkyl group, or a halogen atom. "$R^{53}$" represents an alkyl group containing a substituted alkyl group, or a substituted or unsubstituted aryl group. "$A^4$" represents a substituted amino group, or a substituted or unsubstituted aryl group.

For the compound represented by the above general formula (25), for example, the following can be listed: 2-N,N-diphenylamino-5-(N-ethylcarbazol-3-yl)-1,3,4-oxadiazole, 2-(4-diethylaminophenyl)-5-(N-ethylcarbazol-3-yl)-1,3,4-oxadiazole, and the like.

General Formula (26)

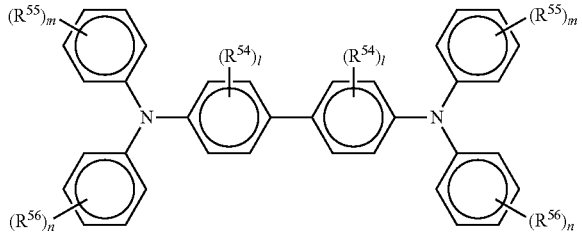

In the above general formula (26), "$R^{54}$" represents a lower alkyl group, a lower alkoxy group, or a halogen atom. "$R^{55}$" and "$R^{56}$," which each may be the same or different, represent a hydrogen atom, a lower alkyl group, a lower alkoxy group, or a halogen atom. "1," "m," and "n" each represent an integer ranging from 0 to 4.

For the benzidine compound represented by the above general formula (26), for example, the following can be listed: N,N'-diphenyl-N,N'-bis(3-methylphenyl)-[1,1'-biphenyl]-4,4'-diamine, 3,3'-dimethyl-N,N,N',N'-tetrakis (4-methylphenyl)-[1,1'-biphenyl]-4,4'-diamine, and the like.

General Formula (6)

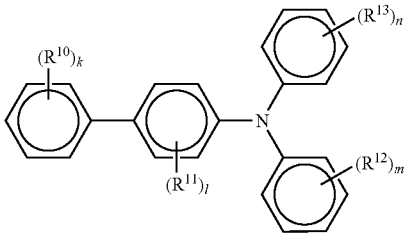

In the above general formula (6), "$R^{10}$," "$R^{12}$" and "$R^{13}$" represent a hydrogen atom, an amino group, an alkoxy group, a thioalkoxy group, an aryloxy group, a methylenedioxy group, a substituted or unsubstituted alkyl group, a halogen atom, or a substituted or unsubstituted aromatic hydrocarbon group. "$R^{11}$" represents a hydrogen atom, an alkoxy group, a substituted or unsubstituted alkyl group, or a halogen atom. "k," "l," "m," and "n" represent an integer ranging from 1 to 4. When the above "k," "l," "m," and "n" are an integer ranging from 2 to 4, the above "$R^{10}$," "$R^{11}$," "$R^{12}$" and "$R^{13}$" may be the same or different.

For the biphenylyl amine compound represented by the above general formula (6), for example, the following can be listed: 4'-methoxy-N,N-diphenyl-[1,1'-biphenyl]-4-amine, 4'-methyl-N,N-bis(4-methylphenyl)-[1,1'-biphenyl]-4-amine, 4'-methoxy-N,N-bis(4-methylphenyl)-[1,1'-biphenyl]-4-amine, N,N-bis(3,4-dimethylphenyl)-[1,1'-biphenyl]-4-amine, and the like.

General Formula (28)

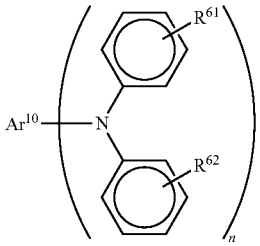

In the above general formula (28), "$Ar^{10}$" represents a condensed polycyclic hydrocarbon group that includes 18 or less carbon atoms and may have a substituent. "$R^{61}$" and "$R^{62}$" represent a hydrogen atom, a halogen atom, a substituted or unsubstituted alkyl group, an alkoxy group, and a substituted or unsubstituted phenyl group, and each may be the same or different. "n" represents an integer of 1 or 2.

For the triarylamine compound represented by the above general formula (28), for example, the following can be listed: N,N-diphenyl-pyrene-1-amine, N,N-di-p-tolyl-pyrene-1-amine, N,N-di-p-tolyl-1-naphthylamine, N,N-di(p-tolyl)-1-phenanthryl amine, 9,9-dimethyl-2-(di-p-tolylamino)fluorene, N,N,N',N'-tetrakis(4-methylphenyl)-phenanthrene-9,10-diamine, N,N,N',N'-tetrakis(3-methylphenyl)-m-phenylenediamine, and the like.

$A^5$-CH═CH—$Ar^{11}$—CH═CH-$A^5$ General Formula (29)

In the above general formula (29), "$Ar^{11}$" represents a substituted or unsubstituted aromatic hydrocarbon group. "$A^5$" represents the following general formula (30).

General Formula (30)

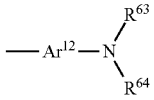

In the above general formula (30), "$Ar^{12}$" represents a substituted or unsubstituted aromatic hydrocarbon group. "$R^{63}$" and "$R^{64}$" each independently represent a substituted or unsubstituted alkyl group, or a substituted or unsubstituted aryl group.

For the diolefin aromatic compound represented by the above general formula (29), for example, the following can be listed: 1,4-bis(4-diphenylamino styryl)benzene, 1,4-bis[4-di(p-tolyl)aminostyryl]benzene, and the like.

General Formula (31)

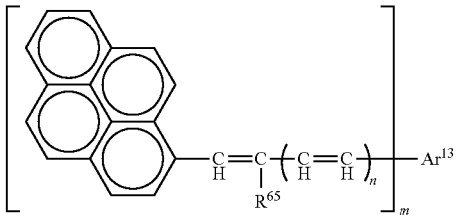

In the above general formula (31), "$Ar^{13}$" represents a substituted or unsubstituted aromatic hydrocarbon group. "$R^{65}$" represents a hydrogen atom, a substituted or unsubstituted alkyl group, or a substituted or unsubstituted aryl group. "n" represents 0 or 1. "m" represents 1 or 2. When the above "n"=0 and the above "m"=1, "$Ar^{13}$" and "$R^{65}$" may together form a ring.

For the styryl pyrene compound represented by the above general formula (31), for example, the following can be listed: 1-(4-diphenylaminostyryl)pyrene, 1-(N,N-di-p-tolyl-4-aminostyryl)pyrene, and the like.

General Formula (7)

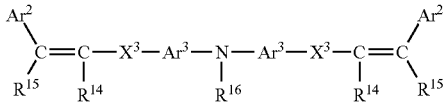

In the above general formula (7), "$X^3$" represents a single bond or a vinylene group. Each "$R^{14}$" independently represents a hydrogen atom, a substituted or unsubstituted alkyl group, or a substituted or unsubstituted aromatic hydrocarbon group. Each "$Ar^2$" independently represents a substituted or unsubstituted aromatic hydrocarbon group. Each "$R^{15}$" independently represents a hydrogen atom, a substituted or unsubstituted alkyl group, or a substituted or unsubstituted aromatic hydrocarbon group. The above "$Ar^2$" and "$R^{15}$" may together form a ring. "$Ar^3$" represents the following general formula (8) or (9).

General Formula (8)

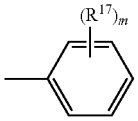

General Formula (9)

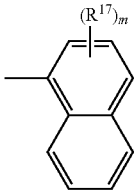

In the above general formulae (8) and (9), "$R^{17}$" represents a hydrogen atom, an alkyl group, an alkoxy group, or a halogen atom. "m" represents an integer ranging from 1 to 3. When the above "m" is 2 or greater, "$R^{17}$" may be the same or different. "$R^{16}$" represents a substituted or unsubstituted alkyl group, or a substituted or unsubstituted aromatic hydrocarbon group.

General Formula (10)

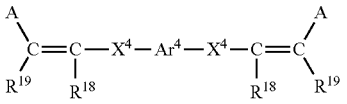

In the above general formula (10), "$X^4$" represents a single bond or a vinylene group. "$R^{18}$" represents a hydrogen atom, a substituted or unsubstituted alkyl group, or a substituted or unsubstituted aromatic hydrocarbon group. "$Ar^4$" represents a substituted or unsubstituted divalent aromatic hydrocarbon group. "$R^{19}$" represents a hydrogen atom, a substituted or unsubstituted alkyl group, or a substituted or unsubstituted aromatic hydrocarbon group. The above "A" represents the following general formula (3), the following general formula (4), 9-anthryl group, or a substituted or unsubstituted carbazolyl group.

General Formula (3)

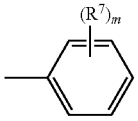

-continued

General Formula (4)

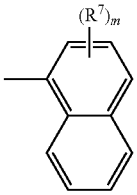

In the above general formulae (3) and (4), "$R^7$" represents a hydrogen atom, an alkyl group, an alkoxy group, a halogen atom, or the following general formula (5).

General Formula (5)

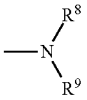

In the above general formula (5), "$R^8$" and "$R^9$" represent a substituted or unsubstituted alkyl group, or a substituted or unsubstituted aromatic hydrocarbon group. The above "$R^8$" and "$R^9$" may be the same or different. The above "$R^8$" and "$R^9$" may form a ring.

In the above general formulae (3) and (4), "m" represents an integer ranging from 1 to 3. When the above "m" is 2 or greater, the above "$R^8$" may be the same or different.

—Electron Transport Material—

For the electron transport material, for example, the following can be listed: chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro xanthone, 2,4,8-trinitro thioxanthone, 2,6,8-trinitro-indeno 4H-indeno[1,2-b]thiophene-4-one, 1,3,7-trinitro dibenzothiophene-5,5-dioxide, and the like. Furthermore, the following general formula (32), (33), (34) or (35), or any other electron transport material may be successfully used. One of the above may be used independently; or alternatively, two or more may be used together.

General Formula (32)

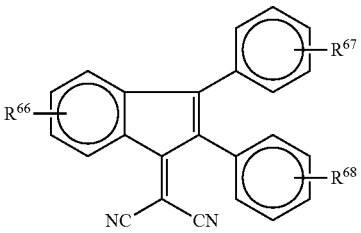

In the above general formula (32), "$R^{66}$," "$R^{67}$" and "$R^{68}$" each independently represent a hydrogen atom, a halogen atom, a substituted or unsubstituted alkyl group, an alkoxy group, or a substituted or unsubstituted phenyl group; and each may be the same or different.

General Formula (33)

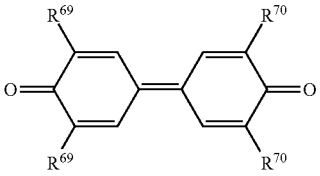

In the above general formula (33), "$R^{69}$" and "$R^{70}$" represent a hydrogen atom, a substituted or unsubstituted alkyl group, or a substituted or unsubstituted phenyl group; and each may be the same or different.

General Formula (34)

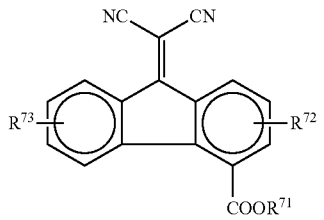

In the above general formula (34), "$R^{71}$," "$R^{72}$" and "$R^{73}$" each independently represent a hydrogen atom, a halogen atom, a substituted or unsubstituted alkyl group, an alkoxy group, or a substituted or unsubstituted phenyl group; and each may be the same or different.

General Formula (35)

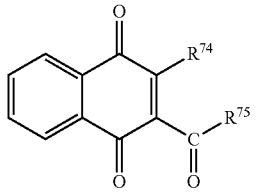

In the above general formula (35), "$R^{74}$" represents an alkyl group that may contain a substituent, or an aryl group that may contain a substituent. "$R^{75}$" represents an alkyl group that may contain a substituent, an aryl group that may contain a substituent, or a group represented by the following general formula (36).

$$—O—R^{76}$$ General Formula (36)

In the above general formula (36), "$R^{76}$" represents an alkyl group that may contain a substituent, or an aryl group that may contain a substituent.

When a charge transport material and the diazapentadiene derivative are mixed and contained in the charge transport layer, the total amount of the above is not specifically restricted, and can be selected appropriately according to the purpose. However, the total amount is preferably 20 parts by mass to 300 parts by mass relative to 100 parts by mass of the binder resin, or more preferably 40 parts by mass to 150 parts by mass. In terms of resolution and responsiveness, the film thickness of the charge transport layer is preferably 25 μm or less. The lower limit thereof may vary according to the system used (in particular, charge potential or the like); however, the lower limit thereof is preferably 5 μm or more.

The amount of the diazapentadiene derivative is not specifically restricted, and can be selected appropriately according to the purpose. However, the amount of the diazapentadiene derivative is preferably 0.01% by mass to 150% by mass relative to the charge transport material. If the diazapentadiene derivative is small in amount, the resistance to the oxidized gas may not be sufficient. If the diazapentadiene derivative is too much in amount, there may be a larger increase in residual potential at the time of repeated use.

—High-Molecular Charge Transport Material—

For the charge transport layer, a high-molecular charge transport material, which functions as a charge transport material and as a binder resin, is also used well. The charge transport layer made of such a high-molecular charge transport material is excellent in wear and abrasion resistance. For the high-molecular charge transport material, a well-known material can be used. In particular, the following is used well: polycarbonates whose main chain and/or side chain contains a triarylamine structure. Among the above, the high-molecular charge transport materials represented by the following general formulae (1) to (XIII) are used well. Examples of the above are shown below, showing specific examples.

General Formula (I)

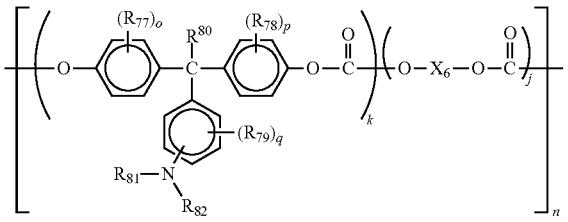

In the above general formula (1), "$R_{77}$," "$R_{78}$" and "$R_{79}$" each independently represent a substituted or unsubstituted alkyl group, or a halogen atom. "$R_{80}$" represents a hydrogen atom, or a substituted or unsubstituted alkyl group. "$R_{81}$" and "$R_{82}$" represent a substituted or unsubstituted aryl group. "o," "p" and "q" each independently represent an integer ranging from 0 to 4. "k" and "j" each represent a proportion by mole: $0.1 \le k \le 1$, $0 \le j \le 0.9$. "n" represents the number of repeating units, and is an integer ranging from 5 to 5,000. "$X_6$" is an aliphatic divalent group, a cyclic aliphatic divalent group, or a divalent group represented by the following general formula (II).

General Formula (II)

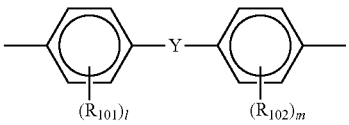

In the above general formula (II), "$R_{101}$" and "$R_{102}$" each independently represent a substituted or unsubstituted alkyl group, an aryl group, or a halogen atom. "l" and "m" represent an integer ranging from 0 to 4. "Y" represents a single bond, a straight-chain, branched or cyclic alkylene group containing 1 to 12 carbon atoms, —O—, —S—, —SO—, —$SO_2$—, —CO—, —CO—O—Z—O—CO— ("Z" in the formula represents an aliphatic divalent group), or the following general formula (III). In this case, the above "$R_{101}$" and "$R_{102}$" each may be the same or different.

General Formula (III)

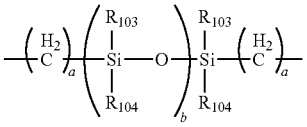

In the general formula (III), "a" represents an integer ranging from 1 to 20. "b" represents an integer ranging from 1 to 2,000. "$R_{103}$" and "$R_{104}$" represent a substituted or unsubstituted alkyl group, or an aryl group.

In this case, the above "$R_{103}$" and "$R_{104}$" each may be the same or different.

General Formula (IV)

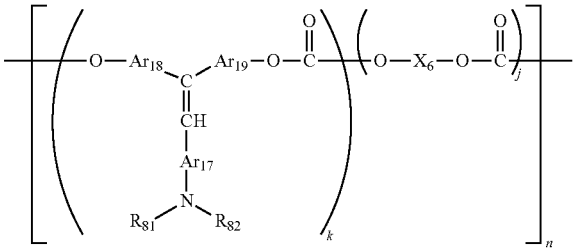

In the above general formula (IV), "$R_{81}$" and "$R_{82}$" represent a substituted or unsubstituted aryl group. "$Ar_{17}$," "$Ar_{18}$" and "$Ar_{19}$" represent the same, or a different, allylene group. "$X_6$," "k," "j" and "n" are the same as those in the above general formula (I).

General Formula (V)

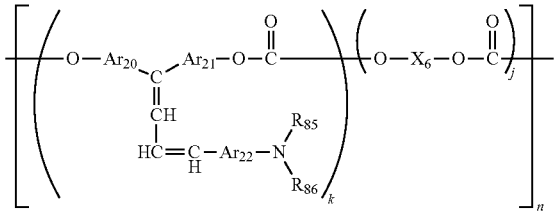

In the above general formula (V), "$R_{85}$" and "$R_{86}$" represent a substituted or unsubstituted aryl group. "$Ar_{20}$," "$Ar_{21}$" and "$Ar_{22}$" represent the same, or a different, allylene group. "$X_6$," "k," "j" and "n" are the same as those in the above general formula (I).

General Formula (VI)

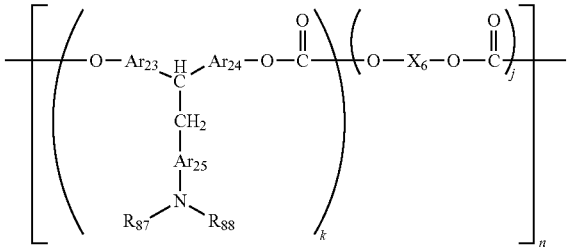

In the above general formula (VI), "$R_{87}$" and "$R_{88}$" each independently represent a substituted or unsubstituted aryl group. "$Ar_{23}$," "$Ar_{24}$" and "$Ar_{25}$" represent the same, or a different, allylene group. "p" represents an integer ranging from 1 to 5. "$X_6$," "k," "j" and "n" are the same as those in the above general formula (I).

In the above general formula (VII), "$R_{89}$" and "$R_{90}$" each independently represent a substituted or unsubstituted aryl group. "$Ar_{26}$," "$Ar_{27}$" and "$Ar_{28}$" represent the same, or a different, allylene group. "$X_7$" and "$X_8$" represent a substituted or unsubstituted ethylene group, or a substituted or unsubstituted vinylene group. "$X_6$," "k," "j" and "n" are the same as those in the above general formula (I).

General Formula (VIII)

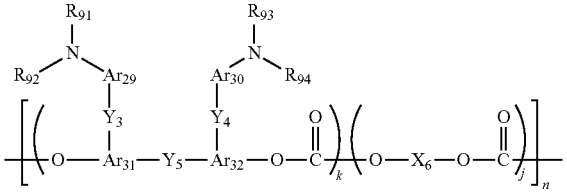

In the above general formula (VIII), "$R_{91}$," "$R_{92}$," "$R_{93}$" and "$R_{94}$" each independently represent a substituted or unsubstituted aryl group. "$Ar_{29}$," "$Ar_{30}$," "$Ar_{31}$." and "$Ar_{32}$" represent the same, or a different, allylene group. "$Y_3$," "$Y_4$" and "$Y_5$" represent a single bond, a substituted or unsubstituted alkylene group, a substituted or unsubstituted cycloalkylene group, a substituted or unsubstituted alkylene ether group, an oxygen atom, a sulfur atom, or a vinylene group; and may be the same or different. "$X_6$," "k," "j" and "n" are the same as those in the above general formula (I).

General Formula (IX)

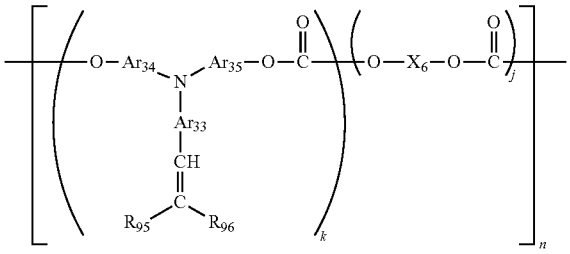

In the above general formula (IX), "$R_{95}$" and "$R_{96}$" each independently represent a hydrogen atom, or a substituted or unsubstituted aryl group; the above "$R_{95}$" and "$R_{96}$" may form a ring. "$Ar_{33}$," "$Ar_{34}$" and "$Ar_{35}$" represent the same, or a different, allylene group. "$X_6$," "k," "j" and "n" are the same as those in the above general formula (I).

General Formula (VII)

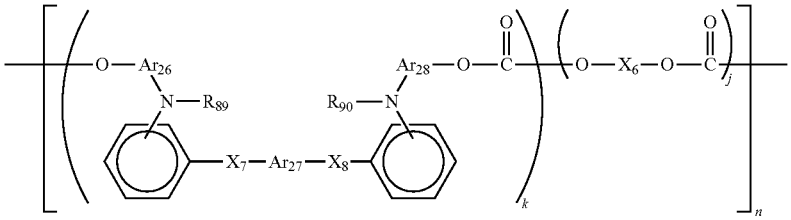

General Formula (X)

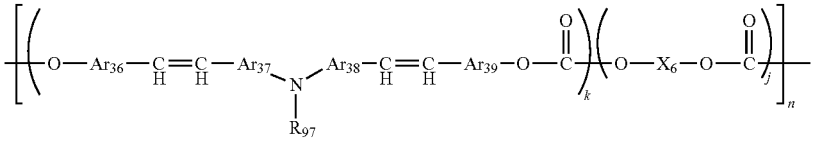

In the above general formula (X), "$R_{97}$" represents a substituted or unsubstituted aryl group. "$Ar_{36}$," "$Ar_{37}$," "$Ar_{38}$" and "$Ar_{39}$" represent the same, or a different, allylene group. "$X_6$," "k," "j" and "n" are the same as those in the above general formula (I).

General Formula (XI)

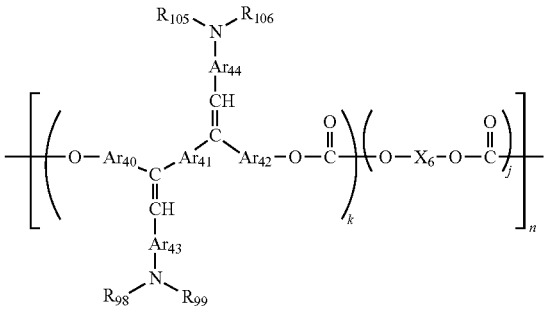

In the above general formula (XI), "$R_{98}$," "$R_{99}$," "$R_{105}$" and "$R_{106}$" each independently represent a substituted or unsubstituted aryl group. "$Ar_{40}$," "$Ar_{41}$," "$Ar_{42}$," "$Ar_{43}$" and "$Ar_{44}$" represent the same, or a different, allylene group. "$X_6$," "k," "j" and "n" are the same as those in the above general formula (I).

General Formula (XII)

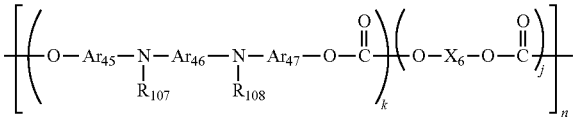

In the above general formula (XII), "$R_{107}$" and "$R_{108}$" each independently represent a substituted or unsubstituted aryl group. "$Ar_{45}$," "$Ar_{46}$" and "$Ar_{47}$" represent the same, or a different, allylene group. "$X_6$," "k," "j" and "n" are the same as those in the above general formula (I).

and "$R_{110}$" each independently represent a straight-chain or branched-chain alkylene group. "m" represents 0 or 1. "k," "j," "n" and "$X_6$" are the same as those in the above general formula (I).

The charge transport layer (37) is formed by dissolving or dispersing a charge transport material alone, or a charge transport material and a binder resin, into a suitable solvent to prepare an application liquid; applying the application liquid to the surface of the charge transport layer; and drying. Moreover, one type, or two or more types of plasticizer, leveling agent, antioxidant or the like may be added when necessary.

For the binder resin, for example, the following can be listed: polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin, alkyd resin, and any other thermoplastic or thermosetting resin.

For the solvent, for example, the following can be listed: tetrahydrofuran, dioxane, toluene, dichloromethane, monochlorobenzene, dichloroethane, cyclohexanone, methyl ethyl ketone, acetone, and the like. One of the above solvents may be used independently; or alternatively, two or more of the above solvents may be mixed.

For the antioxidant, a typical antioxidant described later can be used. However, the following compounds are particularly effective: compounds of (c) hydroquinone and (f) hindered amine.

However, the antioxidant used here is used for different purposes from those described below, and is used to keep the diazapentadiene derivative, which is used for the present invention, from being modified.

Therefore, it is preferred that the antioxidant be contained in a coating liquid during a process that precedes a process of putting in the diazapentadiene derivative. The amount of the antioxidant added to yield sufficient results is 0.1% by mass to 200% by mass relative to the diazapentadiene derivative.

As for a method of applying the coating liquid thus obtained, the following conventional application methods can be used: dip coating, spray coating, bead coating, nozzle coating, spinner coating, ring coating, and the like.

General Formula (XIII)

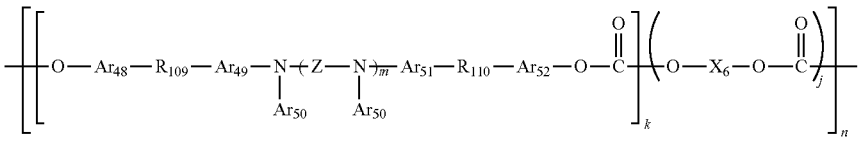

In the above general formula (XIII), "$Ar_{48}$," "$Ar_{49}$," "$Ar_{50}$," "$Ar_{51}$" and "$Ar_{52}$" each independently represent a substituted or unsubstituted aromatic ring group. "Z" represents an aromatic ring group, or —$Ar_{53}$-Za-$Ar_{53}$—. The above "$Ar_{53}$" represents a substituted or unsubstituted aromatic ring group. The above "Za" represents O, S, or an alkylene group. "$R_{109}$"

Then, the following describes the case where the photoconductive layer is a single layer structure (33). A photoconductor that is made by dispersing the above-described charge generation material into a binder resin can be used. The photoconductive layer can be formed by dissolving or dispersing a charge generation material, a charge transport material and a binder resin into a suitable solvent; and applying and drying the above.

Moreover, a plasticizer, a leveling agent, an antioxidant or the like may be added when necessary.

For the binder resin, besides the binder resin that has been described above along with the charge transport layer (37), the binder resin that has been described above along with the charge generation layer (35) may be mixed and used. Needless to say, the above-described high-molecular charge transport material can also be used well.

The amount of the charge generation material, relative to 100 parts by mass of the binder resin, is not specifically restricted, and can be selected appropriately according to the purpose. However, the amount of the charge generation material is preferably 5 parts by mass to 40 parts by mass. The amount of the charge transport material is preferably 0 parts by mass to 190 parts by mass, or more preferably 50 parts by mass to 150 parts by mass.

The photoconductive layer can be formed by applying the following coating liquid by means of dip coating, spray coating, bead coating, ring coating, or the like: an coating liquid that is made by dispersing the charge generation material, the binder resin and the charge transport material in a solvent such as tetrahydrofuran, dioxane, dichloroethane or cyclohexane with the use of a dispersing machine or the like. The appropriate film thickness of the photoconductive layer is about 5 μm to about 25 μm.

<<Under Layer>>

In the photoconductor of the present invention, an under layer can be provided between the electrically conductive substrate (31) and the photoconductive layer. In general, the under layer is made mainly of a resin. As for the resin, given that a photoconductive layer is applied onto the resin as a solvent, it is desirable that the resin be high in resistance to a typical organic solvent.

For such a resin, for example, the following resin can be listed: water-soluble resins, such as polyvinyl alcohol, casein, and sodium polyacrylate, alcohol-soluble resins, such as copolymerized nylon and methoxymethylated nylon, curable resins forming a three-dimensional network, such as polyurethane, melamine resin, phenol resin, alkyd-melamine resin and epoxy resin, and the like.

As for the under layer, in order to prevent moiré, reduce residual potential and achieve other objectives, fine powder of metal oxide pigment, examples of which are as follows, may be added to the under layer: titanium oxide, silica, alumina, zirconium oxide, tin oxide, indium oxide, and the like.

The under layer can be formed by using a suitable solvent and coating method as in the case of the above photoconductive layer. As the under layer, the following can be used: a silane coupling agent, titanate coupling agent, chromium coupling agent, or the like. Moreover, for the under layer, the following can also be used well: one on which $Al_2O_3$ is provided by means of anodic oxidation; and one on which an organic substance, such as poly-para-xylylene (parylene), or an inorganic substance, such as $SiO_2$, $SnO_2$, $TiO_2$, ITO or $CeO_2$, is provided by means of a vacuum thin-film preparation method. Furthermore, any other well-known materials may be used. The appropriate film thickness of the under layer is 0 μm to 5 μm.

<<Protective Layer>>

In the photoconductor of the present invention, in order to protect the photoconductive layer, a protective layer (39) may be provided on the photoconductive layer. For the protective layer (39), for example, the following materials can be listed: ABS resin, ACS resin, olefine-vinyl monomer copolymer, chlorinated polyether, aryl resin, phenol resin, polyacetal, polyamide, polyamide imide, polyacrylate, polyallyl sulfone, polybutylene, polybutylene terephthalate, polycarbonate, polyether sulfone, polyethylene, polythylene telephthalate, polyimide, acrylic resin, polymethylpentene, polypropylene, polyphenylene oxide, polysulfone, polystyrene, polyarylate, AS resin, butadiene-styrene copolymer, polyurethane, polyvinyl chloride, polyvinylidene chloride, epoxy resin, or any other resin. In terms of dispersibility of the filler, residual potential, and film defects, polycarbonate or polyarylate are particularly effective and useful.

To the protective layer of the photoconductor, a filler material is added in order to improve the wear and abrasion resistance. For the solvent used, all the solvents used in the charge transport layer (37), including the following, can be used: tetrahydrofuran, dioxane, toluene, dichloromethane, monochlorobenzene, dichloroethane, cyclohexanone, methyl ethyl ketone, acetone, and the like. However, a solvent whose viscosity is high is preferred during a dispersion process, while a solvent whose volatility is high is preferred during a coating process. If no solvent does meet the above conditions, two or more types of solvents that together have the above physical properties can be mixed and used. The mixture could be highly effective in terms of dispersibility of the filler and residual potential.

The protective layer may contain the above amine compound. Moreover, the addition of a low-molecular charge transport material or high-molecular charge transport material, which has been described along with the charge transport layer (37), is effective and useful in terms of reducing residual potential and improving image quality.

As a method of forming the protective layer, the following conventional methods can be used: dip coating, spray coating, bead coating, nozzle coating, spinner coating, ring coating, and the like. In particular, in terms of uniformity of the coating film, spray coating is more preferable.

<<Intermediate Layer>>

In the photoconductor of the present invention, an intermediate layer may be also provided between the photoconductive layer and the protective layer.

In general, the intermediate layer is made mainly of a binder resin. For the binder resin, for example, the following can be listed: polyamide, alcohol-soluble nylon, water-soluble polyvinyl butyral, polyvinyl butyral, polyvinyl alcohol, and the like.

As a method of forming the intermediate layer, as described above, a commonly-used application method is employed. Incidentally, the appropriate thickness of the intermediate layer is about 0.05 μm to about 2 μm.

According to the present invention, to improve the environmental resistance, especially in order to prevent a decrease in sensitivity and a rise in residual potential, to each of the layers, such as the charge generation layer, the charge transport layer, the under layer, the protective layer and the intermediate layer, an antioxidant, a plasticizer, a lubricant, an ultraviolet absorber and a leveling agent can be added. Typical materials for the above compounds are shown below.

For the antioxidant that can be added to each of the layers, for example, the following (a) to (e) and the like can be listed. However, the antioxidant is not limited to those described below. One of the antioxidants may be used independently; or alternatively, two or more may be used together. For example, an antioxidant having a high antioxidant capacity (but with a relatively short life) and a slow-acting antioxidant (with a relatively long life) can be used in combination. Moreover, even though not specified in each section, the same is true for other additive agents: one type may be used independently, or a plurality of types may be used together.

(a) Phenolic Compound

As for phenolic compound that can be used as the antioxidant, for example, the following can be listed: 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidene bis-(3-methyl-6-t-butylphenol), 1,1,3-tris-(2-methyl-4-hydroxy-5-t-butylphenyl)

butane, 1,3,5-trimethyl-2,4,6-tris (3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocopherols, and the like.

(b) Paraphenylenediamines

As for paraphenylenediamines that can be used as the antioxidant, for example, the following can be listed: N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinones

As for hydroquinones that can be used as the antioxidant, for example, the following can be listed: 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, 2-(2-octadecenyl)-5-methyl hydroquinone, and the like.

(d) Organosulfur Compounds

As for organosulfur compounds that can be used as the antioxidant, for example, the following can be listed: dilauryl-3,3'-thiodipropionate, distearyl-3,3'-thiodipropionate, ditetradecyl-3,3'-thiodipropionate, and the like.

(e) Organophosphorous Compounds

As for organophosphorous compounds that can be used as the antioxidant, for example, the following can be listed: triphenylphosphine, tri(nonylphenyl)phosphine, tri(dinonylphenyl)phosphine, tricresylphosphine, tri(2,4-dibutylphenoxy)phosphine, and the like.

For the plasticizer that can be added to each of the layers, for example, the following (a) to (m) and the like can be listed. However, the plasticizer is not limited to those described below.

(a) Phosphoric Acid Ester Plasticizers

As for phosphoric acid ester plasticizers that can be used as the plasticizer, for example, the following can be listed: triphenyl phosphate, tricresyl phosphate, trioctyl phosphate, octyl diphenyl phosphate, trichloroethyl phosphate, cresyl diphenyl phosphate, tributyl phosphate, tri-2-ethylhexyl phosphate, triphenyl phosphate, and the like.

(b) Phthalate Ester Plasticizers

As for phthalate ester plasticizers that can be used as the plasticizer, for example, the following can be listed: dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butyl benzyl phthalate, butyl lauryl phthalate, methyl oleyl phthalate, octyl decyl phthalate, dibutyl fumarate, dioctyl fumarate, and the like.

(c) Aromatic Carboxylic Acid Ester Plasticizers

As for aromatic carboxylic acid ester plasticizers that can be used as the plasticizer, for example, the following can be listed: trioctyl trimellitate, tri-n-octyl trimellitate, oxybenzoic acid octyl, and the like.

(c) Aliphatic Dibasic Acid Ester Plasticizers

As for aliphatic dibasic acid ester plasticizers that can be used as the plasticizer, for example, the following can be listed: dibutyl adipate, di-n-hexyl adipate, di-2-ethylhexyl adipate, di-n-octyl adipate, adipate-n-octyl-n-decyl, diisodecyl adipate, dicapryl adipate, di-2-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives

As for fatty acid ester derivatives that can be used as the plasticizer, for example, the following can be listed: butyl oleate, glycerol mono-oleic acid ester, methyl acetyl ricinolate, pentaerythritol ester, dipentaerythritol hexa ester, triacetin, tributyrin, and the like.

(f) Oxyacid Ester Plasticizers

As for oxyacid ester plasticizers that can be used as the plasticizer, for example, the following can be listed: methyl acetyl ricinolate, butyl acetyl ricinoleate, butyl phthalyl butyl glycolate, acetyl tributyl citrate, and the like.

(g) Epoxy Plasticizers

As for epoxy plasticizers that can be used as the plasticizer, for example, the following can be listed: epoxidized soybean oil, epoxidized linseed oil, epoxystearic acid butyl, epoxystearic acid decyl, epoxystearic acid octyl, epoxystearic acid benzyl, epoxy hexahydrophthalic acid dioctyl, epoxy hexahydrophthalic acid didecyl, and the like.

(h) Divalent Alcohol Ester Plasticizers

As for divalent alcohol ester plasticizers that can be used as the plasticizer, for example, the following can be listed: diethylene glycol dibenzoate, triethylene glycol di-2-ethyl butyrate, and the like.

(i) Chlorine-Containing Plasticizers

As for chlorine-containing plasticizers that can be used as the plasticizer, for example, the following can be listed: chlorinated paraffin, chlorinated diphenyl, chlorinated fatty acid methyl ester, methoxy chlorinated fatty acid methyl ester, and the like.

(j) Polyester Plasticizers

As for polyester plasticizers that can be used as the plasticizer, for example, the following can be listed: polypropylene adipate, polypropylene sebacate, polyester, acetylated polyester, and the like.

(k) Sulfonic Acid Derivatives

As for sulfonic acid derivatives that can be used as the plasticizer, for example, the following can be listed: p-toluenesulfonamide, o-toluenesulfonamide, p-toluenesulfon ethylamide, o-toluenesulfon ethylamide, toluenesulfon-N-ethylamide, p-toluenesulfon-N-cyclohexyl amide, and the like.

(l) Citric Acid Derivatives

As for citric acid derivatives that can be used as the plasticizer, for example, the following can be listed: triethyl citrate, acetyl triethyl citrate, tributyl citrate, acetyl tributyl citrate, acetyl tri-2-ethylhexyl citrate, acetyl-n-octyl decyl citrate, and the like.

(m) Others

As for the others that can be used as the plasticizer, for example, the following can be listed: terphenyl, partially hydrogenated terphenyl, camphor, 2-nitrodiphenyl, dinonyl naphthalene, methyl abietate, and the like.

For the lubricant that can be added to each of the layers, for example, the following (a) to (h) and the like can be listed. However, the lubricant is not limited to those described below.

(a) Hydrocarbon Compounds

As for hydrocarbon compounds that can be used as the lubricant, for example, the following can be listed: liquid paraffin, paraffin wax, micro wax, low-polymerization polyethylene, and the like.

(b) Fatty Acid Compounds

As for fatty acid compounds that can be used as the lubricant, for example, the following can be listed: lauric acid, myristic acid, palmitic acid, stearic acid, arachidic acid, behenic acid, and the like.

(c) Fatty Acid Amide Compounds

As for fatty acid amide compounds that can be used as the lubricant, for example, the following can be listed: stearyl amide, palmityl amide, oleic amide, methylenebisstearamide, ethylenebisstearamide, and the like.

(d) Ester Compounds

As for ester compounds that can be used as the lubricant, for example, the following can be listed: lower alcohol ester of fatty acid, polyhydric alcohol ester of fatty acid, fatty acid polyglycol ester, and the like.

(e) Alcohol Compounds

As for alcohol compounds that can be used as the lubricant, for example, the following can be listed: cetyl alcohol, stearyl alcohol, ethylene glycol, polyethylene glycol, polyglycerol, and the like.

(f) Metallic Soaps

As for metallic soaps that can be used as the lubricant, for example, the following can be listed: lead stearate, cadmium stearate, barium stearate, calcium stearate, zinc stearate, magnesium stearate, and the like.

(g) Natural Waxes

As for natural waxes that can be used as the lubricant, for example, the following can be listed: carnauba wax, candelilla wax, bees wax, whale wax, insects wax, montan wax, and the like.

(f) Others

As for the others that can be used as the lubricant, for example, the following can be listed: silicone compound, fluorine compound, and the like.

For the ultraviolet absorber that can be added to each of the layers, for example, the following (a) to (f) and the like can be listed. However, the ultraviolet absorber is not limited to those described below.

(a) Benzophenones

As for benzophenones that can be used as the ultraviolet absorber, for example, the following can be listed: 2-hydroxybenzophenone, 2,4-dihydroxybenzophenone, 2,2',4-trihydroxybenzophenone, 2,2',4,4'-tetrahydroxybenzophenone, 2,2'-dihydroxy 4-methoxybenzophenone, and the like.

(b) Salicylates

As for salicylates that can be used as the ultraviolet absorber, for example, the following can be listed: phenyl salicylate, 2,4-di-t-butylphenyl-3,5-di-t-butyl-4-hydroxybenzoate, and the like.

(c) Benzotriazoles

As for benzotriazoles that can be used as the ultraviolet absorber, for example, the following can be listed: (2'-hydroxyphenyl)benzotriazole, (2'-hydroxyl 5'-methylphenyl) benzotriazole, (2'-hydroxyl 5'-methylphenyl) benzotriazole, (2'-hydroxyl 3'-tertiary-butyl 5'-methylphenyl)5-chlorobenzotriazole, and the like.

(d) Cyanoacrylates

As for cyanoacrylates that can be used as the ultraviolet absorber, for example, the following can be listed: ethyl-2-cyano-3,3-diphenyl acrylate, methyl 2-carbomethoxy-3-(paramethoxy)acrylate, and the like.

(e) Quenchers (Metallic Complex Salts)

As for quenchers (metallic complex salts) that can be used as the ultraviolet absorber, for example, the following can be listed: nickel (2,2'-thiobis(4-t-octyl)phenolate) n-butyl amine, nickel dibutyl dithiocarbamate, nickel dibutyl dithiocarbamate, cobalt dicyclohexyl dithiophosphate, and the like.

(f) HALS (Hindered Amine)

As for HALS (hindered amine) that can be used as the ultraviolet absorber, for example, the following can be listed: bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpyridine, 8-benzil-7,7,9,9-tetramethyl-3-octyl-1,3,8-triazaspiro[4,5] undecane-2,4-dione, 4-benzoyloxy-2,2,6,6-tetramethylpiperidine, and the like.

(Electrophotographic Method and Electrophotographic Apparatus)

An electrophotographic method of the present invention is an electrophotographic method in which a process containing charging, imagewise exposing, developing and transferring is repeatedly performed on the electrophotographic photoconductor of the present invention.

Moreover, an electrophotographic method of the present invention may be a digital electrophotographic method in which a process containing charging, imagewise exposing, developing and transferring is repeatedly performed on the electrophotographic photoconductor of the present invention, wherein the imagewise exposing is forming a latent electrostatic image on the electrophotographic photoconductor with LD or LED to form.

An electrophotographic apparatus of the present invention is an electrophotographic apparatus that includes a charging unit, an imagewise exposing unit, a developing unit, a transferring unit, and the electrophotographic photoconductor of the present invention.

Moreover, an electrophotographic apparatus of the present invention may be a digital electrophotographic apparatus that includes a charging unit, an imagewise exposing unit, a developing unit, a transferring unit, and the electrophotographic photoconductor of the present invention, wherein the image exposing unit is configured to form a latent electrostatic image on the photoconductor with LD or LED.

The following describes in detail the electrophotographic method of the present invention and an image formation device with reference to the accompanying drawings.

Figure 7:
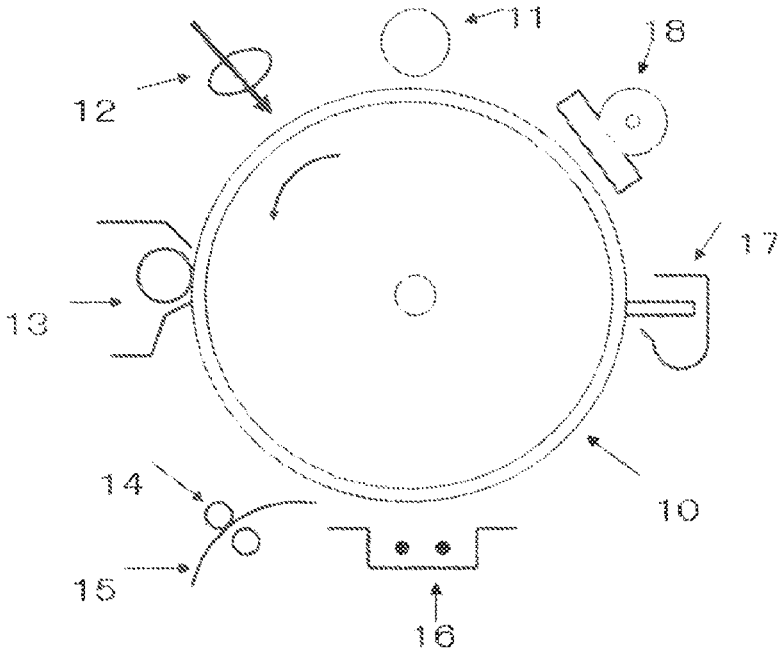
FIG. 7 is a schematic diagram illustrating an electrophotographic process and an electrophotographic apparatus according to the present invention.

FIG. 7 is a schematic diagram illustrating an electrophotographic process of the present invention and an image formation device. The examples described below are also within the scope of the present invention.

A photoconductor (10) rotates in a direction indicated by arrow in FIG. 7. A charging member (11), an image exposure member (12), a developing member (13), a transferring member (16), a cleaning member (17), an electricity removal member (18), and the like are disposed around the photoconductor (10). The cleaning member (17) and the electricity removal member (18) may be omitted.

An operation of the image formation device is basically as follows: the surface of the photoconductor (10) is substantially evenly charged by means of the charging member (11); the light of an image corresponding to an input signal is written by the image exposure member (12) to form a latent electrostatic image; a developing process is performed by the developing member (13) on the latent electrostatic image, and a toner image is formed on the surface of the photoconductor; the formed toner image is transferred by the transferring member to transfer paper (15), which is sent by conveying rollers (14) to a transfer site; the toner image is then fixed to the surface of the transfer paper by a fixing device, which is not shown in the diagram; part of the toner, which is not transferred to the transfer paper, is cleaned up by the cleaning member (17); and the residual charges on the photoconductor are removed by the electricity removal member (18) before the next cycle starts.

As shown in FIG. 7, the photoconductor (10) is in the shape of a drum. Instead, the photoconductor (10) may be in the shape of a sheet or an endless belt. For the charging member (11) and the transferring member (16), a corotron, a scorotron, and a solid-state charger, as well as a roller-shaped charging member, a brush-like charging member and the like, are used; all well-known means can be used.

Meanwhile, for light sources of the image exposure member (12), the electricity removal member (18) and the like, general light emitters including the following, can be used: a fluorescent lamp, a tungsten lamp, a halogen lamp, a mercury lamp, a sodium-vapor lamp, a light-emitting diode (LED), a semiconductor laser (LD), and electroluminescence (EL).

Among the above, a semiconductor laser (LD) and a light-emitting diode (LED) are primarily used.

In order to emit only a desired wavelength region of light, various filters, including the following, can also be used: a sharp-cut filter, a band-pass filter, a near-infrared cut filter, a dichroic filter, an interference filter, and a color conversion filter.

As for the light sources and the like, a transferring process, which is used in combination with photo-radiation, an electricity removal process, a cleaning process, a pre-exposure process, or any other process is provided to emit the light to the photoconductor (10). However, when the photoconductor (10) is exposed to the light during the electricity removal process, the effects of fatigue on the photoconductor (10) are large, possibly leading to a decrease in the amount of charge and an increase in residual potential among other things.

Instead of using the exposure process to remove the electricity, it may be also possible to remove the electricity by applying a reverse bias during the charging or cleaning process. In terms of increasing the durability of the photoconductor, the reverse-bias applying method could be effective.

After the electrophotographic photoconductor (10) is positively (or negatively) charged and then image exposure is performed, a positive (or negative) electrostatic latent image is formed on the surface of the photoconductor. When the image is developed with a negative-polarity (or positive-polarity) toner (electricity-detection fine particles), a positive image is obtained. When the image is developed with a positive-polarity (or negative-polarity) toner, a negative image is obtained.

For the developing unit, a well-known method is applied. For the electricity removal unit, a well-known method is used.

Among contaminants adhering to the surface of the photoconductor, discharge substances, which are generated by the charging process, external additive agents, which are contained in the toner, and the like are easily affected by humidity and cause abnormal images. However, among the substances that cause abnormal images is paper powder, which adheres to the photoconductor and often causes abnormal images. The paper powder also tends to result in a decrease in wear and abrasion resistance, as well as to cause uneven wear. Accordingly, for the reasons stated above, a structure in which the photoconductor is not in direct contact with the paper is preferred in terms of increasing the image quality.

The toner that is developed by the developing member (13) on the photoconductor (10) is transferred to the transfer paper (15). However, all the toner is not transferred. Some of the toner may remain on the photoconductor (10). The remaining toner is removed from the photoconductor (10) by the cleaning member (17).

For the cleaning member, a cleaning blade, a cleaning brush, or any other well-known units are used; both may be used together.

According to the photoconductor of the present invention, high light sensitivity and high stability are achieved. Therefore, the photoconductor of the present invention can be applied to a small-diameter photoconductor. Accordingly, as for an image formation device, or a method thereof, in which the above photoconductor is used in a more effective manner, the above can be used quite effectively for a so-called tandem-type image formation device that includes a plurality of photoconductors, which correspond to each of development units corresponding to a plurality of colors of toner, and performs parallel processing using the photoconductors. In the above tandem-type image formation device, at least four colors of toner needed for full-color printing, yellow (Y), magenta (M), cyan (C) and black (K), and the development units, which hold the four colors of toner, are disposed. Furthermore, the tandem-type image formation device includes at least four photoconductors corresponding to the development units. Therefore, full-color printing can be performed at speeds far faster than a conventional image formation device capable of full-color printing.

Figure 8:
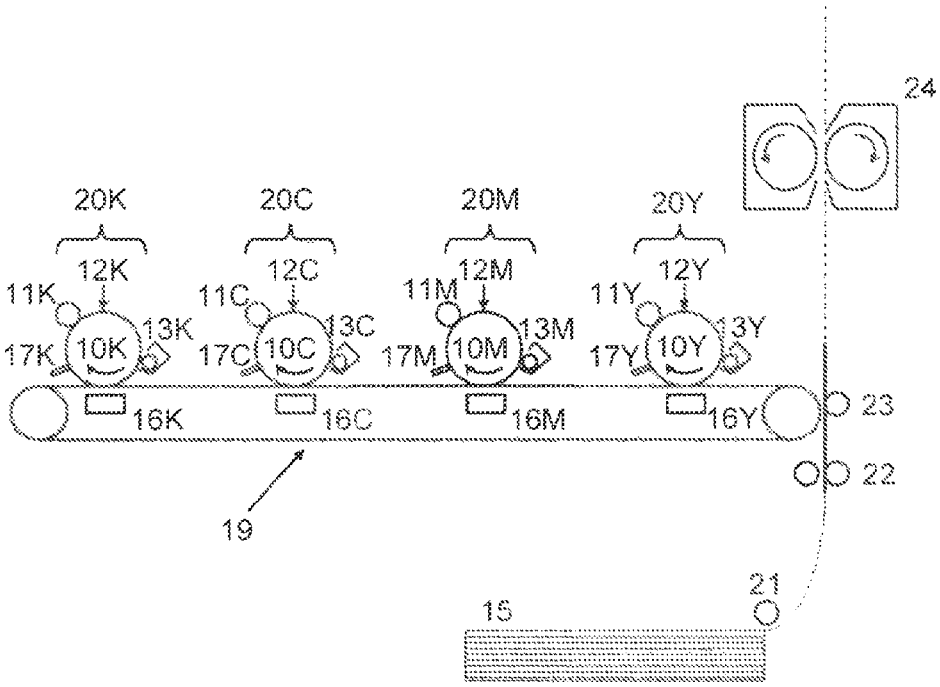
FIG. 8 shows another example of the electrophotographic process according to the present invention.

FIG. 8 is a schematic diagram illustrating a full-color electrophotographic apparatus of a tandem type according to the present invention. The modified example described below is also within the scope of the present invention.

In FIG. 8, photoconductors (10C (cyan)), (10M (magenta)), (10Y (yellow)) and (10K (black)) are drum-shaped photoconductors (10). The photoconductors (10C, 10M, 10Y, and 10K) rotate in a direction indicated by arrow in FIG. 8. Around the photoconductors, at least the following are disposed in order of rotation: charging members (11C, 11M, 11Y, and 11K), developing members (13C, 13M, 13Y, and 13K), and cleaning members (17C, 17M, 17Y, and 17K).

From the back surface's side of the photoconductors (10) between the charging members (11C, 11M, 11Y, and 11K) and the developing members (13C, 13M, 13Y, and 13K), laser beams (12C, 12M, 12Y, and 12K) from exposure members, which are not shown in the diagram, are emitted, forming electrostatic latent images on the photoconductors (10C, 10M, 10Y, and 10K).

Four image formation elements (20C, 20M, 20Y, and 20K), whose main components are the photoconductors (10C, 10M, 10Y, and 10K), are arranged side by side along a transfer belt (19), which is a transfer material conveying unit. The transfer belt (19) is in contact with the photoconductors (10C, 10M, 10Y, and 10K) between the developing members (13C, 13M, 13Y, and 13K) of the image formation elements (20C, 20M, 20Y, and 20K) and the cleaning members (17C, 17M, 17Y, and 17K). On a surface (back surface), which is the opposite side of the transfer belt (19) from the photoconductors (10), transferring members (16C, 16M, 16Y, and 16K) are disposed to apply a transfer bias. The image formation elements (20C, 20M, 20Y, and 20K) are the same in configuration except that the colors of toner in developing devices are different. In the color electrophotographic apparatus having the configuration shown in FIG. 8, an image formation operation is carried out in the following manner. First, in the image formation elements (20C, 20M, 20Y, and 20K), the photoconductors (10C, 10M, 10Y, and 10K) are charged by the charging members (11C, 11M, 11Y, and 11K), which rotate in a direction in which the charging members (11C, 11M, 11Y, and 11K) rotate in conjunction with the photoconductors 10. Then, in exposure units (not shown) disposed outside of the photoconductors (10), the laser beams (12C, 12M, 12Y, and 12K) are used to form electrostatic latent images, each of which corresponds to each of the colors of a to-be-created image.

Then, the latent images are developed by the developing members (13C, 13M, 13Y, and 13K), and toner images are formed. The developing members (13C, 13M, 13Y, and 13K) are developing members that perform a developing process with the use of toners C (cyan), M(magenta), Y (yellow) and K (black). The toner images of each color, created on the four photoconductors (10C, 10M, 10Y, and 10K), are superimposed on the transfer belt (19).

The transfer paper (15) is fed by a paper feed roller (21) from a tray, and is temporarily suspended at a pair of resist rollers (22). A process of sending the transfer paper (15) to a transferring member (23) is performed so as to coincide with the formation of images onto the photoconductors. The toner image that remains retained on the transfer belt (19) is transferred to the surface of the transfer paper (15) by means of an electric field created by a potential difference between a transfer bias applied to the transferring member (23) and the transfer belt (19). The toner image, which is transferred to the surface of the transfer paper, is carried away; the toner is fixed to the surface of the transfer paper by a fixing member (24). The paper is then ejected to a paper discharge unit, which is not shown in the diagram. The residual toner, which is not transferred by a transfer unit and still remains on the photoconductors (10C, 10M, 10Y, and 10K), is collected by the cleaning members (17C, 17M, 17Y, and 17K), which are provided in the corresponding units.

The intermediate transfer system shown in FIG. 8 is especially effective for an image formation device capable of full-color printing. After a plurality of toner images are once formed on an intermediate transfer member, the images are transferred to the paper at once. Therefore, the system makes it easier to control a process of preventing color shift, and is effective in terms of increasing the image quality.

The intermediate transfer member may be made of various materials, and formed into various shapes, such drum- and belt-shaped bodies. However, according to the present invention, any well-known intermediate transfer member can be used, which is effective and useful in terms of increasing the durability and the image quality of the photoconductors.

Incidentally, in the example shown in FIG. 8, the image formation elements are arranged in the following order of color from the upstream to the downstream side in the transfer-paper conveying direction: C (cyan), M (magenta), Y (yellow), and K (black). However, the color order is not limited to the above, and may be set arbitrarily. When a document is created only with a color of black, a mechanism provided for stopping the image formation elements (20C, 20M, and 20Y) of any colors other than black is especially used in an effective manner according to the present invention.

The above-described electrophotographic apparatus may be fixed and built inside a copying machine, a facsimile machine, or a printer; or alternatively, the electrophotographic apparatus may be incorporated into such a machine in the form of a process cartridge.

(Electrophotographic Process Cartridge)

An electrophotographic process cartridge of the present invention is an electrophotographic apparatus process cartridge that includes at least the electrophotographic photoconductor of the present invention.

The following describes in detail the electrophotographic process cartridge of the present invention with reference to the accompanying drawings.

Figure 9:
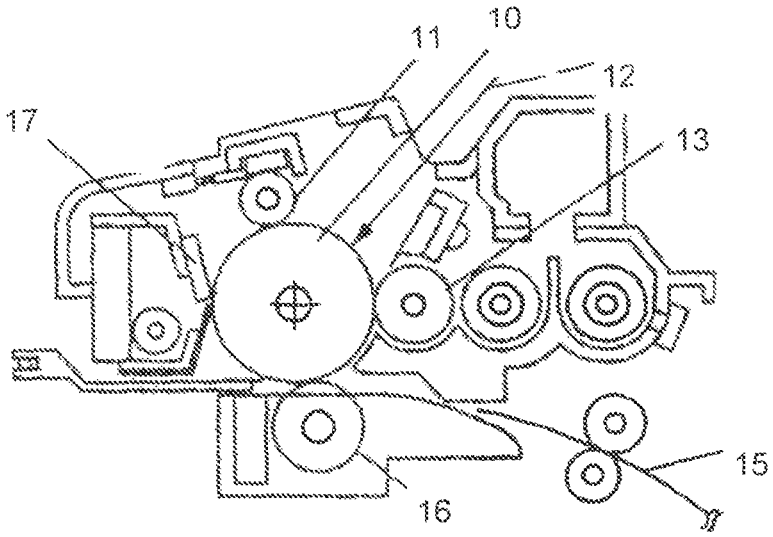
FIG. 9 is a schematic diagram illustrating an electrophotographic process cartridge according to the present invention.

As for the shape and other factors of the process cartridge, many can be listed. In a typical example, a process cartridge shown in FIG. 9 and the like can be listed. As shown in FIG. 9, the process cartridge is one device (component) including a built-in photoconductor (10), as well as a charging member (11), an image exposure member (12), a developing member (13), a transferring member (16), a cleaning member (17), and an electricity removal member.

The above tandem-type image formation device can transfer a plurality of toner images at once, thereby realizing high-speed full-color printing.

However, at least four photoconductors are required, inevitably making the device larger in size. Moreover, depending on the amount of toner used, the photoconductors become worn down in different quantities, resulting in a decrease in color reproducibility, the occurrence of abnormal images, and many other problems.

In contrast, the photoconductor of the present invention can be applied even to a small-diameter photoconductor because high light sensitivity and high stability can be achieved. Moreover, the photoconductor of the present invention has succeeded in reducing the effects of a residual-potential increase, sensitivity degradation and the like. Therefore, even if the four photoconductors are used in different quantities, there are only small differences in residual potential and sensitivity at the time of repeated use. Even if the photoconductors are used repeatedly for a long period of time, it is possible to obtain a full-color image that is excellent in color reproducibility.

The above-described image formation unit may be fixed and built inside a copying machine, a facsimile machine, or a printer; or alternatively, the image formation unit may be incorporated into such a machine in the form of a process cartridge. The process cartridge is one device (component) including a built-in photoconductor, as well as a charging unit, an exposure unit, a developing unit, a transferring unit, a cleaning unit, and an electricity removal unit. As for the shape and other factors of the process cartridge, many can be listed. In a typical example, a process cartridge shown in FIG. 9 can be listed. A photoconductor (16) includes at least a photoconductive layer on an electrically conductive substrate, and contains a filler in an outermost surface layer.

EXAMPLES

The present invention will next be described by way of Examples, which should not be construed as limiting the present invention thereto. Incidentally, the unit "part(s)" means "part(s) by mass."

Production Example 1

Production of Imidazole Derivative

The following were placed into a four-necked flask, and were heated and refluxed for three hours: 4.50 g (21.4 mmol) of benzil, 5.00 g (2.14 mmol) of 2,5-di-t-butyl-4-hydroxybenzaldehyde, 32.5 g (428 mmol) of ammonium acetate, and 400 ml of acetic acid. After being cooled, the above was added to one liter of ice water, thereby separating out deposits, which were then sucked and filtered. In a mixed solvent of toluene/tetrahydrofuran, recrystallization was carried out, and 3.5 g of the imidazole derivative represented by the following formula (yield: 39%) was obtained as a result. The melting point was 250° C. or more.

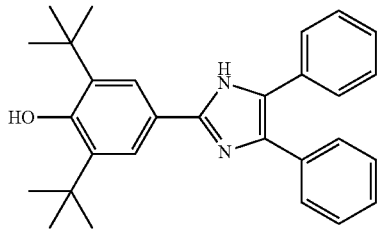

Production Example 2

Production of No. 2 Exemplary Compound

Figure 11:
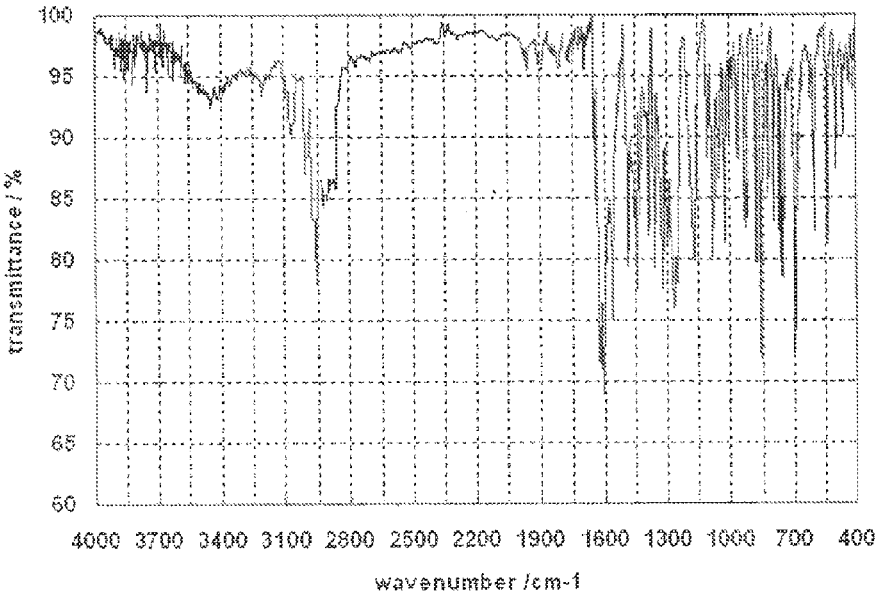
FIG. 11 is a diagram showing an IR spectrum of the No. 2 exemplary compound according to Production Example 2 of the present invention.

Two hundred fifty milliliters of a water solution of 20% by mass $K_3Fe(CN)_6$ was dropped over one hour into a mixture of the following substances while being stirred vigorously at room temperature: 3.00 g (7.10 mmol) of the imidazole derivative obtained in Production Example 1, 200 ml of 2N KOH water solution, and 300 ml of toluene. The reaction solution was extracted with toluene; the organic layer was washed with water, and toluene was distilled away through concentration. The resultant substance was recrystallized from a mixed solvent of toluene/ethanol, and the obtained crystal was then dried by a vacuum heating dryer. As a result, 1.50 g of No. 2 exemplary compound, which is red needle crystal represented by the following structural formula, was obtained (yield: 50%). The melting point was 202.0° C. to 203.0° C. FIG. 11 shows an IR spectrum thereof.

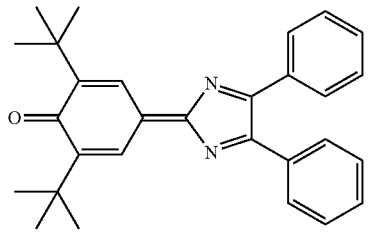

Production Example 3

Production of No. 6 Exemplary Compound

The following were placed into a four-necked flask, and were heated and refluxed for three hours: 5.00 g (33.30 mmol) of benzil, 4.93 g (33.30 mmol) of 2,5-dimethyl-4-hydroxybenzaldehyde, 51.3 g (666 mmol) of ammonium acetate, and 250 ml of acetic acid. After being cooled, the above was added to one liter of ice water, thereby separating out deposits, which were then sucked and filtered. In a mixed solvent of toluene/tetrahydrofuran, recrystallization was carried out, and 9.40 g of white powder of the compound represented by the following formula was obtained as a result.

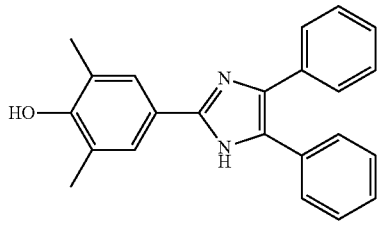

Figure 12:
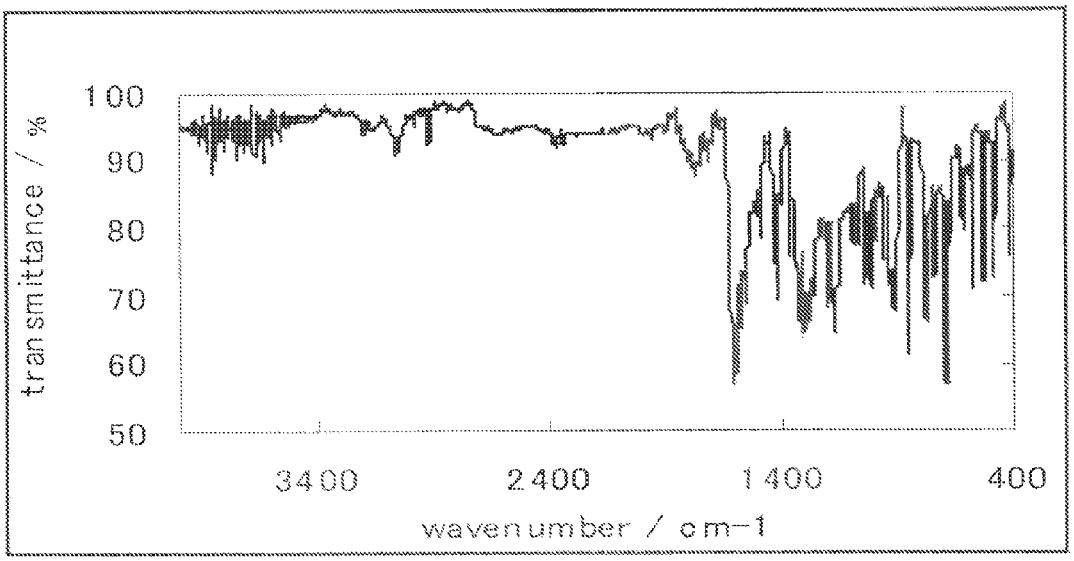
FIG. 12 is a diagram showing an IR spectrum of the No. 6 exemplary compound according to Production Example 3 of the present invention.

Two hundred fifty milliliters of a water solution of 20% by mass $K_3Fe(CN)_6$ was dropped over one hour into a mixture of the following substances while being stirred vigorously at room temperature: 3.00 g (7.10 mmol) of the compound obtained in above process, 200 ml of 2N KOH water solution, and 300 ml of toluene. The reaction solution was extracted with toluene; the organic layer was washed with water, and toluene was distilled away through concentration. The resultant substance was recrystallized from a mixed solvent of toluene/ethanol, and the obtained crystal was then dried by a vacuum heating dryer. As a result, 1.70 g of No. 6 exemplary compound, which is red needle crystal represented by the following structural formula, was obtained (yield: 56.7%). FIG. 12 shows an IR spectrum thereof.

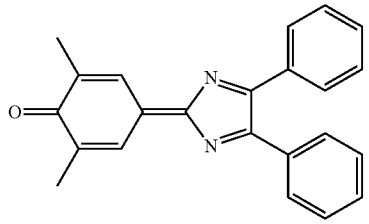

Production Example 4

Synthesis of No. 12 Compound

The following were placed into a four-necked flask, and were heated and refluxed for three hours: 3.3 g (22.50 mmol) of 1-phenyl-1,2-propanedione, 5.27 g (22.50 mmol) of 2,5-di-t-butyl-4-hydroxybenzaldehyde, 34.27 g (450 mmol) of ammonium acetate, and 250 ml of acetic acid. After being cooled, the above was added to one liter of ice water, thereby separating out deposits, which were then sucked and filtered. In a mixed solvent of toluene/tetrahydrofuran, recrystallization was carried out, and 2.70 g of white powder of the compound represented by the following formula was obtained as a result.

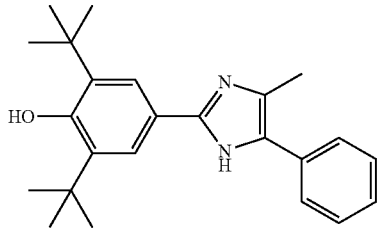

Figure 13:
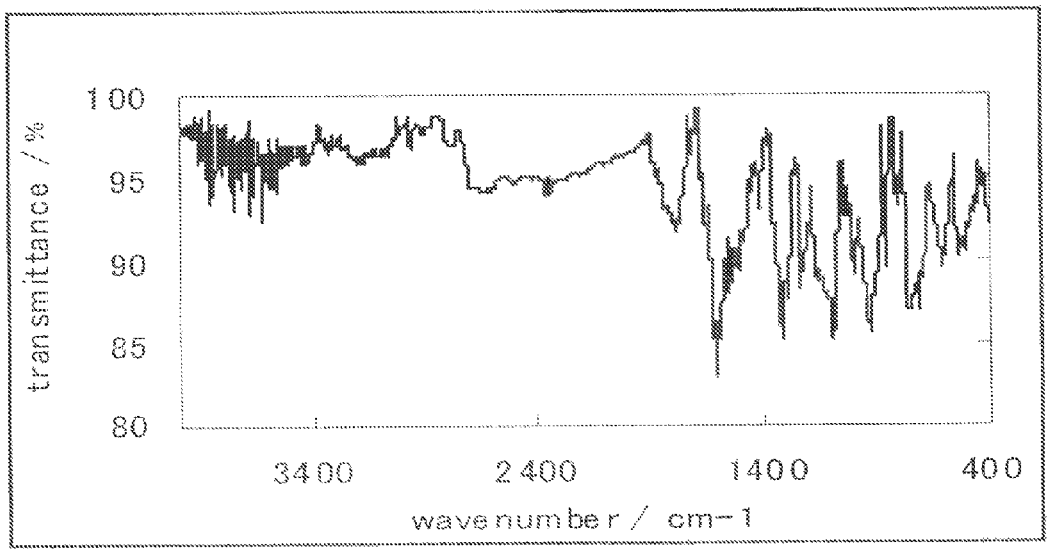
FIG. 13 is a diagram showing an IR spectrum of the No. 12 exemplary compound according to Production Example 4 of the present invention.

Two hundred fifty milliliters of a water solution of 20% by mass $K_3Fe(CN)_6$ was dropped over one hour into a mixture of the following substances while being stirred vigorously at room temperature: 2.70 g (7.40 mmol) of the compound obtained in above process, 200 ml of 2N KOH water solution, and 300 ml of toluene. The reaction solution was extracted with toluene; the organic layer was washed with water, and toluene was distilled away through concentration. The resultant substance was recrystallized from a mixed solvent of toluene/ethanol, and the obtained crystal was then dried by a vacuum heating dryer. As a result, 1.52 g of No. 12 exemplary compound, which is orange powder represented by the following structural formula, was obtained (yield: 76.0%). FIG. 13 shows an IR spectrum thereof.

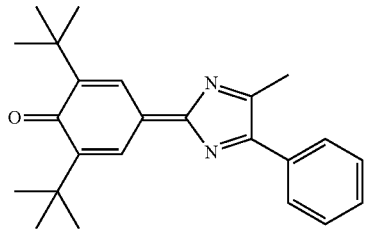

Production Example 5

Synthesis of No. 34 Compound

The following were placed into a four-necked flask, and were heated and refluxed for three hours: 3.93 g (14.08 mmol) of 2,2'-dichlorobenzil, 3.30 g (14.08 mmol) of 2,5-di-t-butyl-4-hydroxybenzaldehyde, 50 g of ammonium acetate, and 250 ml of acetic acid. After being cooled, the above was added to one liter of ice water, thereby separating out deposits, which were then sucked and filtered. In a mixed solvent of toluene/tetrahydrofuran, recrystallization was carried out, and 6.60 g of white powder of the compound represented by the following formula was obtained as a result.

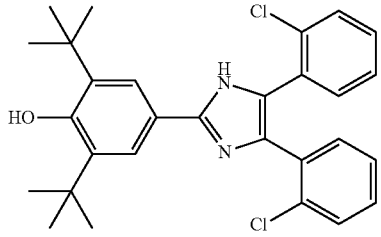

Figure 14:
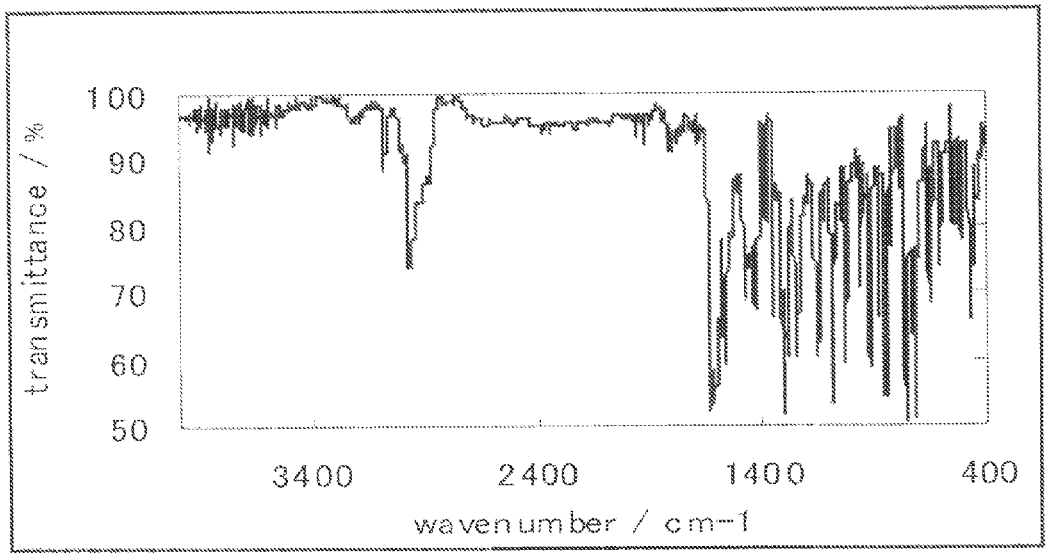
FIG. 14 is a diagram showing an IR spectrum of the No. 34 exemplary compound according to Production Example 5 of the present invention.

Two hundred fifty milliliters of a water solution of 20% by mass $K_3Fe(CN)_6$ was dropped over one hour into a mixture of the following substances while being stirred vigorously at room temperature: 4.00 g (8.10 mmol) of the compound obtained in above process, 200 ml of 2N KOH water solution, and 300 ml of toluene. The reaction solution was extracted with toluene; the organic layer was washed with water, and toluene was distilled away through concentration. The resultant substance was recrystallized from a mixed solvent of toluene/ethanol, and the obtained crystal was then dried by a vacuum heating dryer. As a result, 1.52 g of No. 34 exemplary compound, which is reddish brown needle crystal represented by the following structural formula, was obtained (yield: 76.0%). FIG. 14 shows an IR spectrum thereof.

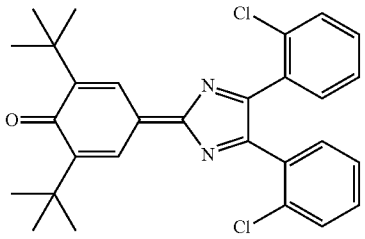

Production Example 6

Synthesis of No. 35 Compound

The following were placed into a four-necked flask, and were heated and refluxed for three hours: 5.00 g (18.50 mmol) of 3,3'-dimethoxybenzyl, 4.33 g (18.50 mmol) of 2,5-di-t-butyl-4-hydroxybenzaldehyde, 50 g of ammonium acetate, and 250 ml of acetic acid. After being cooled, the above was added to one liter of ice water, thereby separating out deposits, which were then sucked and filtered. In a mixed solvent of toluene/tetrahydrofuran, recrystallization was carried out, and 8.20 g of white powder of the compound represented by the following formula was obtained as a result.

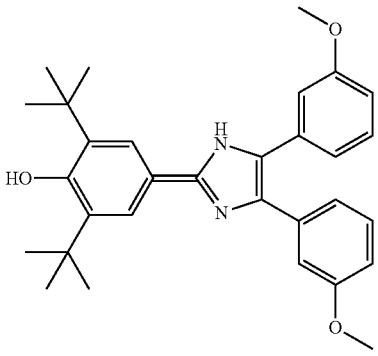

Figure 15:
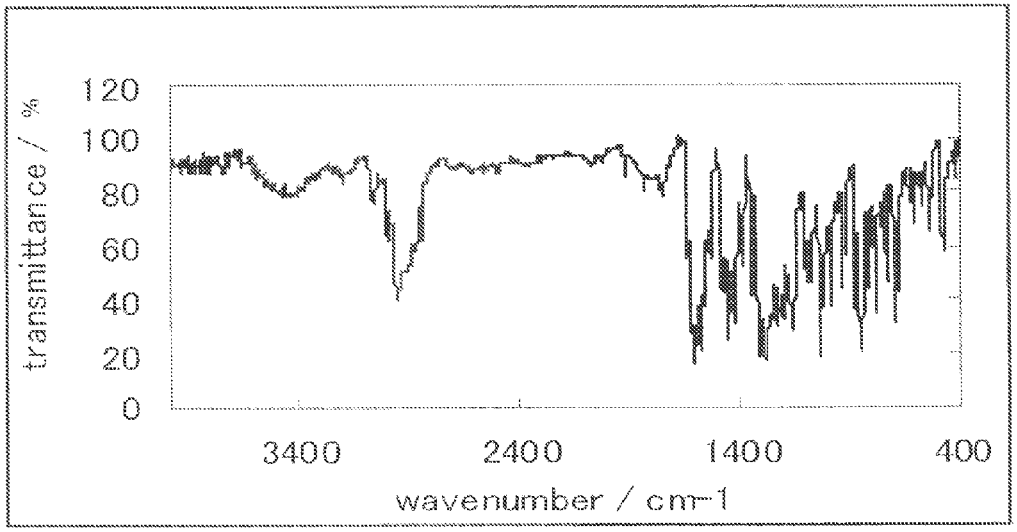
FIG. 15 is a diagram showing an IR spectrum of the No. 35 exemplary compound according to Production Example 6 of the present invention.

Two hundred fifty milliliters of a water solution of 20% by mass $K_3Fe(CN)_6$ was dropped over one hour into a mixture of the following substances while being stirred vigorously at room temperature: 4.00 g (8.26 mmol) of the compound obtained in above process, 200 ml of 2N KOH water solution, and 300 ml of toluene. The reaction solution was extracted with toluene; the organic layer was washed with water, and toluene was distilled away through concentration. The resultant substance was recrystallized from a mixed solvent of toluene/ethanol, and the obtained crystal was then dried by a vacuum heating dryer. As a result, 3.40 g of No. 35 exemplary compound, which is reddish brown needle crystal represented by the following structural formula, was obtained (yield: 85.0%). FIG. 15 shows an IR spectrum thereof.

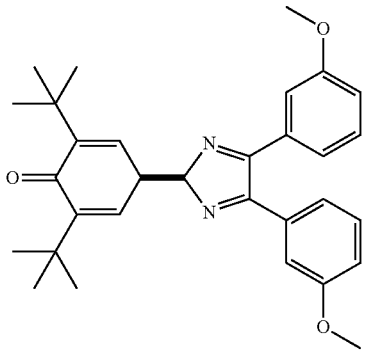

Production Example 7

Synthesis of No. 37 Compound

The following were placed into a four-necked flask, and were heated and refluxed for three hours: 6.50 g (21.30 mmol) of 2-chloro-3'4'-dimethoxybenzyl, 5.00 g (21.30 mmol) of 2,5-di-t-butyl-4-hydroxybenzaldehyde, 20 g of ammonium acetate, and 250 ml of acetic acid. After being cooled, the above was added to one liter of ice water, thereby separating out deposits, which were then sucked and filtered. In a mixed solvent of toluene/tetrahydrofuran, recrystallization was carried out, and 10.90 g of white powder of the compound represented by the following formula was obtained as a result.

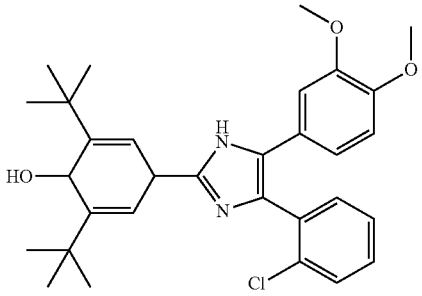

Figure 16:
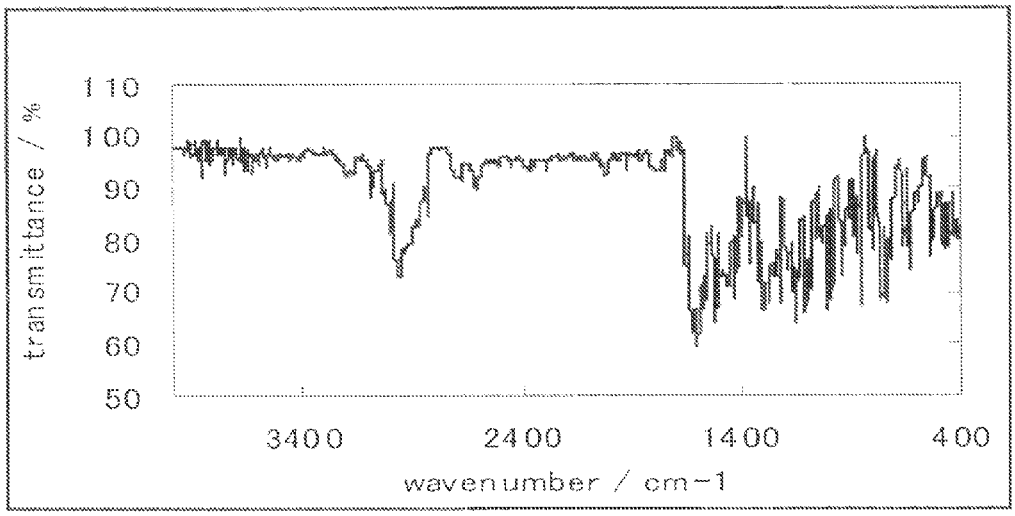
FIG. 16 is a diagram showing an IR spectrum of the No. 37 exemplary compound according to Production Example 7 of the present invention.

Two hundred fifty milliliters of a water solution of 20% by mass $K_3Fe(CN)_6$ was dropped over one hour into a mixture of the following substances while being stirred vigorously at room temperature: 4.00 g (7.72 mmol) of the compound obtained in above process, 200 ml of 2N KOH water solution, and 300 ml of toluene. The reaction solution was extracted with toluene; the organic layer was washed with water, and toluene was distilled away through concentration. The resultant substance was recrystallized from a mixed solvent of toluene/ethanol, and the obtained crystal was then dried by a vacuum heating dryer. As a result, 2.40 g of No. 37 exemplary compound, which is reddish brown needle crystal represented by the following structural formula, was obtained (yield: 60.2%). FIG. 16 shows an IR spectrum thereof.

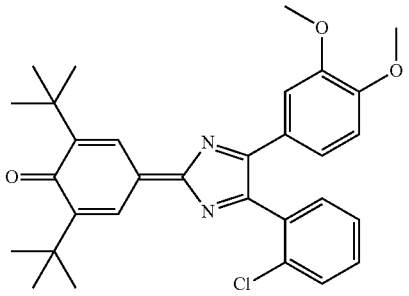

Production Example 8

Synthesis of No. 50 Compound

The following were placed into a four-necked flask, and were heated and refluxed for three hours: 4.45 g (21.40 mmol) of phenanthrenequinone, 5.00 g (21.30 mmol) of 2,5-di-t-butyl-4-hydroxybenzaldehyde, 33 g of ammonium acetate, and 250 ml of acetic acid. After being cooled, the above was added to one liter of ice water, thereby separating out deposits, which were then sucked and filtered. In a mixed solvent of toluene/tetrahydrofuran, recrystallization was carried out, and 7.00 g of white powder of the compound represented by the following formula was obtained as a result.

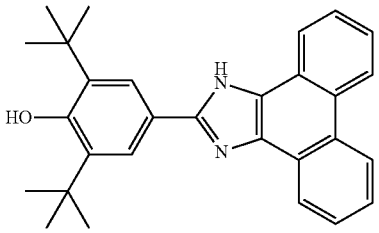

Figure 17:
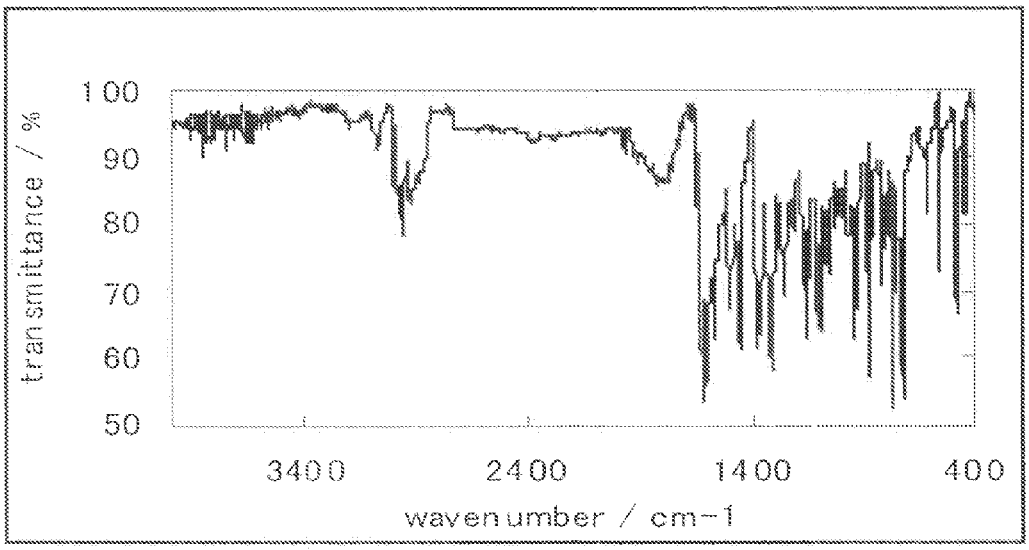
FIG. 17 is a diagram showing an IR spectrum of the No. 50 exemplary compound according to Production Example 8 of the present invention.

Two hundred fifty milliliters of a water solution of 20% by mass $K_3Fe(CN)_6$ was dropped over one hour into a mixture of the following substances while being stirred vigorously at room temperature: 2.00 g (4.73 mmol) of the compound obtained in above process, 200 ml of 2N KOH water solution, and 300 ml of toluene. The reaction solution was extracted with toluene; the organic layer was washed with water, and toluene was distilled away through concentration. The resultant substance was recrystallized from a mixed solvent of toluene/ethanol, and the obtained crystal was then dried by a vacuum heating dryer. As a result, 0.60 g of No. 50 exemplary compound, which is reddish brown needle crystal represented by the following structural formula, was obtained (yield: 30.0%). FIG. 17 shows an IR spectrum thereof.

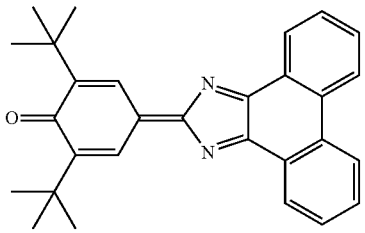

Production Example 9

Synthesis of No. 60 Compound

The following were placed into a four-necked flask, and were heated and refluxed for three hours: 4.06 g (27.40 mmol) of benzil, 5.00 g (27.40 mmol) of 2,5-dimethoxy-4-hydroxybenzaldehyde, 50 g of ammonium acetate, and 250 ml of acetic acid. After being cooled, the above was added to one liter of ice water, thereby separating out deposits, which were then sucked and filtered. In a mixed solvent of toluene/tetrahydrofuran, recrystallization was carried out, and 7.70 g of white powder of the compound represented by the following formula was obtained as a result.

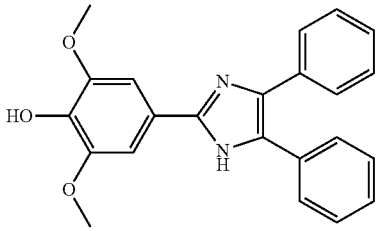

Figure 18:
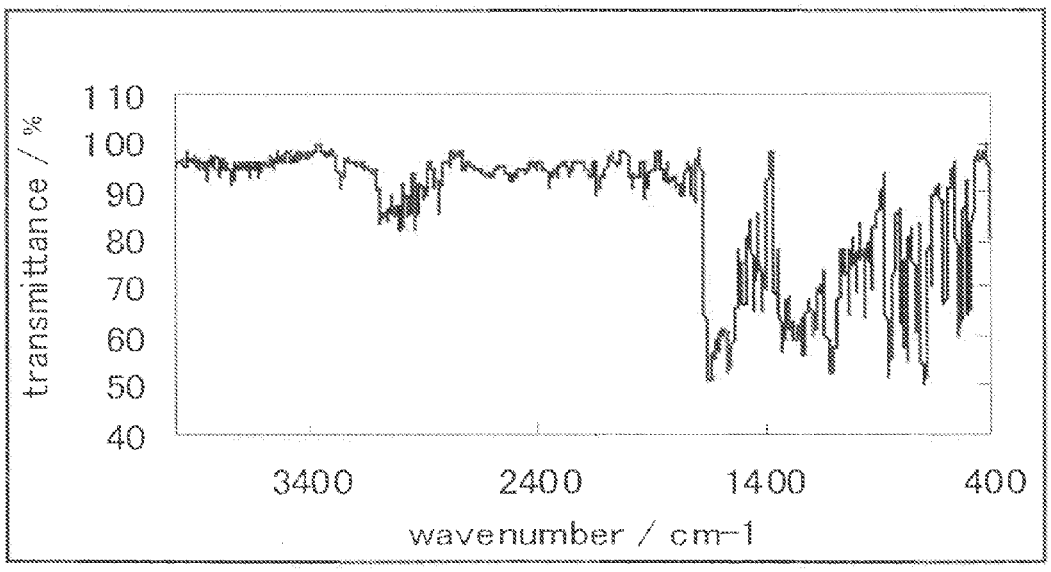
FIG. 18 is a diagram showing an IR spectrum of the No. 60 exemplary compound according to Production Example 9 of the present invention.

Two hundred fifty milliliters of a water solution of 20% by mass $K_3Fe(CN)_6$ was dropped over one hour into a mixture of the following substances while being stirred vigorously at room temperature: 4.00 g (10.80 mmol) of the compound obtained in above process, 200 ml of 2N KOH water solution, and 300 ml of toluene. The reaction solution was extracted with toluene; the organic layer was washed with water, and toluene was distilled away through concentration. The resultant substance was recrystallized from a mixed solvent of toluene/ethanol, and the obtained crystal was then dried by a vacuum heating dryer. As a result, 1.70 g of No. 60 exemplary compound, which is reddish brown needle crystal represented by the following structural formula, was obtained (yield: 42.5%). FIG. 18 shows an IR spectrum thereof.

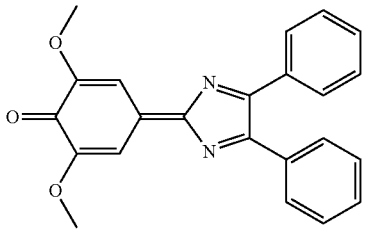

Example 1

To the surface of an aluminum cylinder, the following coating liquids, which each have the composition described below, are sequentially applied by means of dip coating and then dried: an under layer coating liquid, a charge generation layer coating liquid, and a charge transport layer coating liquid. As a result, an under layer having a thickness of 3.5 μm, a charge generation layer having a thickness of 0.2 μm, and a charge transport layer having a thickness of 23 μm are formed (No. 1 photoconductor).

<Production of Oxo-Titanium Phthalocyanine>

Figure 10:
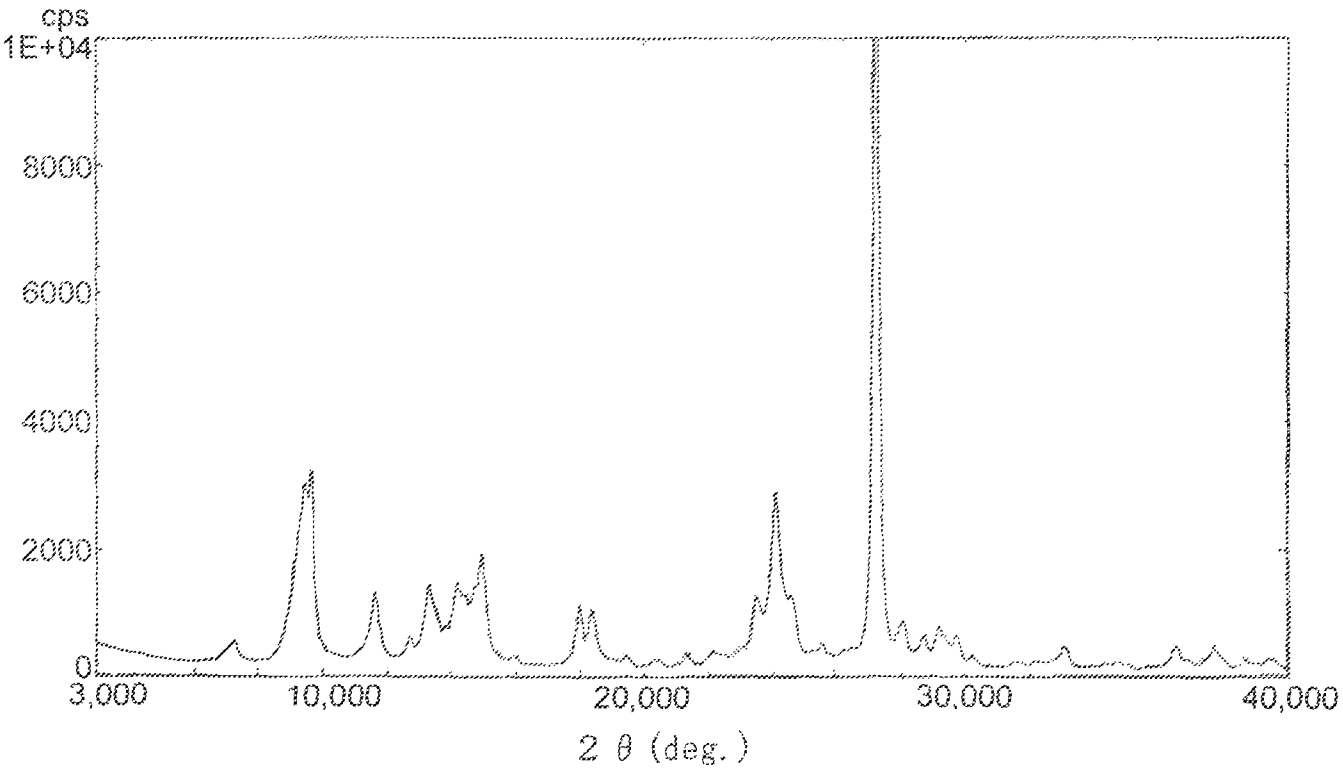
FIG. 10 is a diagram showing a powder XD spectrum of oxo-titanium phthalocyanine.

As in the case of Synthesis Example 4 disclosed in Japanese Patent Application Laid-Open No. 2001-019871, 29.2 g of 1,3-diiminoisoindoline and 200 ml of sulfolane were mixed; under a nitrogen gas stream, 20.4 g of titanium tetrabutoxide was dropped. After the dropping was completed, the temperature was raised gradually to 180° C.; the above was stirred for five hours, and the reaction took place with the reaction temperature maintained at between 170° C. and 180° C. After the reaction came to an end, the heat was released, and the precipitate was filtered out. The resultant substance was washed with chloroform until the powder turned blue. Then, the substance was washed several times with methanol, and then washed again several times with 80° C. hot water before being dried. As a result, crude titanyl phthalocyanine was obtained. The crude titanyl phthalocyanine was dissolved in 20 times the amount of concentrated sulfuric acid to the crude titanyl phthalocyanine, and was then dropped into 100 times the amount of ice water to the crude titanyl phthalocyanine while being stirred. The precipitated crystal was filtered out, and then washed with water repeatedly until the cleaning solvent became neutral. As a result, wet cake of titanyl phthalocyanine pigment was obtained. FIG. 10 shows an X-ray diffraction spectrum of a dried product of the cake. Two grams of the obtained wet cake was put into 20 g of carbon bisulfide, and was stirred for four hours. One hundred grams of methanol was added thereto before being stirred for one hour. Then, filtering and drying were carried out, and the crystalline powder of oxo-titanium phthalocyanine was obtained.

<Under Layer Coating Liquid>

Titanium dioxide powder (manufactured by ISHIHARA SANGYO KAISHA, LTD.; TIPAQUE CR-EL): 400 parts Melamine resin (manufactured by Dainippon Ink and Chemicals, Inc.; SUPER BECKAMINE G821-60): 65 parts Alkyd resin (manufactured by Dainippon Ink and Chemicals, Inc.; BECKOLITE M6401-50): 120 parts 2-Butanone: 400 parts <Charge Generation Layer Coating Liquid>

Oxo-titanium phthalocyanine having a powder XD spectrum shown in FIG. 10: 8 parts Polyvinyl butyral (manufactured by Union Carbide Corporation; XYHL): 5 parts 2-Butanone: 200 parts Cyclohexanone: 400 parts <Charge Transport Layer Coating Liquid>

Polycarbonate resin (Z POLICA, manufactured by Teijin Chemicals Ltd.): 10 parts

Diazapentadiene derivative of the No. 2 exemplary compound: 10 parts

Tetrahydrofuran: 100 parts

The electrophotographic photoconductor thus produced was mounted in an electrophotographic process cartridge. IMAGIO MF2200, manufactured by RICOH Company, Ltd., was so modified that the charging method thereof was of a positively-charged-corona charging type and the image exposure light source was a 655 nm semiconductor laser (LD); the dark part potential thereof was set to 800 (V). A repeat test, which amounted to a process of successively printing 100,000 copies in total, was conducted. At this time, the initial image and the image obtained after the repeat test were assessed. As for blurred images (dot resolution), 10 sheets of a dot image that is 236 dot/cm (600 dpi)×236 dot/cm (600 dpi) in pixel density and 5% in image density were successively printed out. Then, the shape of the dot was observed under a stereoscopic microscope. The sharpness of the contour was rated on a scale of 1 to 5 (5 means "excellent," and 1 "poor") as shown below.

(Dot Image Evaluation Criteria)

5: Clear contour, excellent

4: Very slightly blurred contour observed, but excellent

3: Slightly blurred contour observed, but substantially excellent

2: Blurred contour observed, posing problems depending on image type

1: Dot image cannot be determined

Table 2 shows the results.

Example 2

The No. 2 electrophotographic photoconductor of Example 2 was produced and then assessed in the same way as in Example 1 except that, instead of the diazapentadiene derivative of the No. 2 exemplary compound in Example 1, the No. 1 exemplary compound shown in Table 2 was used. Similarly, Table 2 shows the results.

Example 3

The No. 3 electrophotographic photoconductor of Example 3 was produced and then assessed in the same way as in Example 1 except that, instead of the diazapentadiene derivative of the No. 2 exemplary compound in Example 1, the No. 4 exemplary compound shown in Table 2 was used. Similarly, Table 2 shows the results.

Example 4

The No. 4 electrophotographic photoconductor of Example 4 was produced and then assessed in the same way as in Example 1 except that, instead of the diazapentadiene derivative of the No. 2 exemplary compound in Example 1, the No. 8 exemplary compound shown in Table 2 was used. Similarly, Table 2 shows the results.

Example 5

The No. 5 electrophotographic photoconductor of Example 5 was produced and then assessed in the same way as in Example 1 except that, instead of the diazapentadiene derivative of the No. 2 exemplary compound in Example 1, the No. 12 exemplary compound shown in Table 2 was used. Similarly, Table 2 shows the results.

Example 6

The No. 6 electrophotographic photoconductor of Example 6 was produced and then assessed in the same way as in Example 1 except that, instead of the diazapentadiene derivative of the No. 2 exemplary compound in Example 1, the No. 16 exemplary compound shown in Table 2 was used. Similarly, Table 2 shows the results.

Example 7

The No. 7 electrophotographic photoconductor of Example 7 was produced and then assessed in the same way as in Example 1 except that, instead of the diazapentadiene derivative of the No. 2 exemplary compound in Example 1, the No. 20 exemplary compound shown in Table 2 was used. Similarly, Table 2 shows the results.

Example 8

The No. 8 electrophotographic photoconductor of Example 8 was produced and then assessed in the same way as in Example 1 except that, instead of the diazapentadiene derivative of the No. 2 exemplary compound in Example 1, the No. 24 exemplary compound shown in Table 2 was used. Similarly, Table 2 shows the results.

Example 9

The No. 9 electrophotographic photoconductor of Example 9 was produced and then assessed in the same way as in Example 1 except that, instead of the diazapentadiene derivative of the No. 2 exemplary compound in Example 1, the No. 28 exemplary compound shown in Table 2 was used. Similarly, Table 2 shows the results.

Example 10

The No. 10 electrophotographic photoconductor of Example 10 was produced and then assessed in the same way as in Example 1 except that, instead of the diazapentadiene derivative of the No. 2 exemplary compound in Example 1, the No. 32 exemplary compound shown in Table 2 was used. Similarly, Table 2 shows the results.

Example 11

The No. 11 electrophotographic photoconductor of Example 11 was produced and then assessed in the same way as in Example 1 except that, instead of the diazapentadiene derivative of the No. 2 exemplary compound in Example 1, the No. 36 exemplary compound shown in Table 2 was used. Similarly, Table 2 shows the results.

Example 12

The No. 12 electrophotographic photoconductor of Example 12 was produced and then assessed in the same way as in Example 1 except that, instead of the diazapentadiene derivative of the No. 2 exemplary compound in Example 1, the No. 40 exemplary compound shown in Table 2 was used. Similarly, Table 2 shows the results.

Example 13

The No. 13 electrophotographic photoconductor of Example 13 was produced and then assessed in the same way as in Example 1 except that, instead of the diazapentadiene derivative of the No. 2 exemplary compound in Example 1, the No. 44 exemplary compound shown in Table 2 was used. Similarly, Table 2 shows the results.

Example 14

The No. 14 electrophotographic photoconductor of Example 14 was produced and then assessed in the same way as in Example 1 except that, instead of the diazapentadiene derivative of the No. 2 exemplary compound in Example 1, the No. 48 exemplary compound shown in Table 2 was used. Similarly, Table 2 shows the results.

Example 15

The No. 15 electrophotographic photoconductor of Example 15 was produced and then assessed in the same way as in Example 1 except that, instead of the diazapentadiene derivative of the No. 2 exemplary compound in Example 1, the No. 52 exemplary compound shown in Table 2 was used. Similarly, Table 2 shows the results.

TABLE 2

| | | | Initial | | After printing of 100,000 sheets | |
|---|---|---|---|---|---|---|
| Example No. | Photo-conductor No. | Exemplary derivative No. | Bright part potential (V) | Dot reso-lution | Bright part potential (V) | Dot reso-lution |
| 1 | 1 | 2 | 90 | 5 | 105 | 5 |
| 2 | 2 | 1 | 100 | 5 | 120 | 5 |
| 3 | 3 | 4 | 100 | 5 | 130 | 5 |
| 4 | 4 | 8 | 105 | 5 | 110 | 5 |
| 5 | 5 | 12 | 95 | 5 | 100 | 4 |
| 6 | 6 | 16 | 100 | 5 | 120 | 5 |

TABLE 2-continued

| | | | Initial | | After printing of 100,000 sheets | |
|---|---|---|---|---|---|---|
| Example No. | Photo-conductor No. | Exemplary derivative No. | Bright part potential (V) | Dot reso-lution | Bright part potential (V) | Dot reso-lution |
| 7 | 7 | 20 | 105 | 5 | 125 | 5 |
| 8 | 8 | 24 | 110 | 5 | 130 | 4 |
| 9 | 9 | 28 | 100 | 5 | 115 | 5 |
| 10 | 10 | 32 | 115 | 5 | 110 | 5 |
| 11 | 11 | 36 | 120 | 5 | 120 | 5 |
| 12 | 12 | 40 | 115 | 5 | 130 | 4 |
| 13 | 13 | 44 | 110 | 5 | 110 | 5 |
| 14 | 14 | 48 | 105 | 5 | 115 | 5 |
| 15 | 15 | 52 | 100 | 5 | 120 | 5 |

Example 16

The No. 16 electrophotographic photoconductor of Example 16 was produced in the same way as in Example 1 except that the charge transport layer coating liquid in Example 1 was replaced with one whose composition was shown below. The assessment process was conducted in the same way as in Example 1 except that, instead of the charging method of Example 1, a negatively-charged type of corona discharge (scorotron method) was used. Table 3 shows the results.

<Charge Transport Layer Coating Liquid>

Polycarbonate resin (Z POLICA, manufactured by Teijin Chemicals Ltd.): 10 parts

Diazapentadiene derivative of the No. 2 exemplary compound: 1 part

The No. 1 charge transport material of the following structural formula: 9 parts Tetrahydrofuran: 100 parts

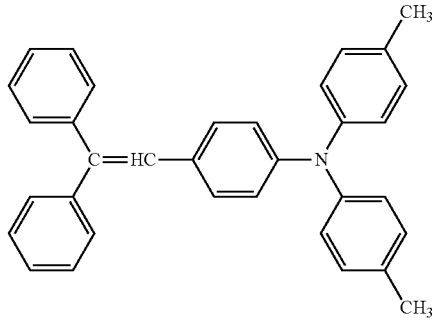

Example 17

The No. 17 electrophotographic photoconductor of Example 17 was produced in the same way as in Example 16 except that, instead of the diazapentadiene derivative of the No. 2 exemplary compound in Example 16, the diazapentadiene derivative of the No. 1 exemplary compound shown in Table 3 was used. Similarly, Table 3 shows the results.

Example 18

The No. 18 electrophotographic photoconductor of Example 18 was produced in the same way as in Example 16 except that, instead of the diazapentadiene derivative of the No. 2 exemplary compound in Example 16, the diazapentadiene derivative of the No. 4 exemplary compound shown in Table 3 was used. Similarly, Table 3 shows the results.

Example 19

The No. 19 electrophotographic photoconductor of Example 19 was produced in the same way as in Example 16 except that, instead of the diazapentadiene derivative of the No. 2 exemplary compound in Example 16, the diazapentadiene derivative of the No. 8 exemplary compound shown in Table 3 was used. Similarly, Table 3 shows the results.

Example 20

The No. 20 electrophotographic photoconductor of Example 20 was produced in the same way as in Example 16 except that, instead of the diazapentadiene derivative of the No. 2 exemplary compound in Example 16, the diazapentadiene derivative of the No. 12 exemplary compound shown in Table 3 was used. Similarly, Table 3 shows the results.

Example 21

The No. 21 electrophotographic photoconductor of Example 21 was produced in the same way as in Example 16 except that, instead of the diazapentadiene derivative of the No. 2 exemplary compound in Example 16, the diazapentadiene derivative of the No. 16 exemplary compound shown in Table 3 was used. Similarly, Table 3 shows the results.

Example 22

The No. 22 electrophotographic photoconductor of Example 22 was produced in the same way as in Example 16 except that, instead of the diazapentadiene derivative of the No. 2 exemplary compound in Example 16, the diazapentadiene derivative of the No. 20 exemplary compound shown in Table 3 was used. Similarly, Table 3 shows the results.

Example 23

The No. 23 electrophotographic photoconductor of Example 23 was produced in the same way as in Example 16 except that, instead of the diazapentadiene derivative of the No. 2 exemplary compound in Example 16, the diazapentadiene derivative of the No. 24 exemplary compound shown in Table 3 was used. Similarly, Table 3 shows the results.

Example 24

The No. 24 electrophotographic photoconductor of Example 24 was produced in the same way as in Example 16 except that, instead of the diazapentadiene derivative of the No. 2 exemplary compound in Example 16, the diazapentadiene derivative of the No. 28 exemplary compound shown in Table 3 was used. Similarly, Table 3 shows the results.

Example 25

The No. 25 electrophotographic photoconductor of Example 25 was produced in the same way as in Example 16 except that, instead of the diazapentadiene derivative of the No. 2 exemplary compound in Example 16, the diazapentadiene derivative of the No. 32 exemplary compound shown in Table 3 was used. Similarly, Table 3 shows the results.

Example 26

The No. 26 electrophotographic photoconductor of Example 26 was produced in the same way as in Example 16 except that, instead of the diazapentadiene derivative of the No. 2 exemplary compound in Example 16, the diazapentadiene derivative of the No. 36 exemplary compound shown in Table 3 was used. Similarly, Table 3 shows the results.

Example 27

The No. 27 electrophotographic photoconductor of Example 27 was produced in the same way as in Example 16 except that, instead of the diazapentadiene derivative of the No. 2 exemplary compound in Example 16, the diazapentadiene derivative of the No. 40 exemplary compound shown in Table 3 was used. Similarly, Table 3 shows the results.

Example 28

The No. 28 electrophotographic photoconductor of Example 28 was produced in the same way as in Example 16 except that, instead of the diazapentadiene derivative of the No. 2 exemplary compound in Example 16, the diazapentadiene derivative of the No. 44 exemplary compound shown in Table 3 was used. Similarly, Table 3 shows the results.

Example 29

The No. 29 electrophotographic photoconductor of Example 29 was produced in the same way as in Example 16 except that, instead of the diazapentadiene derivative of the No. 2 exemplary compound in Example 16, the diazapentadiene derivative of the No. 48 exemplary compound shown in Table 3 was used. Similarly, Table 3 shows the results.

Example 30

The No. 30 electrophotographic photoconductor of Example 30 was produced in the same way as in Example 16 except that, instead of the diazapentadiene derivative of the No. 2 exemplary compound in Example 16, the diazapentadiene derivative of the No. 52 exemplary compound shown in Table 3 was used. Similarly, Table 3 shows the results.

TABLE 3

| | | | Initial | | After printing of 100,000 sheets | |
|---|---|---|---|---|---|---|
| Example No. | Photo-conductor No. | Exemplary derivative No. | Bright part potential (V) | Dot reso-lution | Bright part potential (V) | Dot reso-lution |
| 16 | 16 | 2 | −95 | 5 | −100 | 5 |
| 17 | 17 | 1 | −100 | 5 | −105 | 5 |
| 18 | 18 | 4 | −90 | 5 | −115 | 5 |
| 19 | 19 | 8 | −105 | 5 | −120 | 5 |
| 20 | 20 | 12 | −100 | 5 | −125 | 5 |
| 21 | 21 | 16 | −105 | 5 | −110 | 5 |
| 22 | 22 | 20 | −115 | 5 | −115 | 5 |
| 23 | 23 | 24 | −100 | 5 | −125 | 4 |
| 24 | 24 | 28 | −95 | 5 | −120 | 5 |
| 25 | 25 | 32 | −90 | 5 | −100 | 5 |
| 26 | 26 | 36 | −100 | 5 | −105 | 4 |
| 27 | 27 | 40 | −105 | 5 | −120 | 5 |
| 28 | 28 | 44 | −110 | 5 | −125 | 5 |
| 29 | 29 | 48 | −120 | 5 | −130 | 4 |
| 30 | 30 | 52 | −100 | 5 | −105 | 5 |

Example 31

The Nos. 31 to 34 electrophotographic photoconductors were produced and then assessed in the same way as in Example 16 except that the amounts of the diazapentadiene derivative and the No. 1 charge transport material contained were changed as described below. Similarly, Table 4 shows the results.

Diazapentadiene derivative: 1 part

No. 1 charge transport material: 7 parts

Example 32

The No. 32 electrophotographic photoconductor of Example 32 was produced in the same way as in Example 31 except that, instead of the diazapentadiene derivative of the No. 2 exemplary compound in Example 31, the diazapentadiene derivative of the No. 16 exemplary compound shown in Table 4 was used. Similarly, Table 4 shows the results.

Example 33

The No. 33 electrophotographic photoconductor of Example 33 was produced in the same way as in Example 31 except that, instead of the diazapentadiene derivative of the No. 2 exemplary compound in Example 31, the diazapentadiene derivative of the No. 20 exemplary compound shown in Table 4 was used. Similarly, Table 4 shows the results.

Example 34

The No. 34 electrophotographic photoconductor of Example 34 was produced in the same way as in Example 31 except that, instead of the diazapentadiene derivative of the No. 2 exemplary compound in Example 31, the diazapentadiene derivative of the No. 30 exemplary compound shown in Table 4 was used. Similarly, Table 4 shows the results.

TABLE 4

| | | | Initial | | After printing of 100,000 sheets | |
|---|---|---|---|---|---|---|
| Example No. | Photo-conductor No. | Exemplary derivative No. | Bright part potential (V) | Dot reso-lution | Bright part potential (V) | Dot reso-lution |
| 31 | 31 | 2 | −100 | 5 | −105 | 5 |
| 32 | 32 | 16 | −95 | 5 | −105 | 5 |
| 33 | 33 | 20 | −95 | 5 | −105 | 4 |
| 34 | 34 | 30 | −100 | 5 | −105 | 5 |

Example 35

The No. 35 electrophotographic photoconductor of Example 35 was produced and then assessed in the same way as in Example 31 except that the No. 1 charge transport material in Example 31 was replaced with the No. 2 charge transport material shown below. Similarly, Table 5 shows the results.

No. 2 charge transport material:

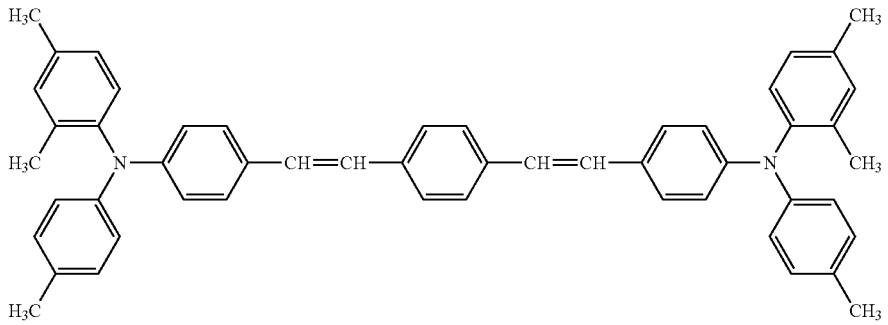

Example 36

The No. 36 electrophotographic photoconductor of Example 36 was produced and then assessed in the same way as in Example 32 except that the diazapentadiene derivative of the No. 16 exemplary compound in Example 32 was replaced with the diazapentadiene derivative of the No. 20 exemplary compound, and the No. 1 charge transport material with the above No. 2 charge transport material. Similarly, Table 5 shows the results.

Example 37

The No. 37 electrophotographic photoconductor of Example 37 was produced and then assessed in the same way as in Example 33 except that the diazapentadiene derivative of the No. 20 exemplary compound in Example 33 was replaced with the diazapentadiene derivative of the No. 40 exemplary compound, and the No. 1 charge transport material with the above No. 2 charge transport material. Similarly, Table 5 shows the results.

Example 38

The No. 38 electrophotographic photoconductor of Example 38 was produced and then assessed in the same way as in Example 34 except that the diazapentadiene derivative of the No. 30 exemplary compound in Example 34 was replaced with the diazapentadiene derivative of the No. 59 exemplary compound, and the No. 1 charge transport material with the above No. 2 charge transport material. Similarly, Table 5 shows the results.

TABLE 5

| | | | Initial | | After printing of 100,000 sheets | |
|---|---|---|---|---|---|---|
| Example No. | Photo-conductor No. | Exemplary derivative No. | Bright part potential (V) | Dot reso-lution | Bright part potential (V) | Dot reso-lution |
| 35 | 35 | 2 | −100 | 5 | −110 | 5 |
| 36 | 36 | 20 | −105 | 5 | −115 | 5 |
| 37 | 37 | 40 | −100 | 5 | −120 | 4 |
| 38 | 38 | 59 | −100 | 5 | −115 | 5 |

Example 39

The No. 39 electrophotographic photoconductor of Example 39 was produced and then assessed in the same way as in Example 31 except that the No. 1 charge transport material in Example 31 was replaced with the No. 3 charge transport material shown below. Similarly, Table 6 shows the results.

Chemical structural formula of No. 3 charge transport material:

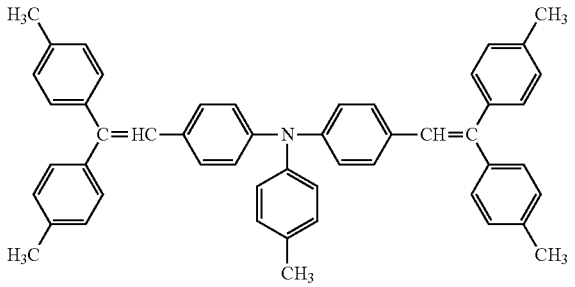

Example 40

The No. 40 electrophotographic photoconductor of Example 40 was produced and then assessed in the same way as in Example 36 except that the No. 1 charge transport material in Example 36 was replaced with the above No. 3 charge transport material. Similarly, Table 6 shows the results.

Example 41

The No. 41 electrophotographic photoconductor of Example 41 was produced and then assessed in the same way as in Example 37 except that the No. 1 charge transport material in Example 37 was replaced with the above No. 3 charge transport material. Similarly, Table 6 shows the results.

Example 42

The No. 42 electrophotographic photoconductor of Example 42 was produced and then assessed in the same way as in Example 38 except that the No. 1 charge transport material in Example 38 was replaced with the above No. 3 charge transport material. Similarly, Table 6 shows the results.

TABLE 6

| | | | Initial | | After printing of 100,000 sheets | |
|---|---|---|---|---|---|---|
| Example No. | Photo-conductor No. | Exemplary derivative No. | Bright part potential (V) | Dot reso-lution | Bright part potential (V) | Dot reso-lution |
| 39 | 39 | 2 | −105 | 5 | −115 | 5 |
| 40 | 40 | 20 | −100 | 5 | −120 | 5 |
| 41 | 41 | 40 | −110 | 5 | −125 | 4 |
| 42 | 42 | 59 | −95 | 5 | −110 | 5 |

Example 43

The No. 43 electrophotographic photoconductor of Example 43 was produced and then assessed in the same way as in Example 31 except that the No. 1 charge transport material in Example 31 was replaced with the No. 4 charge transport material shown below. Similarly, Table 7 shows the results.

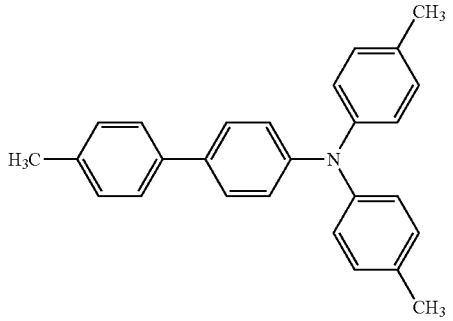

Example 44

The No. 44 electrophotographic photoconductor of Example 44 was produced and then assessed in the same way as in Example 36 except that the No. 1 charge transport material in Example 36 was replaced with the above No. 4 charge transport material. Similarly, Table 7 shows the results.

Example 45

The No. 45 electrophotographic photoconductor of Example 45 was produced and then assessed in the same way as in Example 37 except that the No. 1 charge transport material in Example 37 was replaced with the above No. 4 charge transport material. Similarly, Table 7 shows the results.

Example 46

The No. 46 electrophotographic photoconductor of Example 46 was produced and then assessed in the same way as in Example 38 except that the No. 1 charge transport material in Example 38 was replaced with the above No. 4 charge transport material. Similarly, Table 7 shows the results.

TABLE 7

| | | | Initial | | After printing of 100,000 sheets | |
|---|---|---|---|---|---|---|
| Example No. | Photo-conductor No. | Exemplary derivative No. | Bright part potential (V) | Dot reso-lution | Bright part potential (V) | Dot reso-lution |
| 43 | 43 | 2 | −95 | 5 | −100 | 5 |
| 44 | 44 | 20 | −105 | 5 | −120 | 5 |
| 45 | 45 | 40 | −95 | 5 | −125 | 4 |
| 46 | 46 | 59 | −110 | 5 | −115 | 5 |

Example 47

The No. 47 electrophotographic photoconductor of Example 47 was produced and then assessed by the same operations except that the charge generation layer coating liquid and the charge transport layer coating liquid in Example 16 were replaced with those shown below. Similarly, Table 8 shows the results.

<Charge Generation Layer Coating Liquid>

Fluorenone bisazo pigment of the following structure: 12 parts

Polyvinyl butyral (BX-1): 5 parts

2-Butanone: 400 parts

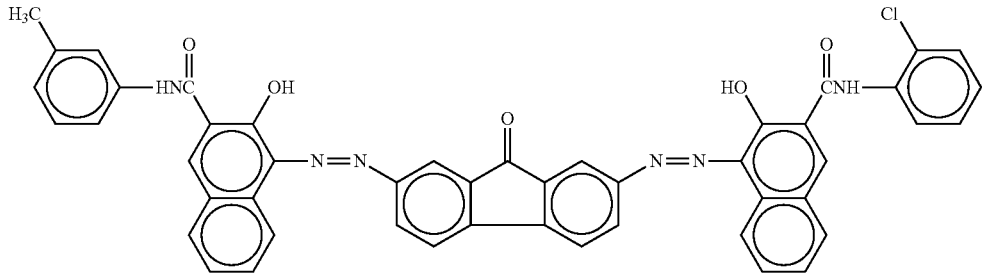

<Charge Transport Layer Coating Liquid>

Polycarbonate resin (Z POLICA): 10 parts

No. 2 diazapentadiene derivative: 1 part

No. 1 charge transport material of the following structural formula: 7 parts

Toluene: 70 parts

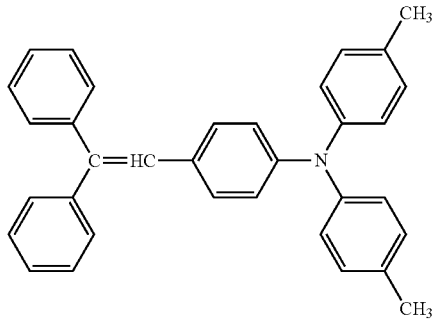

Example 48

The No. 48 electrophotographic photoconductor of Example 48 was produced and then assessed by the same operations except that, instead of the diazapentadiene derivative of the No. 2 exemplary compound in Example 47, the diazapentadiene derivative of the No. 45 exemplary compound was used. Similarly, Table 8 shows the results.

TABLE 8

| | | | Initial | | After printing of 100,000 sheets | |
|---|---|---|---|---|---|---|
| Example No. | Photo-conductor No. | Exemplary derivative No. | Bright part potential (V) | Dot reso-lution | Bright part potential (V) | Dot reso-lution |
| 47 | 47 | 2 | −105 | 5 | −115 | 5 |
| 48 | 48 | 45 | −110 | 5 | −125 | 4 |

Example 49

To the surface of an aluminum cylinder with a diameter of 100 mm, a photoconductive layer coating liquid having the composition shown below was applied and then dried. As a result, a 30 μm single-layer photoconductive layer was formed, and an electrophotographic photoconductor was obtained (the No. 49 photoconductor).

<Photoconductive Layer Coating Liquid>

X-type metal-free phthalocyanine (FASTOGENBLUE8120B: manufactured by Dainippon Ink and Chemicals, Inc.): 2 parts No. 2 charge transport material represented by the following structural formula: 30 parts

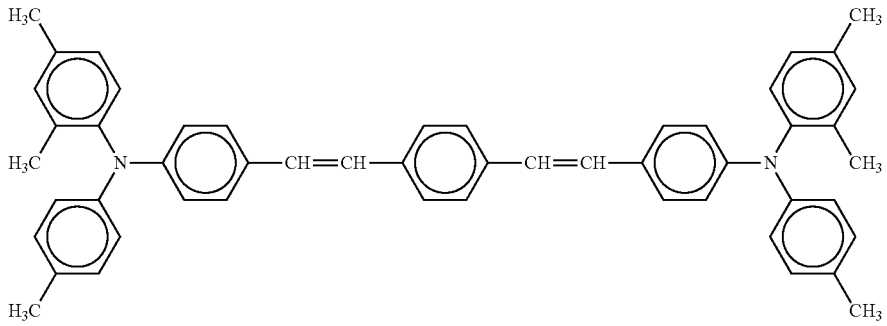

No. 2 diazapentadiene derivative: 20 parts

Bisphenol Z polycarbonate (PANLITE TS-2050, manufactured by Teijin Chemicals Ltd.): 50 parts Tetrahydrofuran: 500 parts The produced electrophotographic photoconductor was positively charged by IMAGIO NEO 752 that was manufactured by RICOH Company, Ltd. and was so modified that the charging method thereof was of a corona charging type (scorotron type) and a 780 nm semiconductor laser (LD) was used as an image exposure light source. The dark part surface potential thereof was set to +700 (V). Then, a repeat test, which amounted to a process of successively printing 100,000 copies in total, was conducted. At this time, the initial image and the image obtained after the repeat test were assessed. Moreover, the dark part potential was also measured after the repeat test. The blurred image (dot resolution) was evaluated in the same way as in Example 5. Table 9 shows the results of the evaluation.

Example 50

The electrophotographic photoconductor of Example 50 was produced and then assessed in the same way as in Example 49 except that the No. 2 diazapentadiene derivative of Example 49 was replaced with that shown in Table 9 (the No. 20 diazapentadiene derivative). Table 9 shows the results.

Example 51

The electrophotographic photoconductor of Example 51 was produced and then assessed in the same way as in Example 49 except that the No. 2 diazapentadiene derivative of Example 49 was replaced with that shown in Table 9 (the No. 40 diazapentadiene derivative). Table 9 shows the results.

Example 52

The electrophotographic photoconductor of Example 52 was produced and then assessed in the same way as in Example 49 except that the No. 2 diazapentadiene derivative of Example 49 was replaced with that shown in Table 9 (the No. 58 diazapentadiene derivative). Table 9 shows the results.

TABLE 9

| | | | Initial | | After printing of 100,000 sheets | |
|---|---|---|---|---|---|---|
| Example No. | Photo-conductor No. | Exemplary derivative No. | Bright part potential (V) | Dot reso-lution | Bright part potential (V) | Dot reso-lution |
| 49 | 49 | 2 | 100 | 5 | 115 | 5 |
| 50 | 50 | 20 | 95 | 5 | 120 | 5 |
| 51 | 51 | 40 | 105 | 5 | 120 | 5 |
| 52 | 52 | 58 | 110 | 5 | 115 | 5 |

Example 53

To the surface of an aluminum cylinder with a diameter of 30 mm, the same photoconductive layer coating liquid as that in Example 49 was applied and then dried. As a result, a 30 μm single-layer photoconductive layer was formed, and an electrophotographic photoconductor was obtained (the No. 53 photoconductor). The photoconductor was evaluated in the same way as in Example 16. Table 10 shows the results.

Example 54

The electrophotographic photoconductor of Example 54 was produced and then assessed in the same way as in Example 53 except that the No. 2 diazapentadiene derivative of Example 53 was replaced with that shown in Table 10 (the No. 20 diazapentadiene derivative). Table 10 shows the results.

Example 55

The electrophotographic photoconductor of Example 55 was produced and then assessed in the same way as in Example 53 except that the No. 2 diazapentadiene derivative of Example 53 was replaced with that shown in Table 10 (the No. 40 diazapentadiene derivative). Table 10 shows the results.

Example 56

The electrophotographic photoconductor of Example 56 was produced and then assessed in the same way as in Example 53 except that the No. 2 diazapentadiene derivative of Example 53 was replaced with that shown in Table 10 (the No. 58 diazapentadiene derivative). Table 10 shows the results.

TABLE 10

| | | | Initial | | After printing of 100,000 sheets | |
|---|---|---|---|---|---|---|
| Example No. | Photo-conductor No. | Exemplary derivative No. | Bright part potential (V) | Dot reso-lution | Bright part potential (V) | Dot reso-lution |
| 53 | 53 | 2 | −100 | 5 | −110 | 5 |
| 54 | 54 | 20 | −95 | 5 | −120 | 4 |
| 55 | 55 | 40 | −120 | 5 | −135 | 4 |
| 56 | 56 | 58 | −115 | 5 | −125 | 4 |

Example 57

To the surface of an aluminum cylinder with a diameter of 100 mm, the charge transport layer coating liquid and charge generation layer coating liquid, which each have the composition shown below, were sequentially applied and then dried. As a result, a 20 μm charge transport layer and a 0.1 μm charge generation layer were formed, and an electrophotographic photoconductor was produced (the No. 57 photoconductor). The photoconductor was evaluated in the same way as in Example 53. Table 11 shows the results of the evaluation.

<Charge Transport Layer Coating Liquid>

Bisphenol A polycarbonate (PANLITE C-1400, manufactured by Teijin Chemicals Ltd.): 10 parts Toluene: 100 parts No. 2 diazapentadiene derivative: 10 parts <Charge Generation Layer Coating Liquid>

Polyvinyl butyral (XYHL, manufactured by UCC): 0.5 parts

Cyclohexanone: 200 parts

Methyl ethyl ketone: 80 parts

X-type metal-free phthalocyanine (FASTOGENBLUE8120B: manufactured by Dainippon Ink and Chemicals, Inc.): 2 parts Example 58

The electrophotographic photoconductor of Example 58 was produced and then assessed in the same way as in Example 57 except that the No. 2 diazapentadiene derivative of Example 57 was replaced with that shown in Table 11 (the No. 20 diazapentadiene derivative). Table 11 shows the results.

Example 59

The electrophotographic photoconductor of Example 59 was produced and then assessed in the same way as in Example 57 except that the No. 2 diazapentadiene derivative of Example 57 was replaced with that shown in Table 11 (the No. 40 diazapentadiene derivative). Table 11 shows the results.

Example 60

The electrophotographic photoconductor of Example 60 was produced and then assessed in the same way as in Example 57 except that the No. 2 diazapentadiene derivative of Example 57 was replaced with that shown in Table 11 (the No. 58 diazapentadiene derivative). Table 11 shows the results.

TABLE 11

| | | | Initial | | After printing of 100,000 sheets | |
|---|---|---|---|---|---|---|
| Example No. | Photo-conductor No. | Exemplary derivative No. | Bright part potential (V) | Dot reso-lution | Bright part potential (V) | Dot reso-lution |
| 57 | 57 | 2 | −105 | 5 | −120 | 5 |
| 58 | 58 | 20 | −100 | 5 | −115 | 5 |
| 59 | 59 | 40 | −95 | 5 | −110 | 5 |
| 60 | 60 | 58 | −100 | 5 | −125 | 5 |

Comparative Example 1

The No. 1 comparative electrophotographic photoconductor of Comparative Example 1 was produced and then assessed in the same way as in Example 1 except that the No. 2 diazapentadiene derivative in Example 1 was replaced with a benzoquinone derivative shown below. Table 12 shows the results.

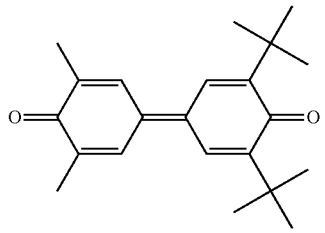

Comparative Example 2

The No. 2 comparative electrophotographic photoconductor of Comparative Example 2 was produced and then assessed in the same way as in Example 16 except that no diazapentadiene derivative was added to the charge transport layer formation coating liquid in Example 16, and the mass of the charge transport material was 10 parts. Table 12 shows the results.

Comparative Example 3

The No. 3 comparative electrophotographic photoconductor of Comparative Example 3 was produced and then assessed in the same way as in Example 35 except that the diazapentadiene derivative in Example 35 was replaced with the tetraphenylmethane compound shown below (Japanese Patent Application Laid-Open (JP-A) No. 2000-231204). Table 12 shows the results.

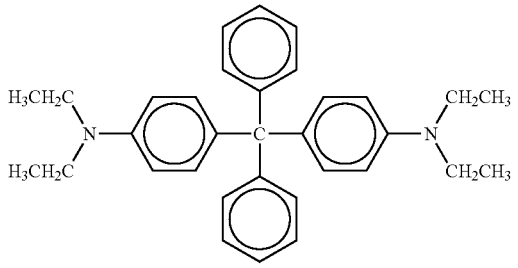

Comparative Example 4

The No. 4 comparative electrophotographic photoconductor of Comparative Example 4 was produced and then assessed in the same way as in Example 47 except that the diazapentadiene derivative in Example 47 was replaced with the hindered amine antioxidant shown below. Table 12 shows the results.

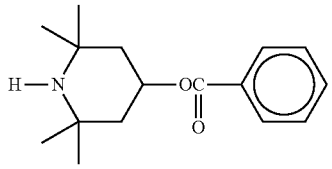

Comparative Example 5

The No. 5 comparative electrophotographic photoconductor of Comparative Example 5 was produced and then assessed in the same way as in Example 49 except that 20 parts of the No. 1 diazapentadiene derivative in Example 49 was replaced with the electron transport material shown below. Table 12 shows the results.

Charge transport material represented by the following structural formula: 18 parts

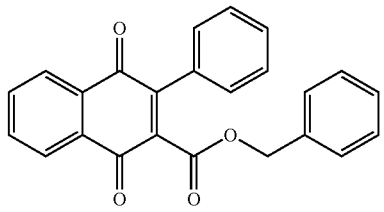

Charge transport material represented by the following structural formula: 2 parts

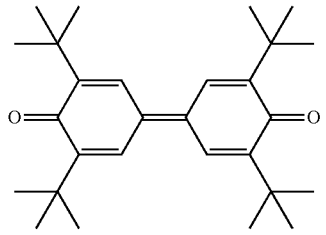

Comparative Example 6

The No. 6 comparative electrophotographic photoconductor of Comparative Example 6 was produced and then assessed in the same way as in Example 49 except that 20 parts of the No. 1 diazapentadiene derivative in Example 49 was replaced with the electron transport material shown below. Table 12 shows the results.

Charge transport material represented by the following structural formula: 20 parts

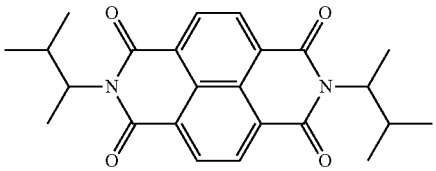

Comparative Example 7

The No. 7 comparative electrophotographic photoconductor of Comparative Example 7 was produced and then assessed in the same way as in Example 57 except that 10 parts of the No. 1 diazapentadiene derivative in Example 57 was replaced with the electron transport material shown below. Table 12 shows the results.

Charge transport material represented by the following structural formula: 9 parts

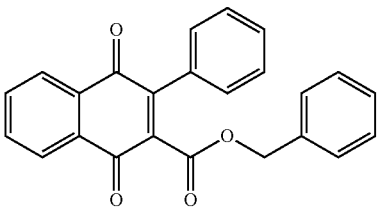

Charge transport material represented by the following structural formula: 1 part

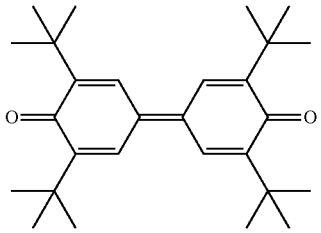

TABLE 12

| Comparative Example No. | Photoconductor No. | Initial: Bright part potential (V) | Initial: Dot resolution | After printing of 100,000 sheets: Bright part potential (V) | After printing of 100,000 sheets: Dot resolution |
|---|---|---|---|---|---|
| Comparative Example 1 | Comparison Photoconductor 1 | +250 | 3 | +440 | 1 |

TABLE 12-continued

| Comparative Example No. | Photoconductor No. | Initial: Bright part potential (V) | Initial: Dot resolution | After printing of 100,000 sheets: Bright part potential (V) | After printing of 100,000 sheets: Dot resolution |
|---|---|---|---|---|---|
| Comparative Example 2 | Comparison Photoconductor 2 | −100 | 5 | −135 | 2 |
| Comparative Example 3 | Comparison Photoconductor 3 | −200 | 4 | −285 | 3 |
| Comparative Example 4 | Comparison Photoconductor 4 | −250 | 2 | −480 | 1 |
| Comparative Example 5 | Comparison Photoconductor 5 | +105 | 5 | +145 | 1 |
| Comparative Example 6 | Comparison Photoconductor 6 | +110 | 4 | +155 | 1 |
| Comparative Example 7 | Comparison Photoconductor 7 | −100 | 4 | −120 | 1 |

Based on the evaluation results shown above, it was confirmed that the increases in bright part potential were small even after the printing of 100,000 sheets, and that the photoconductors containing the diazapentadiene derivative enabled high-quality images to be obtained in a stable manner. Meanwhile, in the case of the comparative photoconductors 1, 3 and 4, the bright part potential was extremely high from the beginning, leading to a decrease in image density as well as a decrease in resolution; after the printing of 100,000 sheets, it was not possible to distinguish images because of a remarkable decline in tone. Furthermore, given the evaluation results of Tables 1 and 9, it is clear that excellent images were obtained even with the photoconductors of a positively charged type; even after the printing of 100,000 sheets, the qualities of the images were excellent, and the results of evaluation as to blurred images (dot resolution), too, were excellent. In the case of the comparative photoconductors 2, 5, 6 and 7, even though the increases in bright part potential were relatively small, the resolution decreased more dramatically than the photoconductors at the time of repeated use.

Example 61

The No. 2 electrophotographic photoconductor was left for four days in a desiccator that was so adjusted that the concentration of nitrogen oxide gas (NOx) was 50 ppm; the images before and after the operation were evaluated. Table 13 shows the results.

Example 62

The No. 10 electrophotographic photoconductor was left for four days in a desiccator that was so adjusted that the concentration of nitrogen oxide gas (NOx) was 50 ppm; the images before and after the operation were evaluated. Table 13 shows the results.

Example 63

The No. 20 electrophotographic photoconductor was left for four days in a desiccator that was so adjusted that the concentration of nitrogen oxide gas (NOx) was 50 ppm; the images before and after the operation were evaluated. Table 13 shows the results.

Example 64

The No. 30 electrophotographic photoconductor was left for four days in a desiccator that was so adjusted that the concentration of nitrogen oxide gas (NOx) was 50 ppm; the images before and after the operation were evaluated. Table 13 shows the results.

Example 65

The No. 40 electrophotographic photoconductor was left for four days in a desiccator that was so adjusted that the concentration of nitrogen oxide gas (NOx) was 50 ppm; the images before and after the operation were evaluated. Table 13 shows the results.

Example 66

The No. 50 electrophotographic photoconductor was left for four days in a desiccator that was so adjusted that the concentration of nitrogen oxide gas (NOx) was 50 ppm; the images before and after the operation were evaluated. Table 13 shows the results.

Example 67

The No. 59 electrophotographic photoconductor was left for four days in a desiccator that was so adjusted that the concentration of nitrogen oxide gas (NOx) was 50 ppm; the images before and after the operation were evaluated. Table 13 shows the results.

Comparative Example 8

The No. 2 comparative electrophotographic photoconductor was left for four days in a desiccator that was so adjusted that the concentration of nitrogen oxide gas (NOx) was 50 ppm; the images before and after the operation were evaluated. Table 13 shows the results.

TABLE 13

| Example/ Comparative Example No. | Photoconductor No. | Initial image quality | Image quality after being left |
|---|---|---|---|
| Example 61 | 2 | 5 | 5 |
| Example 62 | 10 | 5 | 5 |
| Example 63 | 20 | 5 | 4 |
| Example 64 | 30 | 5 | 5 |
| Example 65 | 40 | 5 | 4 |
| Example 66 | 50 | 5 | 5 |
| Example 67 | 59 | 5 | 5 |
| Comparative Example 8 | Comparative photoconductor 2 | 5 | 1 |

From the evaluation results shown in Table 13, it is clear that the photoconductors containing the diazapentadiene derivative help to dramatically improve the resistance to oxidized gas, i.e. the ability to prevent a decrease in resolution. Meanwhile, in the case of the comparative photoconductor 2, the quality of the initial image was excellent. However, it was found that the resolution decreased dramatically due to oxidized gas.

Aspects of the present invention are as follows.

<1> An electrophotographic photoconductor including:

an electrically conductive substrate; and at least a photoconductive layer laid on the electrically conductive substrate, wherein the photoconductive layer contains a diazapentadiene derivative represented by the following general formula (1);

General Formula (1)

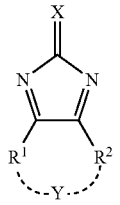

in the general formula (1), "X" represents the following general formula (a), (b) or (c); "$R^1$" and "$R^2$" each represent a substituted or unsubstituted alkyl group or a substituted or unsubstituted aromatic hydrocarbon group, and may be the same or different; the "$R^1$" and "$R^2$" may be joined together via "Y" to form a ring; "Y" represents a single bond, an oxygen atom, —$CH_2CH_2$—, or —CH═CH—.

General Formula (a)

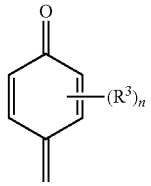

General Formula (b)

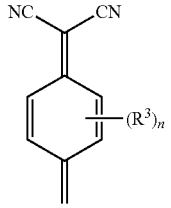

General Formula (c)

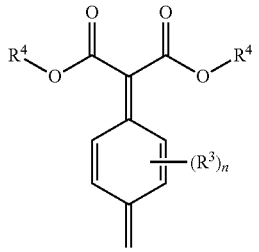

In the general formula (a), (b) or (c), "$R^3$" represents a substituted or unsubstituted alkyl group, a substituted or unsubstituted aromatic hydrocarbon group, a substituted or unsubstituted alkoxy group, an alkoxycarbonyl group, or a halogen group; "$R^4$" represents a substituted or unsubstituted alkyl group, or a substituted or unsubstituted aromatic hydrocarbon group; "n" represents an integer ranging from 0 to 4; and when "n" is an integer of 2 to 4, "$R^3$" may be the same or different.

<2> The electrophotographic photoconductor according to <1>, wherein the photoconductive layer further contains a charge transport material.

<3> The electrophotographic photoconductor according to <2>, wherein the charge transport material is a compound represented by the following general formula (2).

General Formula (2)

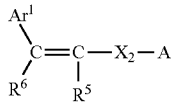

In the general formula (2), "$X_2$" represents a single bond or a vinylene group; "$R^5$" represents a hydrogen atom, a substituted or unsubstituted alkyl group, or a substituted or unsubstituted aromatic hydrocarbon group; "$Ar^1$" represents a substituted or unsubstituted aromatic hydrocarbon group; "$R^6$" represents a hydrogen atom, a substituted or unsubstituted alkyl group, or a substituted or unsubstituted aromatic hydrocarbon group; "$Ar^1$" and "$R^6$" may together form a ring; "A" represents the following general formula (3), the following general formula (4), a 9-anthryl group, or a substituted or unsubstituted carbazolyl group.

General Formula (3)

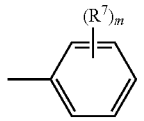

General Formula (4)

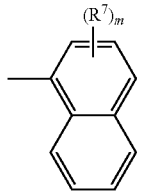

In the general formulae (3) and (4), each "$R^7$" independently represents a hydrogen atom, an alkyl group, an alkoxy group, a halogen atom, or the following general formula (5); "m" represents an integer ranging from 1 to 3; and when "m" represents 2 or greater, "$R^7$" may be the same or different.

General Formula (5)

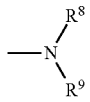

In the general formula (5), "$R^8$" and "$R^9$" each represent a substituted or unsubstituted alkyl group or a substituted or unsubstituted aromatic hydrocarbon group; the "$R^8$" and "$R^9$" may be the same or different, and may form a ring; and when the "m" in the general formulae (3) and (4) is 2 or greater, the "$R^8$" or "$R^9$" may be the same or different.

<4> The electrophotographic photoconductor according to <2>, wherein the charge transport material is a compound represented by the following general formula (6).

General Formula (6)

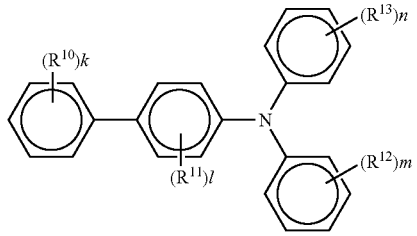

In the general formula (6), "$R^{10}$," "$R^{12}$" and "$R^{13}$" each represent a hydrogen atom, an amino group, an alkoxy group, a thioalkoxy group, an aryloxy group, a methylenedioxy group, a substituted or unsubstituted alkyl group, a halogen atom, or a substituted or unsubstituted aromatic hydrocarbon group; "$R^{11}$" represents a hydrogen atom, an alkoxy group, a substituted or unsubstituted alkyl group, or a halogen atom; "k," "l," "m," and "n" each represent an integer ranging from 1 to 4; and when the "k," "l," "m," or "n" is an integer ranging from 2 to 4, the "$R^{10}$," "$R^{11}$," "$R^{12}$" or "$R^{13}$" may be the same or different.

<5> The electrophotographic photoconductor according to <2>, wherein the charge transport material is a compound represented by the following general formula (7).

General Formula (7)

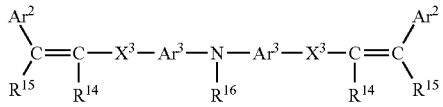

In the general formula (7), "$X^3$" represents a single bond or a vinylene group; "$R^{14}$" independently represents a hydrogen atom, a substituted or unsubstituted alkyl group, or a substituted or unsubstituted aromatic hydrocarbon group; "$Ar^2$" independently represents a substituted or unsubstituted aromatic hydrocarbon group; "$R^{15}$" independently represents a hydrogen atom, a substituted or unsubstituted alkyl group, or a substituted or unsubstituted aromatic hydrocarbon group; the "$Ar^2$" and "$R^{15}$" may together form a ring; and "$Ar^3$" represents the following general formula (8) or (9).

General Formula (8)

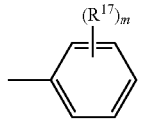

General Formula (9)

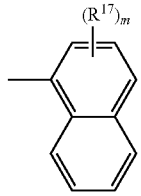

In the general formulae (8) and (9), "$R^{17}$" represents a hydrogen atom, an alkyl group, an alkoxy group, or a halogen atom; "m" represents an integer ranging from 1 to 3; when the "m" is 2 or greater, "$R^{17}$" may be the same or different; "$R^{16}$" represents a substituted or unsubstituted alkyl group, or a substituted or unsubstituted aromatic hydrocarbon group.

<6> The electrophotographic photoconductor according to <2>, wherein the charge transport material is a compound represented by the following general formula (10).

General Formula (10)

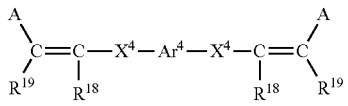

In the general formula (10), "$X^4$" represents a single bond or a vinylene group; "$R^{18}$" represents a hydrogen atom, a substituted or unsubstituted alkyl group, or a substituted or unsubstituted aromatic hydrocarbon group; "$Ar^4$" represents a substituted or unsubstituted divalent aromatic hydrocarbon group; "$R^{19}$" represents a hydrogen atom, a substituted or unsubstituted alkyl group, or a substituted or unsubstituted aromatic hydrocarbon group; "A" represents the following general formula (3), the following general formula (4), a 9-anthryl group, or a substituted or unsubstituted carbazolyl group.

General Formula (3)

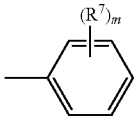

General Formula (4)

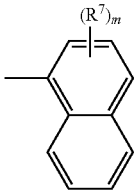

In the general formulae (3) and (4), "$R^7$" represents a hydrogen atom, an alkyl group, an alkoxy group, a halogen atom, or the following general formula (5); "m" represents an integer ranging from 1 to 3; and when "m" represents 2 or greater, "$R^7$" may be the same or different.

General Formula (5)

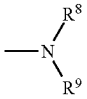

In the above general formula (5), "$R^8$" and "$R^9$" represent a substituted or unsubstituted alkyl group, or a substituted or unsubstituted aromatic hydrocarbon group; the "$R^8$" and "$R^9$" may be the same or different, and may form a ring; and when the "m" in the general formulae (3) and (4) is 2 or greater, the "$R^8$" or "$R^9$" may be the same or different.

<7> The electrophotographic photoconductor according to any one of <1> to <6>, wherein the photoconductive layer contains a charge generation layer and a charge transport layer which are laminated on the electrically conductive substrate in this order.

<8> The electrophotographic photoconductor according to any one of <1> to <6>, wherein the photoconductive layer contains a charge transport layer and a charge generation layer which are laminated on the electrically conductive substrate in this order.

<9> The electrophotographic photoconductor according to any one of <1> to <6>, wherein the photoconductive layer is a photoconductive layer having a single-layered structure.

<10> An electrophotographic method including:

repeatedly performing a process containing charging, imagewise exposing, developing and transferring on the electrophotographic photoconductor according to any one of <1> to <9>.

<11> A digital electrophotographic method including:

repeatedly performing a process containing charging, imagewise exposing, developing and transferring on the electrophotographic photoconductor according to any one of <1> to <9>, wherein the imagewise exposing is forming a latent electrostatic image on the electrophotographic photoconductor with LD or LED.

<12> An electrophotographic apparatus including:

a charging unit;

an imagewise exposing unit;

a developing unit;

a transferring unit; and the electrophotographic photoconductor according to any one of <1> to <9>.

<13> A digital electrophotographic apparatus including:

a charging unit;

an imagewise exposing unit;

a developing unit;

a transferring unit; and the electrophotographic photoconductor according to any one of <1> to <9>, wherein the imagewise exposing unit is configured to form a latent electrostatic image on the electrophotographic photoconductor with LD or LED.

<14> A process cartridge for an electrophotographic apparatus, the process cartridge including:

the electrophotographic photoconductor according to any one of <1> to <9>.

This application claims priority to Japanese application No. 2011-074441, filed on Mar. 30, 2011 and incorporated herein by reference.

What is claimed is:

1. An electrophotographic photoconductor comprising:

an electrically conductive substrate; and at least a photoconductive layer laid on the electrically conductive substrate, wherein the photoconductive layer contains a diazapentadiene derivative represented by the following general formula (1):

General Formula (1)

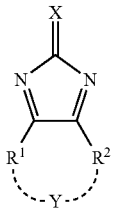

in the general formula (1), "X" represents the following general formula (a), (b) or (c); "$R^1$" and "$R^2$" each represent a substituted or unsubstituted alkyl group or a substituted or unsubstituted aromatic hydrocarbon group, and may be the same or different; the "$R^1$" and "$R^2$" may be joined together via "Y" to form a ring; "Y" represents a single bond, an oxygen atom, —$CH_2CH_2$—, or —CH═CH—, General Formula (a)

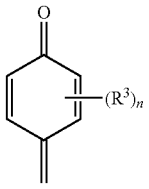

-continued

General Formula (b)

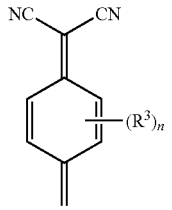

General Formula (c)

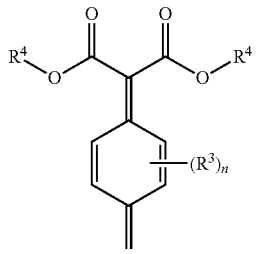

in the general formula (a), (b) or (c), "$R^3$" represents a substituted or unsubstituted alkyl group, a substituted or unsubstituted aromatic hydrocarbon group, a substituted or unsubstituted alkoxy group, an alkoxycarbonyl group, or a halogen group; "$R^4$" represents a substituted or unsubstituted alkyl group, or a substituted or unsubstituted aromatic hydrocarbon group; "n" represents an integer ranging from 0 to 4; and when "n" is an integer of 2 to 4, "$R^3$" may be the same or different.

2. The electrophotographic photoconductor according to claim 1, wherein the photoconductive layer further comprises a charge transport material.

3. The electrophotographic photoconductor according to claim 2, wherein the charge transport material is a compound represented by the following general formula (2);

General Formula (2)

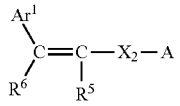

in the general formula (2), "$X_2$" represents a single bond or a vinylene group; "$R^5$" represents a hydrogen atom, a substituted or unsubstituted alkyl group, or a substituted or unsubstituted aromatic hydrocarbon group; "$Ar^1$" represents a substituted or unsubstituted aromatic hydrocarbon group; "$R^6$" represents a hydrogen atom, a substituted or unsubstituted alkyl group, or a substituted or unsubstituted aromatic hydrocarbon group; "$Ar^1$" and "$R^6$" may together form a ring; "A" represents the following general formula (3), the following general formula (4), a 9-anthryl group, or a substituted or unsubstituted carbazolyl group:

General Formula (3)

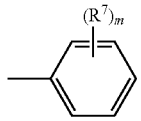

-continued

General Formula (4)

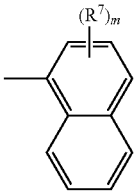

in the general formulae (3) and (4), "$R^7$" each independently represents a hydrogen atom, an alkyl group, an alkoxy group, a halogen atom, or the following general formula (5); "m" represents an integer ranging from 1 to 3; and when "m" represents 2 or greater, "$R^7$" may be the same or different:

General Formula (5)

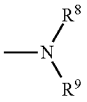

in the general formula (5), "$R^8$" and "$R^9$" each represent a substituted or unsubstituted alkyl group or a substituted or unsubstituted aromatic hydrocarbon group; the "$R^8$" and "$R^9$" may be the same or different, and may form a ring; when the "m" is 2 or greater in the general formulae (3) and (4), the "$R^8$" or "$R^9$" may be the same or different.

4. The electrophotographic photoconductor according to claim 2, wherein the charge transport material is a compound represented by the following general formula (6);

General Formula (6)

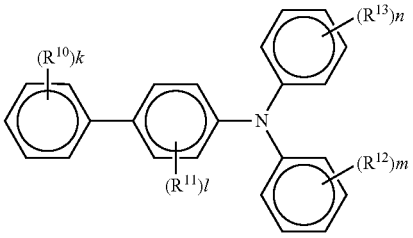

in the general formula (6), "$R^{10}$," "$R^{12}$" and "$R^{13}$" each represent a hydrogen atom, an amino group, an alkoxy group, a thioalkoxy group, an aryloxy group, a methylenedioxy group, a substituted or unsubstituted alkyl group, a halogen atom, or a substituted or unsubstituted aromatic hydrocarbon group; "$R^{11}$" represents a hydrogen atom, an alkoxy group, a substituted or unsubstituted alkyl group, or a halogen atom; "k," "l," "m," and "n" each represent an integer ranging from 1 to 4; and when the "k," "l," "m," or "n" is an integer ranging from 2 to 4, the "$R^{10}$," "$R^{11}$," "$R^{12}$" or "$R^{13}$" may be the same or different.

5. The electrophotographic photoconductor according to claim 2, wherein the charge transport material is a compound represented by the following general formula (7);

General Formula (7)

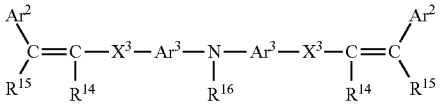

in the general formula (7), "$X^3$" represents a single bond or a vinylene group; "$R^{14}$" independently represents a hydrogen atom, a substituted or unsubstituted alkyl group, or a substituted or unsubstituted aromatic hydrocarbon group; "$Ar^2$" independently represents a substituted or unsubstituted aromatic hydrocarbon group; "$R^{15}$" independently represents a hydrogen atom, a substituted or unsubstituted alkyl group, or a substituted or unsubstituted aromatic hydrocarbon group; the "$Ar^2$" and "$R^{15}$" may together form a ring; and "$Ar^3$" represents the following general formula (8) or (9);

General Formula (8)

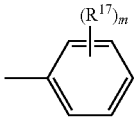

General Formula (9)

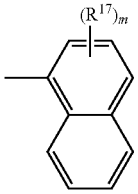

in the general formulae (8) and (9), "$R^{17}$" represents a hydrogen atom, an alkyl group, an alkoxy group, or a halogen atom; "m" represents an integer ranging from 1 to 3; when the "m" is 2 or greater, "$R^{17}$" may be the same or different; "$R^{16}$" represents a substituted or unsubstituted alkyl group, or a substituted or unsubstituted aromatic hydrocarbon group.

6. The electrophotographic photoconductor according to claim 2, wherein the charge transport material is a compound represented by the following general formula (10):

General Formula (10)

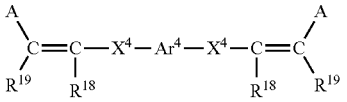

in the general formula (10), "$X^4$" represents a single bond or a vinylene group; "$R^{18}$" represents a hydrogen atom, a substituted or unsubstituted alkyl group, or a substituted or unsubstituted aromatic hydrocarbon group; "$Ar^4$" represents a substituted or unsubstituted divalent aromatic hydrocarbon group; "$R^{19}$" represents a hydrogen atom, a substituted or unsubstituted alkyl group, or a substituted or unsubstituted aromatic hydrocarbon group; "A" represents the following general formula (3), the following general formula (4), a 9-anthryl group, or a substituted or unsubstituted carbazolyl group:

General Formula (3)

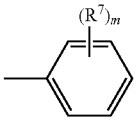

General Formula (4)

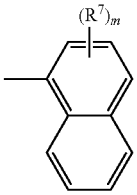

in the general formulae (3) and (4), "$R^7$" represents a hydrogen atom, an alkyl group, an alkoxy group, a halogen atom, or the following general formula (5); "m" represents an integer ranging from 1 to 3; and when "m" represents 2 or greater, "$R^7$" may be the same or different:

General Formula (5)

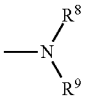

in the above general formula (5), "$R^8$" and "$R^9$" represent a substituted or unsubstituted alkyl group, or a substituted or unsubstituted aromatic hydrocarbon group; the "$R^8$" and "$R^9$" may be the same or different, and may form a ring; and when the "m" in the general formulae (3) and (4) is 2 or greater, the "$R^8$" or "$R^9$" may be the same or different.

7. The electrophotographic photoconductor according to claim 1, wherein the photoconductive layer comprises a charge generation layer and a charge transport layer which are laminated on the electrically conductive substrate in this order.

8. The electrophotographic photoconductor according to claim 1, wherein the photoconductive layer comprises a charge transport layer and a charge generation layer which are laminated on the electrically conductive substrate in this order.

9. The electrophotographic photoconductor according to claim 1, wherein the photoconductive layer is a photoconductive layer having a single-layered structure.

10. An electrophotographic method comprising:

repeatedly performing a process comprising charging, imagewise exposing, developing and transferring on an electrophotographic photoconductor which comprises:

an electrically conductive substrate; and at least a photoconductive layer laid on the electrically conductive substrate, wherein the photoconductive layer contains a diazapentadiene derivative represented by the following general formula (1):

General Formula (1)

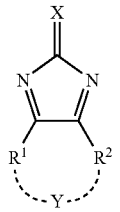

in the general formula (1), "X" represents the following general formula (a), (h) or (c); "$R^1$" and "$R^2$" each represent a substituted or unsubstituted alkyl group or a substituted or unsubstituted aromatic hydrocarbon group, and may be the same or different; the "$R^1$" and "$R^2$" may be joined together via "Y" to form a ring; "Y" represents a single bond, an oxygen atom, —$CH_2CH_2$—, or —CH═CH—, General Formula (a)

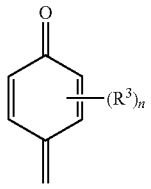

General Formula (b)

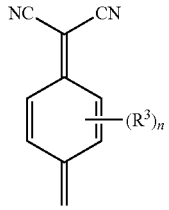

General Formula (c)

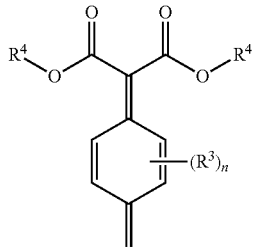

in the general formula (a), (b) or (c), "$R^3$" represents a substituted or unsubstituted alkyl group, a substituted or unsubstituted aromatic hydrocarbon group, a substituted or unsubstituted alkoxy group, an alkoxycarbonyl group, or a halogen group; "$R^4$" represents a substituted or unsubstituted alkyl group, or a substituted or unsubstituted aromatic hydrocarbon group; "n" represents an integer ranging from 0 to 4; and when "n" is an integer of 2 to 4, "$R^3$" may be the same or different.

11. The electrophotographic method according to claim 10, wherein the imagewise exposing is forming a latent electrostatic image on the electrophotographic photoconductor with LD or LED.

12. An electrophotographic apparatus comprising:

a charging unit;

an imagewise exposing unit;

a developing unit;

a transferring unit; and an electrophotographic photoconductor which comprises:

an electrically conductive substrate; and at least a photoconductive layer laid on the electrically conductive substrate, wherein the photoconductive layer contains a diazapentadiene derivative represented by the following general formula (1);

General Formula (1)

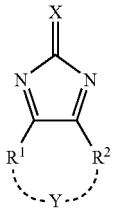

in the general formula (1), "X" represents the following general formula (a), (b) or (c); "$R^1$" and "$R^2$" each represent a substituted or unsubstituted alkyl group or a substituted or unsubstituted aromatic hydrocarbon group, and may be the same or different; the "$R^1$" and "$R^2$" may be joined together via "Y" to form a ring; "Y" represents a single bond, an oxygen atom, —$CH_2CH_2$—, or —CH═CH—, General Formula (a)

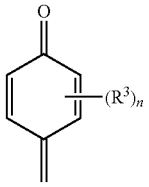

General Formula (b)

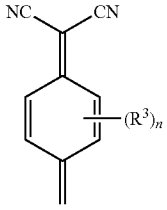

General Formula (c)

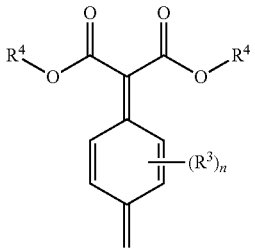

in the general formula (a), (b) or (c), "$R^3$" represents a substituted or unsubstituted alkyl group, a substituted or unsubstituted aromatic hydrocarbon group, a substituted or unsubstituted alkoxy group, an alkoxycarbonyl group, or a halogen group; "$R^4$" represents a substituted or unsubstituted alkyl group, or a substituted or unsubstituted aromatic hydrocarbon group; "n" represents an integer ranging from 0 to 4; and when "n" is an integer of 2 to 4, "$R^3$" may be the same or different.

13. The electrophotographic apparatus according to claim 12, wherein the imagewise exposing unit is configured to form a latent electrostatic image on the electrophotographic photoconductor with LD or LED.

* * * * *